US008260163B2

(12) United States Patent
Shibuya et al.

(10) Patent No.: US 8,260,163 B2
(45) Date of Patent: Sep. 4, 2012

(54) IMAGE FORMING APPARATUS INCLUDING CONTROL FOR REMOVING ELECTRICAL DISCHARGE PRODUCT

(75) Inventors: Kenichi Shibuya, Toride (JP); Takayuki Ganko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 401 days.

(21) Appl. No.: 12/603,949

(22) Filed: Oct. 22, 2009

(65) Prior Publication Data

US 2010/0111556 A1 May 6, 2010

(30) Foreign Application Priority Data

Nov. 5, 2008 (JP) ..... 2008-284885

(51) Int. Cl.
*G03G 15/00* (2006.01)

(52) U.S. Cl. ..... 399/48; 399/31; 399/50; 399/101; 399/343

(58) Field of Classification Search ..... 399/31, 399/48, 50, 101, 343
See application file for complete search history.

(56) References Cited

U.S. PATENT DOCUMENTS

| | | | | |
|---|---|---|---|---|
| 7,298,983 | B2 | 11/2007 | Silvestri et al. | 399/48 |
| 2004/0218939 | A1 | 11/2004 | Motohashi et al. | |
| 2006/0088325 | A1* | 4/2006 | Suzuki | 399/44 |
| 2007/0059000 | A1 | 3/2007 | Shibuya | |
| 2008/0107451 | A1* | 5/2008 | Nukada et al. | 399/176 |

FOREIGN PATENT DOCUMENTS

| | | | |
|---|---|---|---|
| JP | 07-234619 | A | 9/1995 |
| JP | 09-190144 | A | 7/1997 |
| JP | 11-143294 | A | 5/1999 |
| JP | 2005-091734 | A | 4/2005 |
| JP | 2006-234894 | A | 9/2006 |

OTHER PUBLICATIONS

Communication Appln. No. 09174196.7-2209, European Patent Office, Feb. 22, 2010.
Office Action—Korean Patent Appln. No. 2009-106399 issued by the Korean Patent Office, Feb. 22, 2012.

* cited by examiner

*Primary Examiner* — Ryan Walsh
(74) *Attorney, Agent, or Firm* — Fitzpatrick, Cella, Harper & Scinto

(57) ABSTRACT

An image forming apparatus includes a photosensitive member; a charging member contactable to said photosensitive member to electrically charge said photosensitive member; applying means applying a charging bias voltage to said charging member; detecting means detecting a current flowing between said charging member and said photosensitive member; a controller for controlling said image forming apparatus to execute an operational mode for removing an electric discharge product deposited on a surface of said photosensitive member, in the case that detecting means detects a current not lower than a predetermined value when a voltage lower than a voltage at which an electric charge starts between said photosensitive member and said charging member is applied to said charging member.

9 Claims, 30 Drawing Sheets

APPLIED DC VOL. VS. DRUM POTENTIAL

APPLIED DC VOL. VS. DC CURRENT

IDLE ROTATION TIME VS. Idc
(50μA OF DISCHARGE CURRENT)

R. HUMIDITY VS. DIM OCCURRENCE Idc
(DC= -500V)

R. HUMIDITY VS. DIM OCCURRENCE Idc
(DC: -500V)

IMAGE FORMING APPARATUS INCLUDING CONTROL FOR REMOVING ELECTRICAL DISCHARGE PRODUCT

FIELD OF THE INVENTION AND RELATED ART

The present invention relates to an image forming apparatus such as an electrophotographic copying machine, a printer, a facsimile, and the like.

An image forming apparatus which uses a charging method of the so-called contact type, that is, an image forming apparatus which charges its photosensitive member by placing its charging member in contact with the photosensitive member, is smaller in the amount of electrical discharge than an image forming apparatus which uses a charging method of the so-called corona type. Thus, the former is smaller in the amount of byproducts, such as ozone ($O_3$), nitrogen oxides (NOx), etc., which are generated by the electrical discharge, than the latter. However, the former generates the byproducts of electrical discharge in a microscopic gap between its photosensitive member and charging member. Thus, a small amount of the byproducts of electrical discharge, such as the aforementioned ozone and NOX, adheres to the peripheral surface of the photosensitive member. As the byproducts adhere to the peripheral surface of the photosensitive member, the peripheral surface reduces in the capability to hold electrical charge (it reduces in electrical resistance), even if the amount of the byproducts is very small. It has been known that this reduction in the charge holding capability of the peripheral surface of a photosensitive member is likely to cause an image forming apparatus to output a print which is noticeably blurry and/or dim (flowing image or image flow). This reduction occurs because the byproducts absorb humidity in an environment which is high in humidity. Further, a charging method which uses an AC voltage along with a DC voltage to charge a photosensitive member is greater in the amount of discharge current than a charging method which uses only a DC voltage. Therefore, the employment of the former has been known to be more likely to result in the formation of the noticeably blurry and/or dim image than the employment of the latter.

Japanese Laid-open Patent Application H11-143294 discloses an image forming apparatus structured so that a heater is disposed inside a photosensitive member, or in the adjacencies of the photosensitive member, to dry the peripheral surface of the photosensitive member to prevent the apparatus from forming a noticeably blurry and/or dim image, and the like. Further, Japanese Laid-open Patent Application 2003-32307 discloses a method for removing the aforementioned byproducts of electrical discharge. This method removes the byproducts of electrical discharge by increasing the number of frictional contacts, per unit of time, between the cleaner blade, which is placed in contact with a photosensitive member, and the photosensitive member, by rotating the photosensitive member for an extra length of time, or an extra number of times. Further, Japanese Laid-open Patent Application H07-234619 discloses a method for improving a cleaner blade, in polishing performance, by supplying the peripheral surface of a photosensitive member with polishing agent. Further, there has been known a method for supplying the peripheral surface of a photosensitive member with a mold separation agent to make it difficult for the byproducts of electrical discharge to remain adhered to the peripheral surface of the photosensitive member.

In consideration of the reduction in energy consumption, and the durability of a photosensitive member, it is desired that any of the above described methods is carried out only when it is noticed that the amount by which electrical charge drains from the peripheral surface of a photosensitive drum has become greater than a preset value (threshold value).

More concretely, in the case where a heater is used to increase a photosensitive member in temperature, an additional amount of electrical power is consumed by keeping the heater turned on. In the case of the method which rotates a photosensitive member an additional number or times, the additional number of rotations of the photosensitive member reduces an image forming apparatus in productivity, and/or reduces the photosensitive member in service life, because the photosensitive member is additionally shaved by the additional rotation of the photosensitive member. In other words, a feed-forward control, that is, a control method which carries out the operation for preventing the formation of the above described noticeably blurry and/or dim image, even when such an image is not being formed, causes such problems as increase in down-time, increase in electrical power consumption, increase in the amount of shaving of the drum (which reduces drum in service life), and the like.

Thus, it is desired that the operation for preventing an image forming apparatus from forming a noticeably blurry and/or dim image is carried out only when it has been detected that the peripheral surface of a photosensitive member had reduced in electrical resistance by an amount large enough to result in the formation of a noticeably blurry and/or dim image (feed-back control).

One of the methods for detecting the reduction in the electrical resistance of the peripheral surface of a photosensitive member, which is one of the primary causes of the formation of a noticeably blurry and/or dim is recorded in U.S. Pat. No. 7,298,983. To concretely describe this patent, a photosensitive member is charged, and then, a latent image is formed on the charged photosensitive member. Then, whether or not the photosensitive member has been decreased in electrical resistance by an amount large enough to result in the formation of a noticeably blurry and/or dim image is determined by forming another latent image on the photosensitive member after the elapsing of a preset length of time. However, in order for this method to reliably detect whether or not the electrical resistance of the peripheral surface of a photosensitive member has reduced, the photosensitive member has to be rotated at least one full turn. Thus, this method for detecting the reduction in the electrical resistance of the peripheral surface of a photosensitive member is problematic in that the employment of this method reduces an image forming apparatus in productivity.

SUMMARY OF THE INVENTION

Thus, the primary object of the present invention is to provide an automatic method for detecting whether or not the photosensitive member of an electrophotographic image forming apparatus is in the state which causes the image forming apparatus to form a noticeably blurry and/or dim image, without requiring additional time and additional space, so that the mode for preventing the formation of a noticeably blurry and/or dim image, is activated only as necessary.

More concretely, in order to detect a significant amount of reduction in the electrical resistance of the peripheral surface of the photosensitive member of an electrophotographic image forming apparatus, an electric voltage which is no more than the discharge start voltage is applied between the photosensitive member, and the charging member of the apparatus, which is placed in contact with the photosensitive member to charge the photosensitive member. If the voltage applied to the charging member is no more than the discharge start voltage, and the electrical resistance of the peripheral surface of the photosensitive member is higher than a certain value, no electric current, which is attributable to electrical discharge, flows between the photosensitive member and charging member. However, it has become evident that if the peripheral surface of the photosensitive member reduces in electrical resistance by an amount large enough to cause the apparatus to form a noticeably blurry and/or dim image, electrical charge is injected into the photosensitive member by the charging member even if a voltage which is no higher than the discharge start voltage is applied to the charging member. Thus, whether or not the peripheral surface of the photosensitive member has reduced in electrical resistance by the amount large enough to cause the apparatus to form a noticeably blurry and/or dim image, can be determined by detecting the electric current which flows between the photosensitive member and charging member when a voltage which is no higher than the discharge start voltage is applied. The usage of a method such as the above described one makes it possible to detect whether or not the peripheral surface of a photosensitive member has reduced in electrical resistance by an amount large enough to cause the apparatus to form a noticeably blurry and/or dim image, without rotating the photosensitive member by one full turn. Thus, unlike the method recorded in U.S. Pat. No. 7,298,983, the method in accordance with the present invention does not significantly reduce an electrophotographic image forming apparatus in productivity.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatuses in the preferred embodiments of the present invention will be described in more detail.

Embodiment 1

1. General Structure of Image Forming Apparatus

Figure 1:
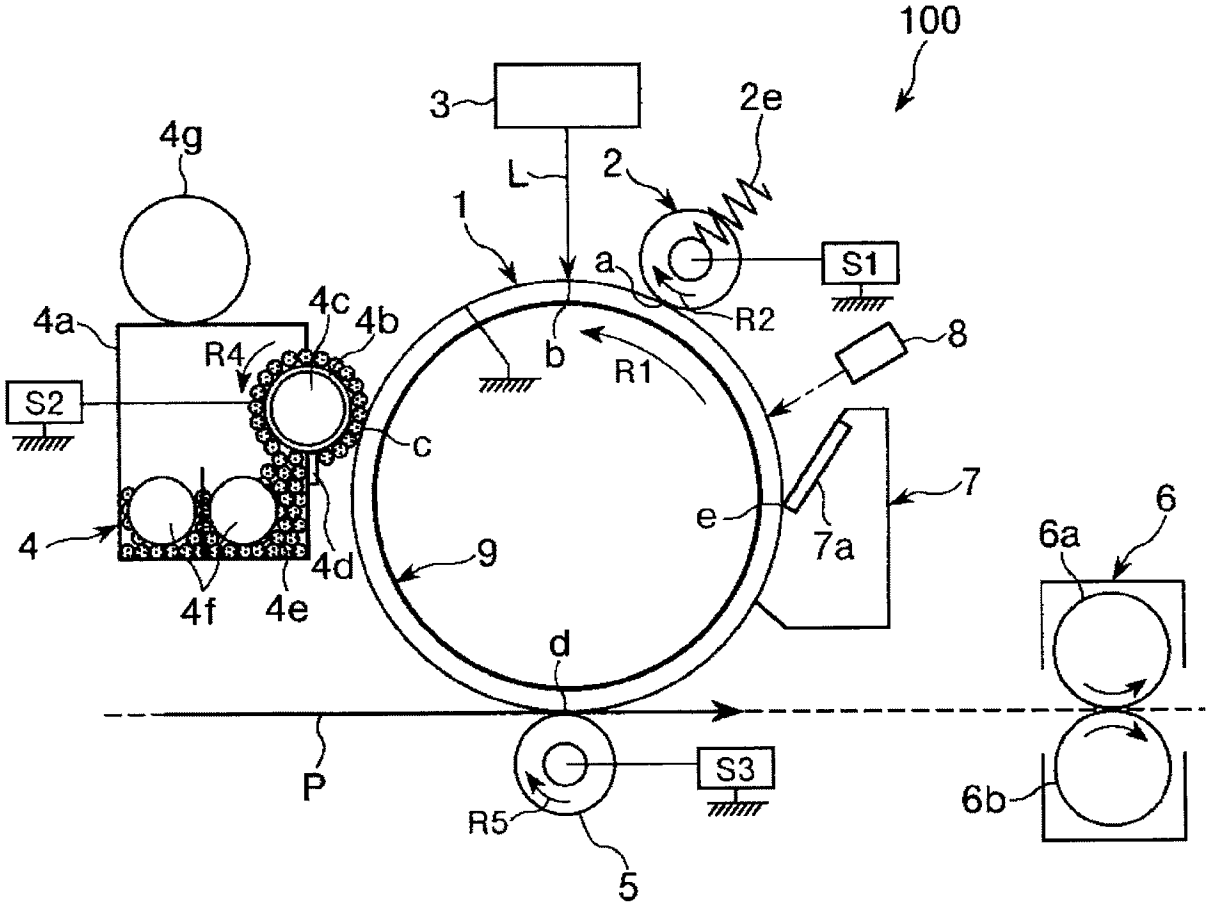
FIG. 1 is a schematic sectional view of the image forming apparatus in the first preferred embodiment of the present invention, and shows the general structure of the apparatus.

FIG. 1 shows the general structure of the image forming apparatus in the first preferred embodiment of the present invention. The image forming apparatus 100 in this embodiment is a laser beam printer, which uses one of the electrophotographic image formation processes of the transfer type. It uses one of the charging systems of the contact type, and one of the reversal developing methods. Its maximum recording medium size is A3.

The image forming apparatus 100 has a photosensitive member (electrophotographic photosensitive member) as its image bearing first member, which is in the form of a rotatable drum. The photosensitive drum 1 is rotationally driven in the direction (counterclockwise direction) indicated by an arrow mark R1 in the drawing. The image forming apparatus 100 is also provided with the following means, which are disposed in the adjacencies of the peripheral surface of the photosensitive drum 1 in the listed order in terms of the rotational direction of the photosensitive drum 1. The first is a charge roller 2 (charging device in the form of a roller) as the charging means. It is a charging member of the contact type. The next is a developing apparatus 4 as a developing means. The third is a transfer roller 5 as a transferring means. It is a transferring means of the contact type. Next is a cleaning apparatus 7 as a cleaning means. There is an exposing apparatus 3 as an exposing means (electrostatic latent image forming means), which is above the area between the charge roller 2 and developing apparatus 4 in the drawing. In terms of the direction in which a sheet of transfer medium P is conveyed, there is a fixing apparatus 6 as a fixing means, on the downstream side of an image transfer station d, which is between the photosensitive drum 1 and transfer roller 5.

The photosensitive drum 1 in this embodiment is 30 mm in external diameter, and is a negatively chargeable organic photosensitive member (OPC). It is rotationally driven by a motor as a driving means, at a process speed (peripheral velocity) of 210 mm/sec in the direction (counterclockwise direction) indicated by the arrow mark R1 in the drawing. Next, referring to FIG. 2, it is made up of an aluminum cylinder 1*a* (electrically conductive substrate), and three layers, that is, an undercoat layer 1*b*, a photoelectric charge generation layer 1*c*, and an electrical charge transfer layer 1*d*, which are coated in layers on the peripheral surface of the aluminum cylinder in the listed order. The undercoat layer 1*b* is for preventing optical interference and improving the adhesion between the aluminum cylinder 1*a*, and the layer on the aluminum cylinder 1*a*.

The charge roller 2 is rotatably supported by at the lengthwise ends of its metallic core 2*a* by a pair of bearings, and is kept pressed by a pair of compression springs 2*e*, as pressure applying means, toward the axial line of the photosensitive drum 1, being thereby kept pressed upon the peripheral surface of the photosensitive drum 1 by a preset amount of pressure. As the photosensitive drum 1 is rotationally driven, the charge roller 2 is rotated by the rotation of the photosensitive drum 1 in the direction (clockwise direction) indicated by an arrow mark R2 in FIG. 2. The area of contact between the photosensitive drum 1 and charge roller 2 is the photosensitive drum charging station a (charging nip).

To the metallic core 2*a* of the charge roller 2, a charge voltage (charge bias) which meets preset requirements is applied from a charge voltage power source S1 as a charge voltage applying means. As the charge voltage is applied to the charge roller 2, the peripheral surface of the photosensitive drum 1 is charged to predetermined polarity and potential level through the contact between the photosensitive drum 1 and charge roller 2. In this embodiment, a combination of a DC voltage and an AC voltage is applied, as the charge bias, to the charge roller 2 during an image forming operation. More concretely, the peripheral surface of the photosensitive drum 1 is uniformly charged to −500 V (dark area potential level Vd) through the area of contact between the photosensitive drum 1 and charge roller 2. To the charge roller 2, an oscillatory voltage, which is a combination of −500 V of DC voltage, and an AC voltage which is 2 kHz in frequency, is applied.

Figure 2:
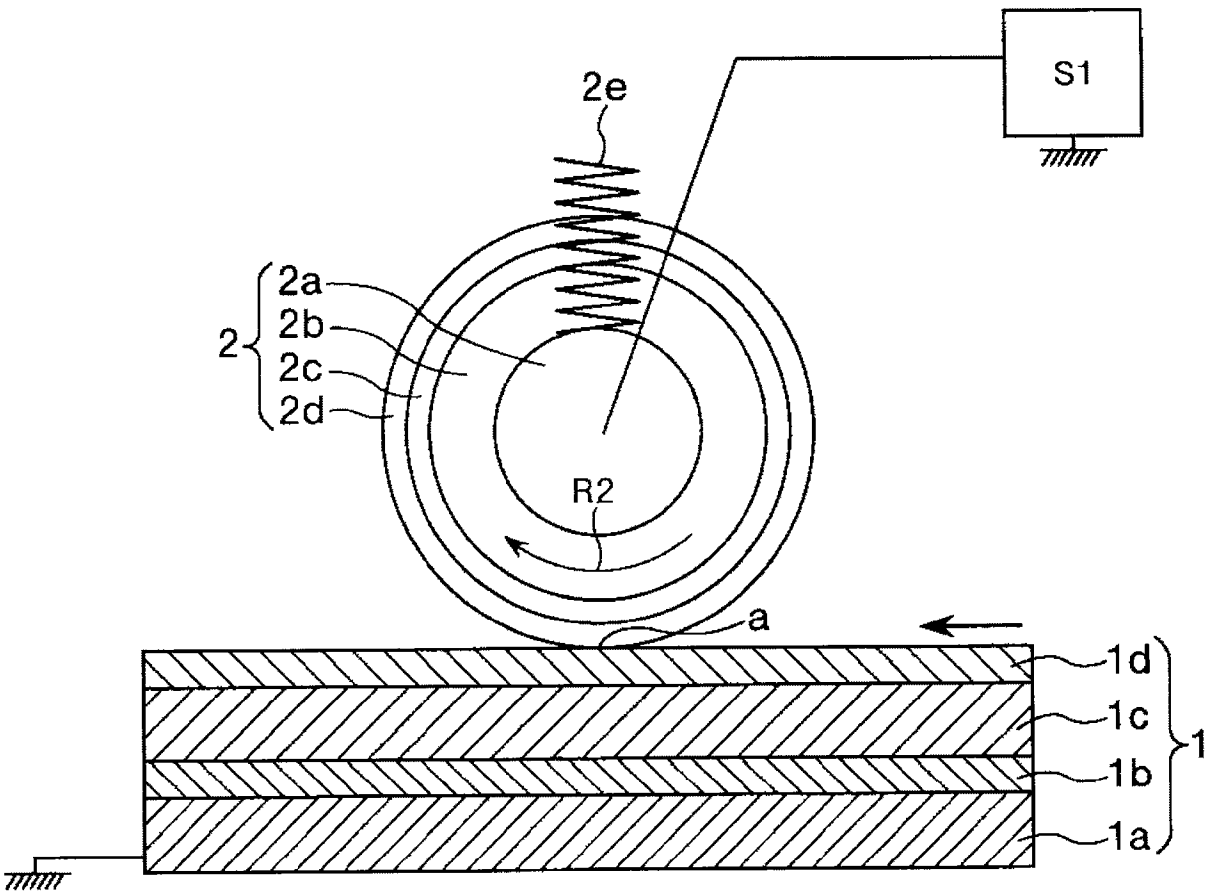
FIG. 2 is a schematic sectional view of the photosensitive drum and charge roller of the image forming apparatus in the first preferred embodiment of the present invention, and shows the laminar structure of the photosensitive drum and the laminar structure of the charge roller.

Referring to FIG. 2, in this embodiment, the charge roller 2 is 320 mm in length. It is made up of a metallic core 2*a* (supporting member), and three layers, that is, an undercoat layer 2*b*, an intermediary layer 2*c*, and a surface layer 2*d*, which are coated in layers in the listed order on the peripheral surface of the metallic core 2*a*. The under coat layer 2*b* is for reducing the charge noises, and is formed of foamed sponge. The surface layer 2*d* is a protective layer provided to prevent the occurrence of electrical leak even if the photosensitive drum 1 has defects such a pinhole. More concretely, the specifications of the charge roller 2 in this embodiment are as follows. The metallic core 2*a* is a piece of round stainless steel rod which is 6 mm in diameter. The bottom layer 2*b* is made of foamed EPDM, in which carbon particles were dispersed. It is 0.5 g/cm$^3$ in specific gravity, $10^2$-$10^9$ Ω·cm in volume resistivity, and 3.0 mm in thickness. The intermediary layer 2*c* is made of an NBR, in which carbon particles were dispersed. It is $10^2$-$10^5$ Ω·cm in volume resistivity, and 700 μm in thickness. The surface layer 2*d* is formed of Toresin, which is a fluorinated compound, in which tin oxide and carbon particles were dispersed. It is $10^7$-$10^{10}$ Ω·cm in volume resistivity, 1.5 μm in surface roughness (10 points average surface roughness Ra: JIS). It is 10 μm in thickness.

The exposing apparatus 3 in this embodiment is a laser beam scanner which uses a semiconductor laser. It scans the uniformly charged area of the peripheral surface of the photosensitive drum 1, at the exposing position b, by outputting a beam of laser light L while modulating the beam with the image formation signals inputted from a host apparatus, such as an image reading apparatus (unshown). As the charged area of the peripheral surface of the photosensitive drum 1 is scanned by the beam of laser light L, the exposed points of the peripheral surface of the photosensitive drum 1 reduce in potential level. As a result, an electrostatic latent image (electrostatic image), which reflects the image formation data, with which the beam of laser light L was modulated, is effected on the peripheral surface of the photosensitive drum 1 in a manner of unrolling the image.

The developing apparatus 4 in this embodiment is a developing apparatus which reversely develops an electrostatic latent image on the peripheral surface of the photosensitive drum 1, with the use of two-component magnetic brush. That is, it develops an electrostatic latent image on the peripheral surface of the photosensitive drum 1, by adhering toner to the exposed points (light points) of the peripheral surface of the photosensitive drum 1. In other words, it adheres charged toner, which is the same in polarity as the peripheral surface of the photosensitive drum 1, to the points of the peripheral surface of the photosensitive drum 1, which have reduced in potential level because of the exposure to the beam of laser light L. The developing apparatus 4 is provided with a development sleeve 4*b*, which is disposed, as a development bearing member, in the opening of the developing means container 4*a*. The development sleeve 4*b* is nonmagnetic, and is rotatable. The developing apparatus 4 is also provided with a stationary magnetic roller 4*c*, which is in the hollow of the development sleeve 4*b*. The developing means container 4*a* contains developer 4*e*, which is thinly coated on the peripheral surface of the development sleeve 4*b* by a developer regulating blade 4*d*. As the development sleeve 4*b* is rotated, the developer 4*e* on the development sleeve 4*b* is conveyed by the development sleeve 4*b* to the development area c, which is the area of contact between the photosensitive drum 1 and development sleeve 4*b*. The developer 4*e* in the developing means container 4*a* is a mixture of nonmagnetic toner and magnetic carrier. It is conveyed to the development sleeve 4*b* while being uniformly stirred by two developer stirring members 4*f*, which are in the developing means container 4*a* and being rotated.

The magnetic carrier in this embodiment is roughly $10^{13}$ Ω·cm in volume resistivity, and 40 μm in particle diameter. The toner is negatively charged by the friction between the toner and magnetic carrier. The toner density in the developing means container 4*a* is detected by a toner density sensor (unshown) so that the developer (mixture between toner and magnetic carrier) in the developing means container 4*a* can be kept constant in toner density, by supplying the developing means container 4*a* with a proper amount of toner from a toner hopper 4*g*, based on the information detected by the toner density sensor.

The development sleeve 4*b* is disposed so that the peripheral surface of the development sleeve 4*b* directly faces the peripheral surface of the photosensitive drum 1, and also, so that the closest distance between the development sleeve 4*b* and photosensitive drum 1 in the development area c becomes 300 μm. Further, the development sleeve 4*b* is rotationally driven (in direction indicated by arrow mark R4 in drawing) so that the direction of the movement of its peripheral surface in the development area c is opposite to the direction of the movement of the peripheral surface of the photosensitive drum 1 in the development area c.

To the development sleeve 4*b*, a predetermined development voltage (development bias) is applied from a development voltage power source S2 as a development voltage applying means. The development voltage applied in this embodiment is an oscillatory voltage, which is a combination of a DC voltage (Vdc) and an AC voltage (Vac). More concretely, it is an oscillatory voltage, which is a combination of −320 V of DC voltage, and an AC voltage which is 8 kHz in frequency, and 1,800 Vpp in peak-to-peak voltage.

The transfer roller 5 is kept pressed upon the photosensitive drum 1 with the application of a predetermined amount of pressure, creating the transfer station d. To the transfer roller 5, a transfer voltage (transfer bias) is applied from a transfer voltage power source S3 as a transfer voltage applying means. More concretely, to the transfer roller 5, a transfer voltage (+500 V in this embodiment) which is positive in polarity, being therefore opposite in polarity to the polarity (negative) to which toner is normally charged. As the transfer voltage is applied to the transfer roller 5, the toner image on the peripheral surface of the photosensitive drum 1 is transferred onto the transfer medium P, such as a sheet of paper, as the image bearing second member (to which image is transferred for second time). The transfer roller 5 rotates in the direction indicated by an arrow mark R5 in the drawing.

The fixing apparatus 6 has a fixation roller 6*a* and a pressure roller 6*b*, which are rotatable, and form a fixation nip between them. The fixing apparatus 6 thermally fixes the toner image to the transfer medium P by applying heat and pressure to the recording medium P and the toner image thereon while conveying the transfer medium P by pinching the transfer medium P with the fixation roller 6*a* and pressure roller 6*b*.

The cleaning apparatus 7 has a cleaning blade 7*a* as a cleaning member (scrubbing member). After the transfer of the toner image from the photosensitive drum 1 to the transfer medium P, the peripheral surface of the photosensitive drum 1 is scrubbed by the cleaning blade 7*a* to clean the peripheral surface of the photosensitive drum 1 by removing the toner (transfer residual toner) remaining adhered to the peripheral surface of the photosensitive drum 1, so that the peripheral surface of the photosensitive drum 1 can be repeatedly used for image formation. Designated by a referential code e in the drawing is the area of contact between the cleaning blade 7*a* and peripheral surface of the photosensitive drum 1.

The image forming apparatus 100 in this embodiment has a pre-exposing apparatus 8 as a pre-exposing means. In terms of the rotational direction of the photosensitive drum 1 (direction in which peripheral surface of photosensitive drum 1 moves), the pre-exposing apparatus 8 is on the downstream side of the cleaning apparatus 7, and on the upstream side of the charge roller 2. The pre-exposing apparatus 8 projects light upon the peripheral surface of the photosensitive drum 1 to remove the electrical charge remaining on the peripheral surface of the photosensitive drum 1 after the transfer of the toner image from the peripheral surface of the photosensitive drum 1 so that the portion of the peripheral surface of the photosensitive drum 1, which is about to be charged, becomes virtually zero in potential.

Further, the image forming apparatus 100 in this embodiment has a drum heater 9 as a heating means. The drum heater 9 is disposed in the hollow of the photosensitive drum 1 to heat the photosensitive drum 1. It is the means for heating the photosensitive drum 1 to evaporate away the moisture absorbed by the byproducts of the electrical discharge which occurred during the charging process, and the moisture absorbed by the photosensitive drum 1 itself. In other words, the drum heater 9 is for preventing the image forming apparatus 100 from forming a noticeably blurry and/or dim image when the image forming apparatus 100 is operated in an environment in which humidity is high, by preventing the peripheral surface of the photosensitive drum 1 from reducing in electrical resistance.

2. Operational Sequence

Figure 3:
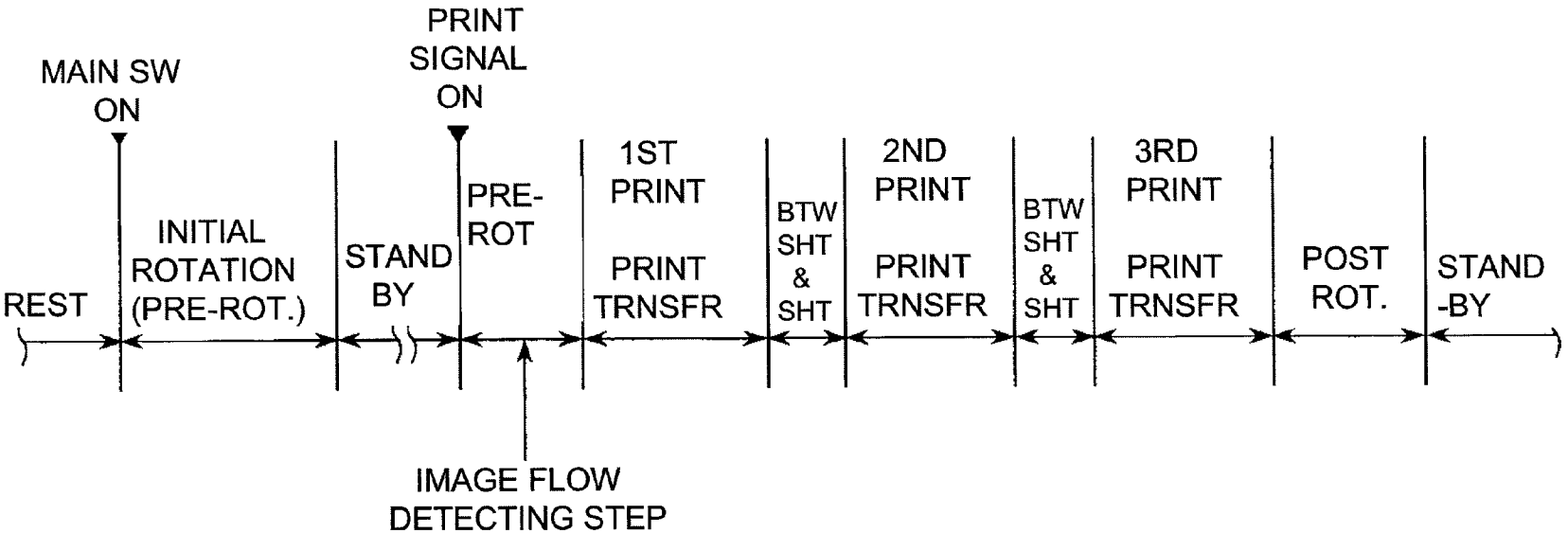
FIG. 3 is a diagram of the operational sequence of the image forming apparatus in the first preferred embodiment of the present invention.

FIG. 3 is a drawing of the operational sequence of the image forming apparatus 100.

a. Initial Rotational Operation (Pre-Rotation Process)

This is the process (initial period, warm-up period) carried out right after the image forming apparatus 100 is started. In this process, as the switch of the electric power source of the image forming apparatus 100 is turned on, various preparatory operations for the processing devices of the image forming apparatus 100 are carried out. For example, the photosensitive drum 1 is rotationally driven, and the temperature of the fixing apparatus 6 is increased to the preset level.

b. Preparatory Rotation for Printing (Pre-Rotation Process)

The period between when the printer is turned on and when the printer begins to actually form an image is the preparatory rotational period in which a preparatory operation for image formation is carried out to prepare the image forming apparatus 100 for the actual image forming operation. If a print signal happens to be inputted during the initial rotational period, the image forming operation to be started by the print signal is carried out as soon as the preparatory rotational operation is completed. When no print signal is inputted during the initial rotation, the main motor is stopped, and then, the rotational driving of the photosensitive drum 1 is stopped, after the completion of the initial rotation. Then, the image forming apparatus 100 is kept on standby until a print signal is inputted. As a print signal is inputted, the rotational operation is carried out again to prepare the image forming apparatus 100 for printing. In this embodiment, it is in this preparatory rotation period that whether or not the image forming apparatus 100 is in the condition, in which it forms a noticeably blurry and/or dim image, is determined; the program for determining whether or not the image forming apparatus 100 is to be operated in the "charge drain suppression" mode is run. These programs will be described later in detail.

c. Printing Process (Image Formation Process)

As soon as the operation for preparing the image forming apparatus for actual printing is completed, the process for forming an image on the rotating photosensitive drum 1 is carried out. The image formed on the peripheral surface of the photosensitive drum 1 is transferred onto the transfer medium P, and the transferred image on the transfer medium P is fixed by the fixing apparatus 6. Then, the finished print is outputted from the image forming apparatus 100. When the image forming apparatus 100 is in the continuous printing mode, the above-described printing process is repeated until a required number (n) of prints are yielded.

d. Recording Medium Interval

A recording medium interval is the period between when the trailing end (edge) of a transfer medium P passes the transfer station d when the image forming apparatus 100 is in the continuous printing mode, and when the leading end (edge) of the following recording medium P reaches the transfer station d. That is, it is the period in which no recording medium P is passing through the transfer station d.

e. Post-Rotation

Even after the process for printing on the last recording medium P is completed, the main motor is continuously driven for a while to rotationally drive the photosensitive drum 1. This rotational period is for carrying out predetermined post-operations.

f. Standby Period

As soon as the post-operations are completed, the driving of the main motor is stopped, and therefore, the rotational driving of the photosensitive drum 1 stops. Then, the image forming apparatus 100 is kept on standby until the next print start signal is inputted. If the image forming apparatus 100 is set to yield only one print, it is put through the post-operations as soon as the one print is outputted. Then, it is put on standby. If a print start signal is inputted while the image forming apparatus 100 is on standby, the image forming apparatus 100 begins to carry out the pre-rotation.

When the image forming apparatus 100 is in the above described printing process (c.) is when an image is formed, whereas when the image forming apparatus 100 is in the above described initial rotation process (a.), pre-rotation process (b.), recording medium interval (d.), and post-rotation (e.), are when no image is formed.

3. Charge Voltage Application System

Figure 4:
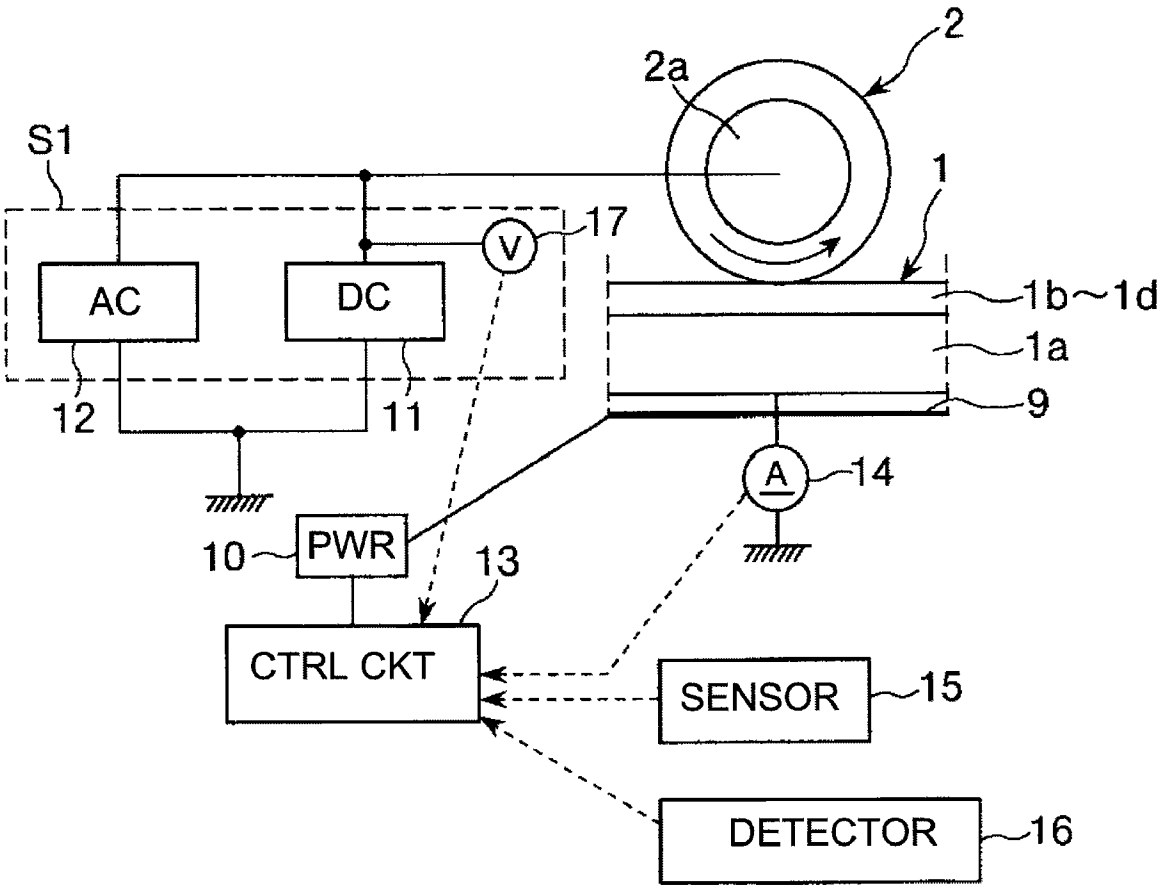
FIG. 4 is a block diagram of the charge voltage application system of the image forming apparatus in the first preferred embodiment of the present invention.

FIG. 4 is a block diagram of the electrical circuit of the charge voltage application system for the charge roller 2.

To the charge roller 2, a predetermined oscillatory voltage (Vdc+Vac), which is a combination of a DC voltage, and an AC voltage, the frequency of which is f, is applied from the charge voltage power source S1. As the voltage is applied, the peripheral surface of the rotating photosensitive drum 1 is charged to a preset potential level.

The charge voltage power source S1, which is the means for applying an electric voltage to the charge roller 2, and has a DC voltage power source 11 and an AC voltage power source 12. A control circuit 13 is enabled to apply a DC voltage, an AC voltage, or a combination of the DC and AC voltages, by controlling the DC voltage power source 11 and AC voltage power source of the charge voltage source S1.

Further, the image forming apparatus 100 in this embodiment has a direct current value measurement circuit 14 (current detection device, which hereafter will be referred to simply as "measurement circuit"), which is a current amount detecting means. The measured direct current value (information) is inputted from the measurement circuit 14 to the control circuit 13 as a controlling means. In order for the peripheral surface of the photosensitive drum 1 to be uniformly charged, the peak-to-peak voltage of the AC voltage is desired to be no less than twice the discharge start voltage. During an image forming operation, such a voltage that causes electrical discharge to occur from the charge roller 2 to the photosensitive drum 1 is applied to the charge roller 2.

The control circuit 13, as a controlling means, has the function of determining whether or not the photosensitive drum 1 is in the condition in which a significant amount of charge is possibly draining from the photosensitive drum, based on the value (information) of the direct current inputted into the control circuit 13 from the measurement circuit 4. The control circuit 13 has also the function of carrying out the program for determining whether or not the image forming apparatus 100 is to put in the charge drain suppression mode.

Further, the image forming apparatus 100 has an electrical heater power source 10 for supplying the drum heater 9 in the hollow of the photosensitive drum 1, with electric power. In this embodiment, +100 V of DC voltage is applied to the drum heater 9 from the power source 10. Further, the electric heater power source 10 is controlled (turned on or off) by the control circuit 13.

4. Detection of "Charge Drain"

Next, the system for detecting "charge drain" will be described. By the way, in a case where which of two voltages and/or currents is greater is discussed in the following explanation of this subject of "charge drain", it is to be assumed that their relationship in terms of size is discussed in terms of absolute value.

One of the primary objects of the present invention is to provide an image forming apparatus which is capable of efficiently suppressing the occurrence of the phenomenon that the byproducts of electrical discharge remaining adhered to the peripheral surface of the photosensitive drum 1 of the image forming apparatus causes the image forming apparatus to form a noticeably blurry and/or dim image. More concretely, one of the primary objects of the present invention is to provide an image forming apparatus which automatically detects, without requiring an additional time and space, whether or not the photosensitive drum 1 is in the condition in which the photosensitive drum 1 causes the apparatus to form a noticeably blurry and/or dim image, so that the image forming apparatus will be operated in the charge drain suppression mode only when it needs to be operated in the charge drain suppression mode.

Figure 5:
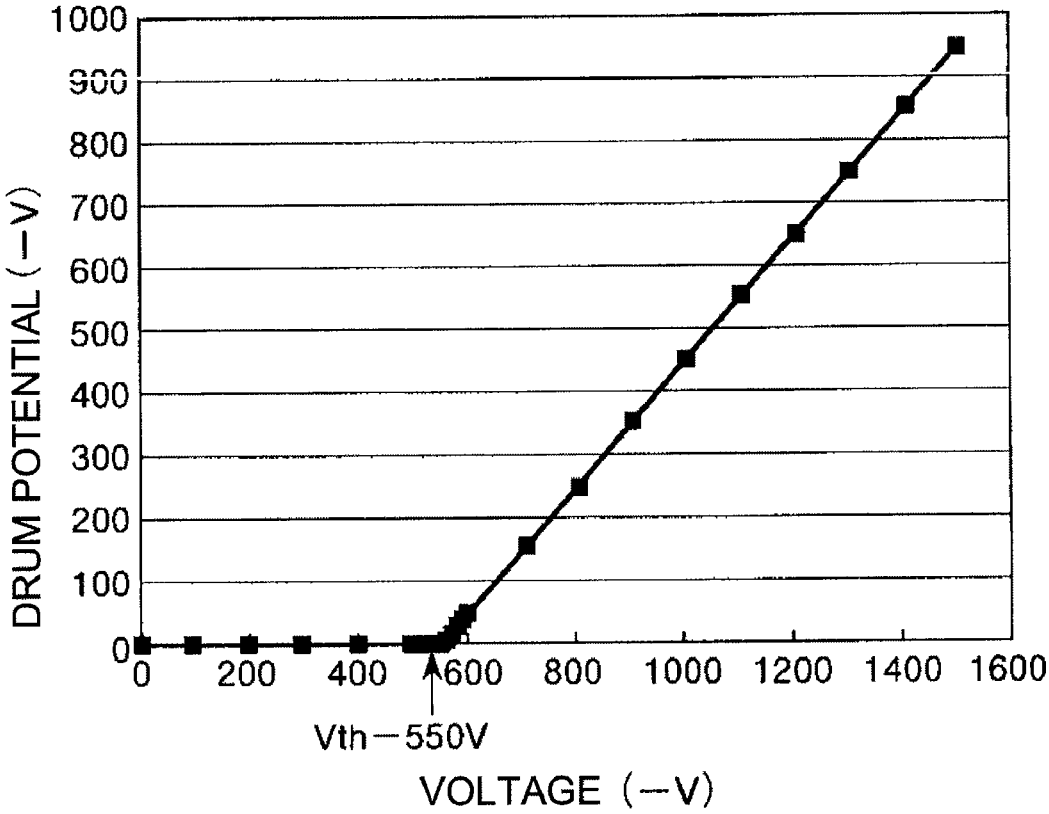
FIG. 5 is a graph which shows an example of the relationship between the direct voltage applied to charge the photosensitive drum, and the potential level of the peripheral surface of the photosensitive drum.

FIG. 5 is a graph which shows the results of the measurement of the potential level of the peripheral surface of the photosensitive drum under the condition in which the temperature was 23° C. and the relative humidity was 50%. The DC voltage applied to the charge roller 2 was gradually increased. Until the DC voltage reached a certain value, the surface potential of the photosensitive drum 1 did not increase at all. However, as soon as the DC voltage applied to the charge roller 2 increased beyond the certain value, the surface potential of the photosensitive drum 1 began to increase. This point at which the surface potential of the photosensitive drum 1 began to increase is the discharge start voltage Vth. The discharge start voltage Vth in this embodiment was −550 V.

The discharge start voltage Vth is determined by the size of the gap between the charge roller 2 and photosensitive drum 1, thickness of the photosensitive layer, and amount of dielectric constant. As a voltage which is greater than the discharge start voltage Vth is applied to the charge roller 2, electrical discharge occurs across the abovementioned gap, as described by Paschen's law. As a result, the photosensitive drum 1 becomes charged.

Figure 6:
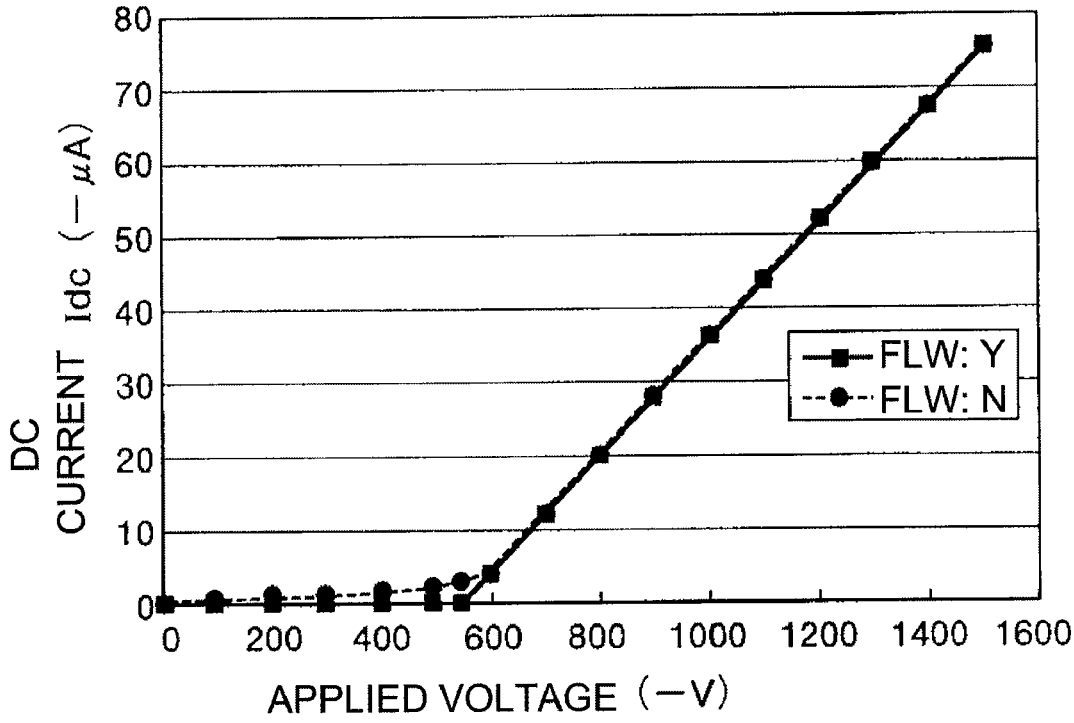
FIG. 6 is a graph which shows an example of the relationship between the DC voltage applied to the charging device and the amount of the direct current which flowed into the measurement circuit.

FIG. 6 is a graph of the results of the measurement of the amount of the DC voltage which flowed into the measurement circuit 14 when the DC voltage applied to the charge roller 2 was gradually increased under the same condition as that under which FIG. 5 was created. FIG. 6 shows both the results of the case in which the photosensitive drum 1 was not in the condition which causes the photosensitive drum 1 to suffer from a significant amount of charge drain, and the results of the case in which the photosensitive drum 1 was not in the condition which causes the photosensitive drum 1 to suffer from a significant amount of charge drain.

It is evident from FIG. 6 that when the photosensitive drum 1 was not in the condition which causes the formation of a noticeably blurry and/or dim image, and the voltage applied to the charge roller 2 was no higher than the discharge start voltage Vth, virtually no direct current was detected by the measurement circuit 14. It is also evident from FIG. 6 that when the photosensitive drum 1 was in the condition which causes the formation of a noticeably blurry and/or dim image, DC voltage was detected by the measurement circuit 14 even though the voltage applied to the charge roller 2 was no higher than the discharge start voltage Vth.

Figure 7:
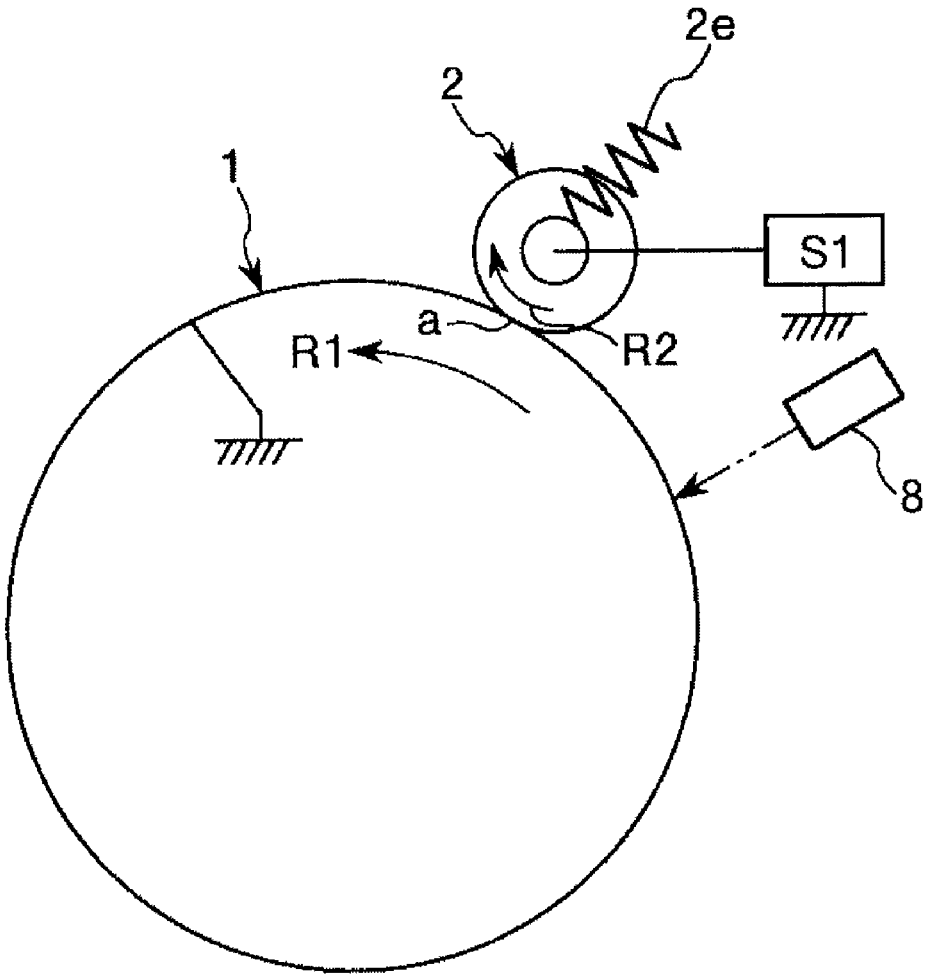
FIG. 7 is a sectional diagrammatic drawing of an example of the testing apparatus for measuring the amount of the direct current which flows as the charge on the peripheral surface of a photosensitive drum drains.

FIG. 7 shows the state of the image forming apparatus 100 in this embodiment, after the removal of the exposing apparatus 3, developing apparatus 4, transfer roller 5, fixing apparatus 6, and cleaning apparatus 7, from the image forming apparatus 100. That is, FIG. 7 shows the state of the image forming apparatus 100, in which only the charge roller 2 and pre-exposing apparatus 8 are left in the adjacencies of the peripheral surface of the photosensitive drum 1. While the image forming apparatus 100 was kept in the condition shown in FIG. 7, the photosensitive drum 1 was idly rotated, while being charged to a certain level, in an environment in which the relative humidity was 50%. Further, during this rotation of the photosensitive drum 1, such a combination of AC and DC voltage that caused 50 μA of electrical discharge to occur between the charge roller 2 and photosensitive drum 1 was applied to the charge roller 2. The AC voltage was 1,500 Vpp in peak-to-peak voltage, and the DC voltage was −500 V.

Figure 8:
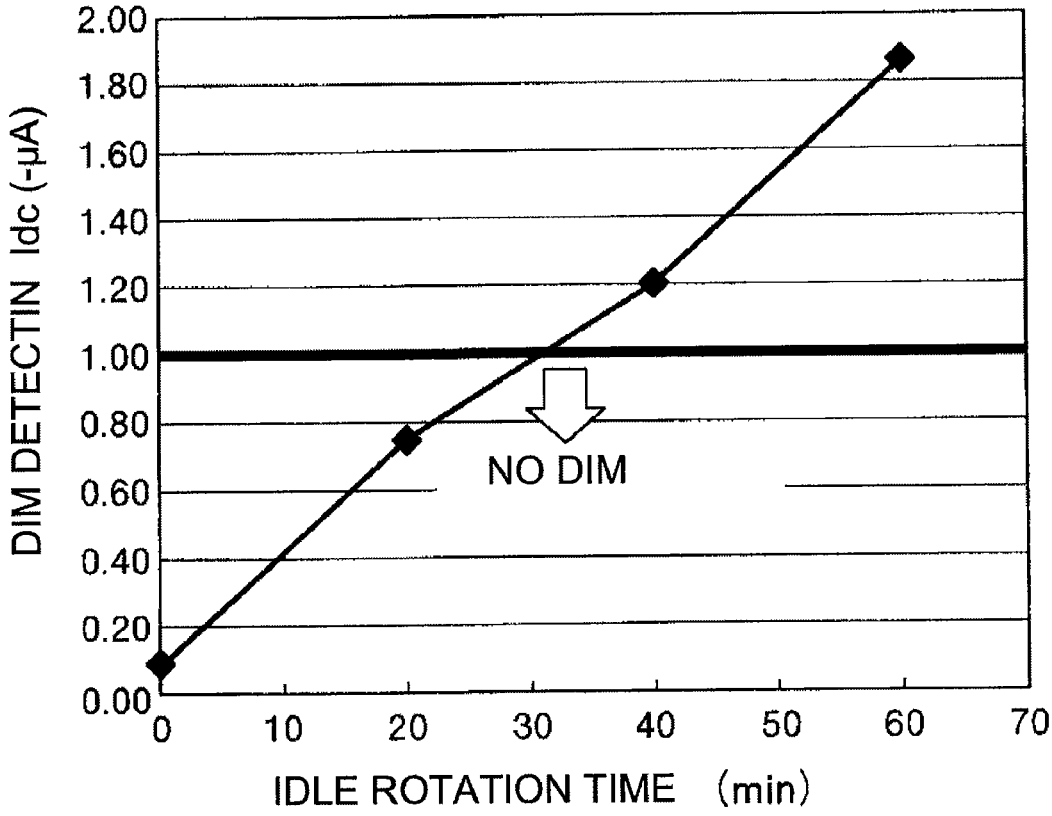
FIG. 8 is a graph which shows an example of the relationship between the length of time the photosensitive drum was idled, and the amount of direct current which flowed into the photosensitive drum.

FIG. 8 shows the results of the measurement of the relationship between the amount of the DC current which flowed into the measurement circuit 14 of the apparatus shown in FIG. 7 when the photosensitive drum 1 was charged by applying only −500 V of DC voltage to the charge roller 2 under the above described condition while the photosensitive drum 1 was idly rotated.

Referring to FIG. 5, in the case of the charging system in this embodiment, when the voltage applied to the charge roller 2 was only a DC voltage, the electrical discharge did not start, and therefore, the photosensitive drum 1 was not charged, until the DC voltage exceeded −550 V. However, as the operation for charging the photosensitive drum 1 was continued, the byproducts of electrical discharge accumulated on the peripheral surface of the photosensitive drum 1. If the byproducts remain on the photosensitive drum 1, they absorb the humidity in the air. As a result, the peripheral surface of the photosensitive drum 1 reduces in electrical resistance, which in turn causes the image forming apparatus 100 to form a noticeably blurry and/or dim image.

Figure 9:
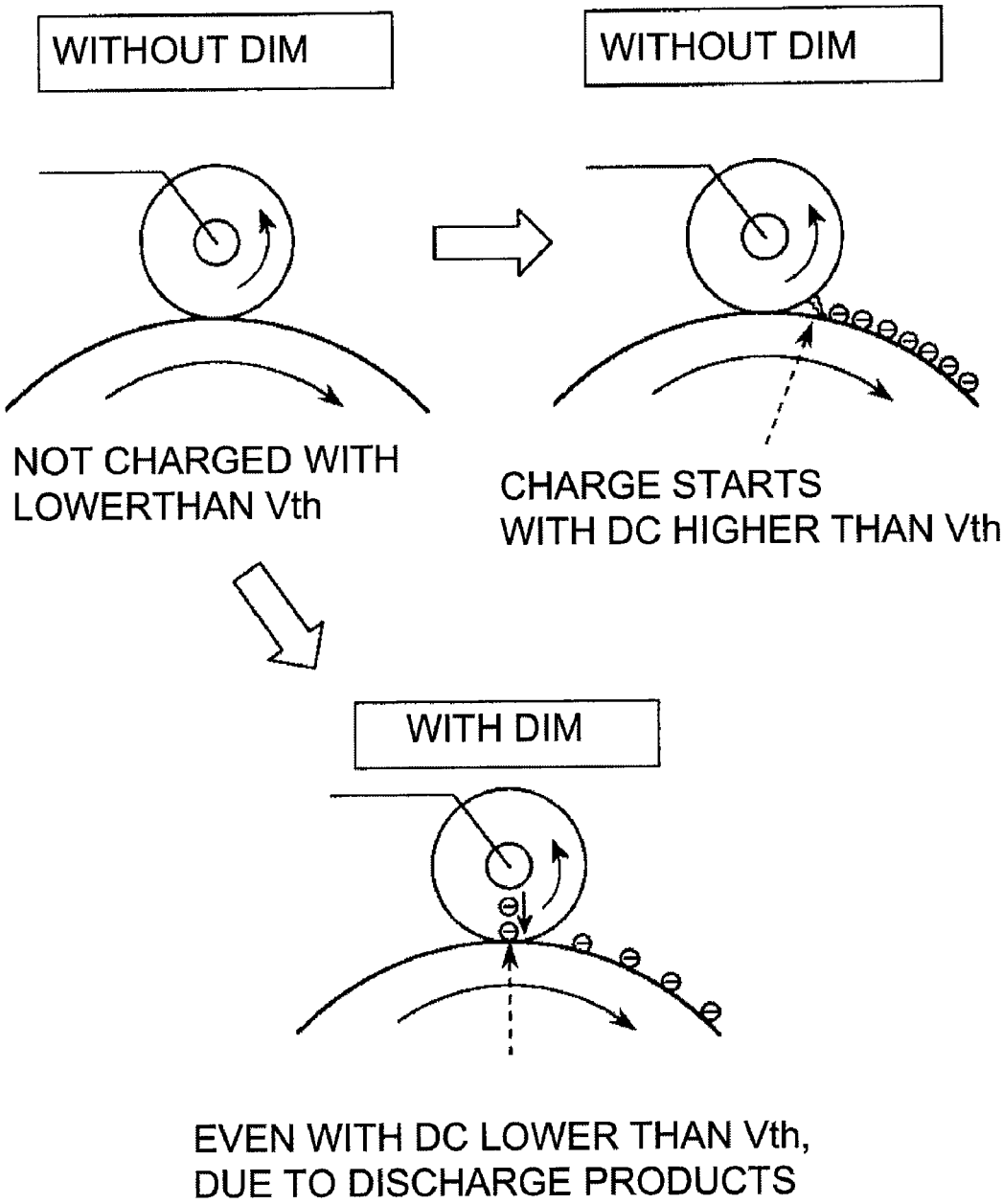
FIG. 9 is a drawing for describing the mechanism that causes the peripheral surface of the photosensitive drum to become charged when the amount of voltage applied to the charging device is no higher than the discharge start voltage.

If the photosensitive drum 1 is in the condition which causes the formation of a noticeably blurry and/or dim image, it begins to be charged by a very small amount even if the DC voltage (which is −500 V in this embodiment) applied to the photosensitive drum 1 is no more than the discharge start voltage Vth, which can be calculated based on Paschen's law. This phenomenon occurs because the reduction in the electrical resistance of the peripheral surface of the photosensitive drum 1 allows electrical charge to be "injected" into the photosensitive drum 1. FIG. 9 diagrammatically shows the mechanism of this "charge injection".

If the pre-exposing apparatus 8 is turned on, and −500 V of DC voltage is applied to the charge roller 2 when the photosensitive drum 1 is in the normal condition, that is, the condition in which electrical charge does not drain from the peripheral surface of the photosensitive drum by a significant amount, the portion of the peripheral surface of the photosensitive drum 1, which is on the immediately downstream side of the charge roller 2 in terms of the rotational direction of the photosensitive drum 1, does not become charged. Neither does the portion of the peripheral surface of the photosensitive drum 1, which is on the immediately upstream side of the charge roller 2 in terms of the rotational direction of the photosensitive drum 1, become charged. Thus, no electric current flows. That is, when the photosensitive drum 1 is in the normal condition, no electric current flows, and therefore, no direct current is detected by the measurement circuit 14.

However, when the photosensitive drum 1 is in the condition which causes the formation of a noticeably blurry and/or dim image, that is, the condition in which the reduction in the electrical resistance of the peripheral surface of the photosensitive drum 1 allows a very small amount of electrical charge to be injected into the photosensitive drum 1 even though the DC voltage applied to the charge roller 2 is no more than the discharge start voltage Vth, the portion of the peripheral surface of the photosensitive drum 1, which is on the immediately downstream side of the charge roller 2, becomes slightly charged. Further, the surface potential of the photosensitive drum 1 on the upstream side of the charge roller 2 was removed by the pre-exposing apparatus 8, and therefore, it becomes virtually 0 V. Therefore, the portion of the peripheral surface of the photosensitive drum 1, which is on the upstream side of the charge roller 2, and the portion of the peripheral surface of the photosensitive drum 1, which is on the downstream side of the charge roller 2, become different in potential level. Therefore, even when only −500 V of DC voltage, which is no more than the discharge start voltage Vth, is applied to the charge roller 2, direct current flows. That is, the reduction in the surface resistance of the photosensitive drum 1 can be more accurately detected by reducing the surface potential level of the photosensitive drum 1 to virtually 0 V through pre-exposure.

In this embodiment, the phenomenon such as the one described above was used as the means for determining whether or not the photosensitive drum 1 is in the condition which causes the formation of a noticeably blurry and/or dim image (charge drain detection).

The following became evident from the researches earnestly conducted by the inventors of the present invention. That is, referring to FIG. 8, in the case of the charging system in this embodiment, if the value of the direct current Idc becomes no less than −1 μA because of the reduction in the electrical resistance of the peripheral surface of the photosensitive drum 1 when the image forming apparatus 100 is in an environment in which relative humidity is 50%, the electrical charge, which is necessary for the formation of a latent image, is not sufficiently kept by the photosensitive drum 1; it drains. As a result, the formation of a noticeably blurry and/or dim image, that is, the phenomenon that an image, the isolated dots of which are missing, is formed, occurs.

In this embodiment, therefore, whether or not the photosensitive drum 1 is in the condition in which it causes the formation of a noticeably blurry and/or dim image, is determined by applying a DC voltage, which is no higher in potential level than the discharge start voltage Vth, to the charge roller 2, and measuring the amount of the direct current Idc flowed by the DC voltage, with the use of the measurement circuit 14.

Whether or not the formation of a noticeably blurry and/or dim image has begun to occur can be determined by measuring the ratio at which the halftone area of an image has reduced in density. More concretely, in this embodiment, whether or not the formation of a noticeably blurry and/or dim image began to occur was determined by measuring how much a halftone image patch, which is 0.5 in reflection density when there is no formation of a noticeably blurry and/or dim image, reduced. In this embodiment, as the reflection density fell from 0.5 to 0.4, that is, as the ratio of reflection density fell below 80%, it was judged that the formation of a noticeably blurry and/or dim image has begun to occur. Also in this embodiment, the reflection density of the image of the halftone patch was measured with the use of a spectroreflectometer X-Rite 505/508 (X-Rite Co., Ltd.).

As described above, the image forming apparatus 100 in this embodiment has a detecting means for obtaining the information about the effects of the application of the DC voltage (which is no higher than discharge start voltage) to the charge roller 2, upon the surface potential level of the photosensitive drum 1. The image forming apparatus 100 also has a controlling means 13 which determines whether or not the process for stopping the formation of a noticeably blurry and/or dim image (mode for stopping formation of noticeably blurry and/or dim image prevention mode) is to be carried out in response to the results of the detection by the detecting means 14. In particular, in this embodiment, the abovementioned detecting means has a current detecting device 14, which is a detecting device for detecting the current which flows from the charge roller 2 to the photosensitive drum 1 when a DC voltage, which is no higher than the discharge start voltage, is applied to the charge roller 2. The controlling means 13 determines whether or not the image forming apparatus 100 is to be operated in the charge drain suppression mode, based on the output of the current detecting means 14 as a detecting means. For example, if the amount of current detected by the current detecting device 14 is no less than a preset value, the controlling means 13 makes the image forming apparatus 100 operate in the charge drain suppression mode, whereas if it is no more than the preset value, the controlling means 13 does not make the image forming apparatus 100 operate in the charge drain suppression mode.

5. Control Flow

Figure 10:
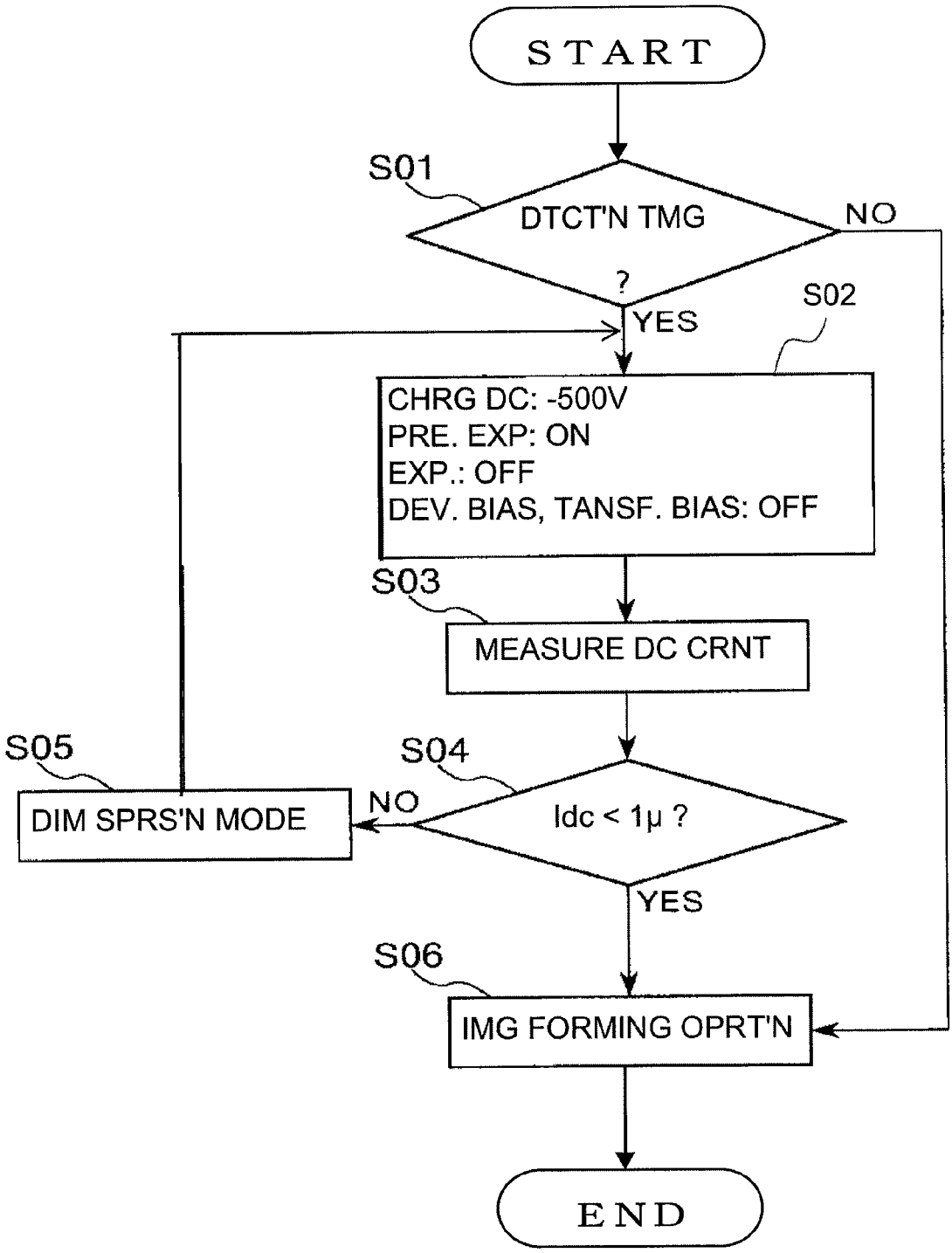
FIG. 10 is a flowchart of an example of the operational sequence for determining whether or not the image forming apparatus is to be operated in the charge drain suppression mode.

FIG. 10 is an example of the flowchart of the operational sequence for determining whether or not the charge drain has begun, and then, determining whether or not the image formation mode, in which the image forming apparatus 100 is operated, is to be switched to the charge drain suppression mode, based on the first determination.

The control circuit 13 carries out the process for finding out whether or not charge has begun to drain from the photosensitive drum 1 by a significant amount, during the pre-rotation period (FIG. 3), for example (S01). More concretely, the photosensitive drum 1 is rotated, and a DC voltage (which is −500 V in this embodiment), which is no higher than the discharge start voltage Vth, is applied to the charge roller 2 (S02). During this step (S02), the pre-exposing apparatus is kept turned on; the exposing apparatus 3 is kept turned off; and the development voltage and transfer voltage are kept turned off. With the image forming apparatus 100 being set as described above, if the photosensitive drum 1 is in the condition which may cause the formation of a noticeably blurry and/or dim image, the current which is injected from the charge roller 2 into the photosensitive drum 1, is measured, as the direct current Idc, by the measurement circuit 14, even if the DC voltage applied to the charge roller 2 is no higher than the discharge start voltage Vth (S03).

The control circuit 13 determines whether or not the value of the direct current Idc measured by the measurement circuit 14 is no greater than −1 μA (S04). If the direct current Idc is no less than −1 μA, the control circuit 13 determines that the image forming apparatus 100 is to be switched in operational mode to the charge drain suppression mode (S05). On the other hand, if the detected value of the direct current Idc is no more than −1 μA, the control circuit 13 allows the image forming apparatus 100 to carry out an image forming operation in response to the inputted image formation signals (S06). The various devices which are involved in this control flow are controlled by the control circuit 13. Incidentally, the image forming apparatus 100 may be programmed so that the charge drain detection sequence is carried out for every 100th print, for example.

In this embodiment, when the image forming apparatus 100 is in the charge drain suppression mode, the charge drain is suppressed by the drum heater 9 in the hollow of the photosensitive drum 1. If the control circuit 13 determines that the operational mode of the image forming apparatus 100 is to be switched to the charge drain suppression mode, it begins to supply the drum heater 9 with the electric power from the heater power source 10 to reduce the relative humidity of the adjacencies of the peripheral surface of the photosensitive drum 1 in order to reduce the amount by which charge drains from the peripheral surface of the photosensitive drum. In this embodiment, the control circuit 13 operates the image forming apparatus 100 in the charge drain suppression mode for one minute, and then, switches the operational mode back to the charge drain detection mode (S02-S04) to determine whether or not the photosensitive drum 1 is in the condition which causes the charge drain. If the value of the direct current Idc has fallen below −1 μA, the control circuit 13 switches the operational mode to the image formation mode (S06). On the other hand, if the value of the direct current Idc has remained no less than −1 μA, the control circuit 13 switches the operation mode back to the charge drain suppression mode (S05).

As described above, in this embodiment, the control circuit 13 determines whether or not the photosensitive drum 1 is to be heated by the heating means 9, based on the results of the detection by the detecting means 14. In particular, in this embodiment, whether or not the abovementioned heating process is carried out is determined based on the output of the current detecting device 14, which constitutes the detecting means.

As described above, in this embodiment, whether or not the photosensitive drum 1 is in the condition which causes the formation of a noticeably blurry and/or dim image is determined within the image forming apparatus 100 before an image forming operation is started. Therefore, it is only when necessary that the image forming apparatus 100 is operated in the charge drain suppression mode. Therefore, electric power and time are not consumed unnecessarily. That is, the formation of a noticeably blurry and/or dim image is efficiently prevented. Also in this embodiment, while the image forming apparatus 100 is operated in the charge drain suppression mode, the moisture in the byproducts of electrical discharge, and the moisture in the photosensitive drum 1 itself, are evaporated by heating the photosensitive drum 1 with the drum heater 9 to restore the photosensitive drum 1 in electrical resistance to prevent the formation of a noticeably blurry and/or dim image.

That is, the present invention makes it possible to determine, with the use of a simple means, whether or not the photosensitive drum is in the condition which causes the formation of a noticeably blurry and/or dim image, and also, makes it possible to operate an image forming apparatus in the charge drain suppression mode only when necessary. Thus, the present invention can provide an electrophotographic image forming apparatus which efficiently prevents the formation of a noticeably blurry and/or dim image, and therefore, can continuously form satisfactory images for a long time.

Embodiment 2

Next, another preferred embodiment of the present invention will be described. The components, portions, etc., of the image forming apparatus in this embodiment, the functions and structures of which are equivalent to, or the same as, the counterparts in the first preferred embodiment, are given the same referential codes as those given to describe the first preferred embodiment, and will not be described in detail. The first preferred embodiment of the present invention was described with reference to the case in which whether or not the charge drain had begun to occur was detected when the ambient relative humidity of the image forming apparatus was 50%.

Figure 11:
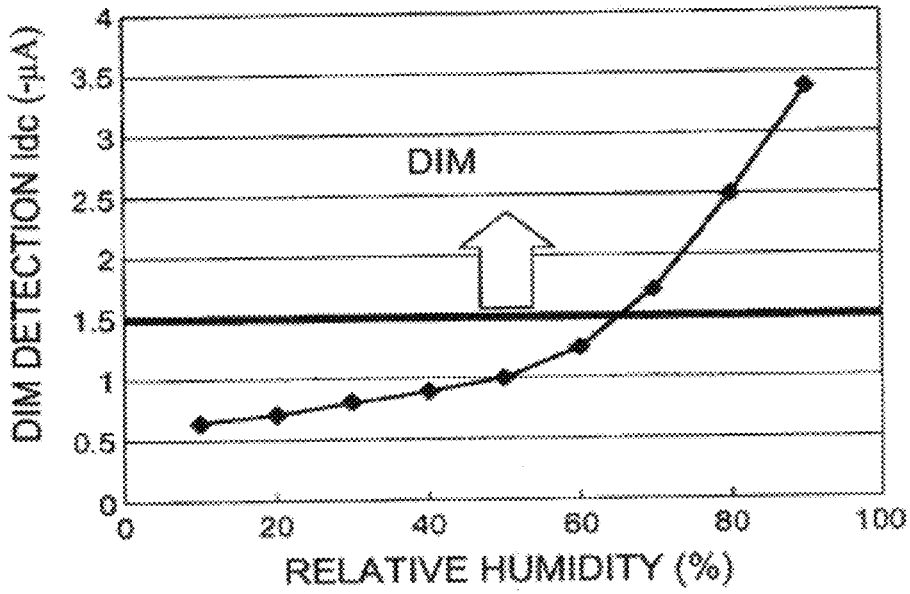
FIG. 11 is a graph which shows an example of relationship between the relative humidity, and the amount of direct current which flowed into the photosensitive drum.

FIG. 11 is a graph which shows the relationship between the relative humidity in the image forming apparatus 100, and the value of the direct current Idc, at and above which electrical charge began to drain from the photosensitive drum 1 by a significant amount. The changes in the environment in which the image forming apparatus 100 is operated cause the charge roller 2 and photosensitive drum 1 to change in electrical resistance. For example, if the relative humidity increases, the direct current Idc, which is detected by the measurement circuit 14 as it becomes possible for electrical charge from draining from the photosensitive drum 1 by a significant amount, increases. Therefore, in order to more precisely control the image forming apparatus 100, it is desired to make it possible for the value of the direct current Idc, which is the threshold value for determining whether or not the photosensitive drum 1 is in the condition which causes the formation of a noticeably blurry and/or dim image, to be varied in response to the environmental changes. In this embodiment, therefore, an environment sensor 15, as an environment sensing means, is placed within the image forming apparatus 100, as shown in FIG. 4. More specifically, the environment sensor 15 in this embodiment detects the internal relative humidity of the image forming apparatus 100, and transmits the detected relative humidity to the control circuit 13.

Figure 12:
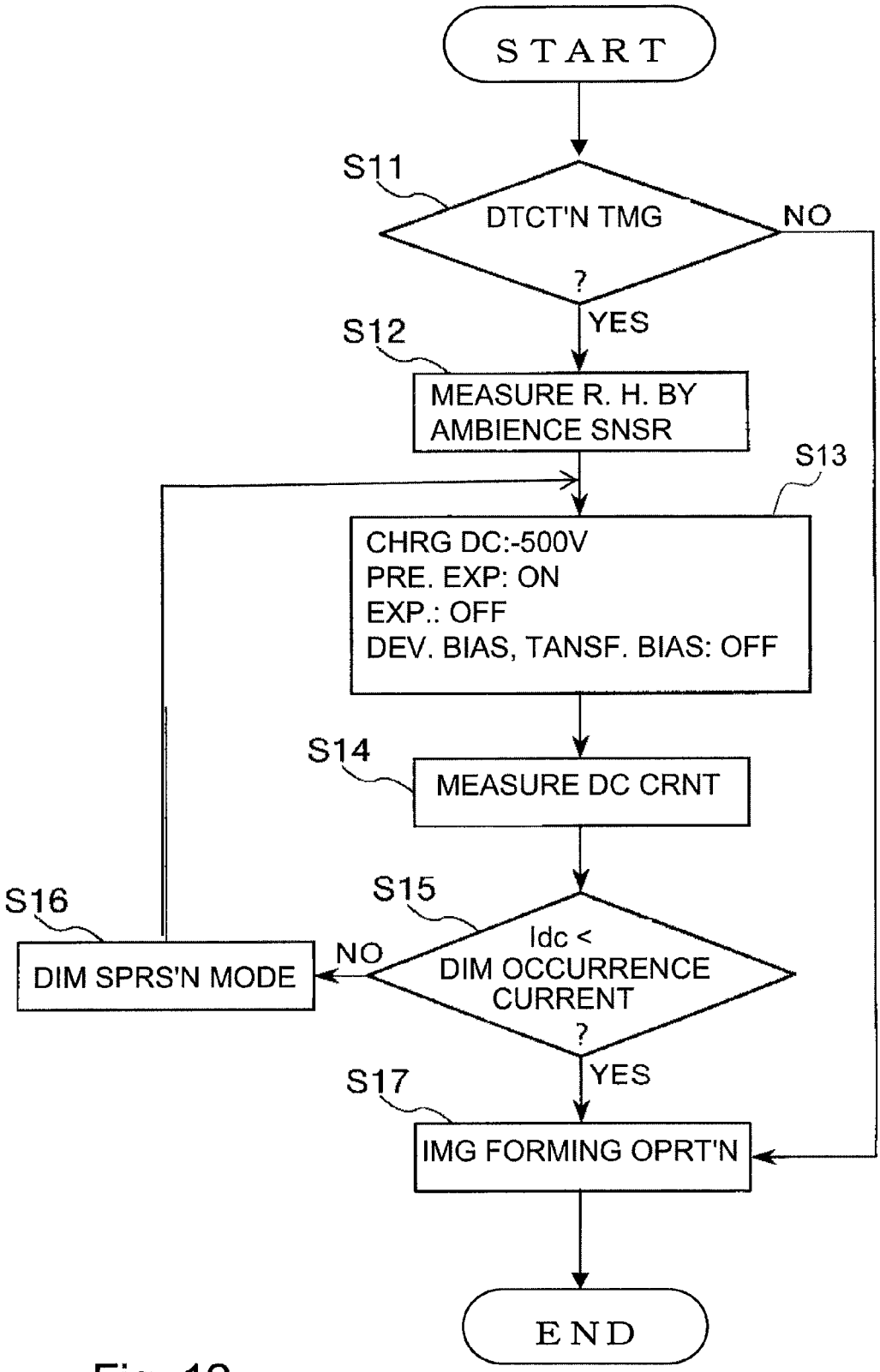
FIG. 12 is a flowchart of another example of the operational sequence for determining whether or not the image forming apparatus is to be operated in the charge drain suppression mode.

FIG. 12 is an example of flowchart of the operational sequence to be carried out, while no image is formed, for determining whether or not the operational mode of the image forming apparatus 100 is to be switched to the charge drain suppression mode, by checking whether or not a significant amount of charge has begun to drain from the peripheral surface of the photosensitive drum 1. The control circuit 13 makes the environment sensor 15 detect the internal relative humidity of the image forming apparatus 100, with the timing for charge drain detection (S11), and then, makes the sensor 15 transmit the obtained information to the control circuit 13 (S12). Then, the control circuit 13 makes the photosensitive drum 1 rotate, and applies a DC voltage (which is −500 V in this embodiment), which is no higher than the discharge start voltage Vth, to the charge roller 2 (S13) while rotating the photosensitive drum 1. During the application of this DC voltage, the pre-exposing apparatus 8 is kept turned off; the exposing apparatus 3 is kept turned off; and both the development voltage and transfer voltage are kept turned off (S13). With the image forming apparatus 100 being set as described in terms of voltage, if the photosensitive drum 1 is in the condition which causes the formation of a noticeably blurry and/or dim image, the current which flows from the charge roller 2 to the photosensitive drum 1 is detected, as the direction current Idc, by the measurement circuit 14, even if the direct current applied to the charge roller 2 is no higher than the discharge start voltage Vth (S14).

The control circuit 13 determines whether or not the value of the direct current Idc detected by the measurement circuit 14 is no higher than the current value (minimum current value which causes formation of a noticeably blurry and/or dim image) for determining whether or not the formation of a noticeably blurry and/or dim image occurs under the environmental condition detected by the environment sensor 15 (S15). Referring to FIG. 11, this threshold value, which varies in response to the environmental changes, is set in advance in the control circuit 13. The control circuit 13 selects the current value from among the set values, based on the information regarding the relative humidity detected by the environment sensor 15, and then, uses the selected current value for the above-described determination. If the control circuit 13 determines that the value of the direct current Idc has become no less than one of the charge drain causing values, in FIG. 11, which was detected by the environment sensor 15, it determines that the operational mode of the image forming apparatus 100 is to be switched to the charge drain suppression mode (S16). On the other hand, if the control circuit 13 determines that the value of the direct current Idc is no higher than one of the charge drain causing value, it allows the image forming apparatus 100 to start an image forming operation (S17). The various devices involved in the this control sequence are controlled by the control circuit 13.

In this embodiment, the charge drain suppression mode is carried out by the drum heater 9 in the hollow of the photosensitive drum 1. As the control circuit 13 determines that the operational mode is to be switched to the charge drain suppression mode, it begins to supply the drum heater 9 with the electric power from the heater power source 10 to reduce the relative humidity of the adjacencies of the peripheral surface of the photosensitive drum 1 in order to reduce the charge drain. In this embodiment, the control circuit 13 operates the image forming apparatus 100 in the charge drain suppression mode for one minutes, and then, switches the operational mode back to the charge drain detection mode (S13-S15) to determine whether or not the photosensitive drum 1 is in the condition which causes the formation of a noticeably blurry and/or dim image. If the value of the direct current Idc has fallen below the threshold value for the formation of a noticeably blurry and/or dim image, the control circuit 13 switches the operational mode to the image formation mode (S17). On the other hand, if the value of the direct current Idc has remained no less than the threshold value for the formation of the noticeably blurry and/or dim image, the control circuit 13 switches the operation mode back to the charge drain suppression mode (S16).

As described above, this embodiment can provide the effects similar to those provided by the first preferred embodiment. Moreover, in this embodiment, the internal condition of the image forming apparatus 100 is detected by the environment sensor 15 when determining whether or not the photosensitive drum 1 is in the condition which may cause the formation of a noticeably blurry and/or dim image. Therefore, not only can this embodiment make it possible to operate the image forming apparatus 100 in the charge drain suppression mode only when necessary, but also, more efficiently carry out the mode.

Embodiment 3

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

Figure 13:
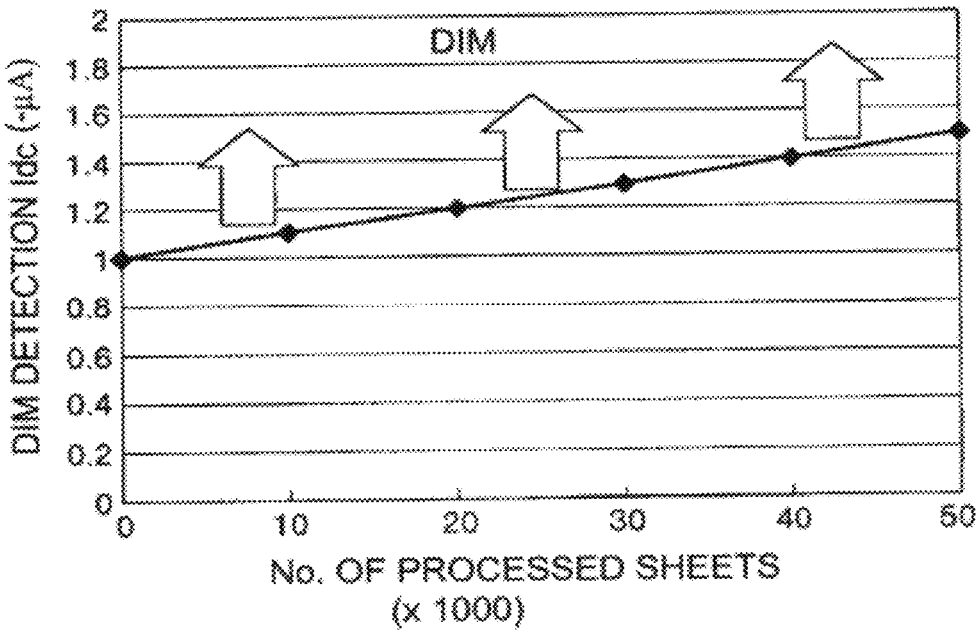
FIG. 13 is a graph which shows an example of relationship between the number of prints made, and the amount of direct current which flowed into the photosensitive drum.

FIG. 13 is a graph which shows the relationship between the cumulative print count, as the amount of the usage of the image forming apparatus 100, and the value of the direct current Idc, at and above which the photosensitive drum 1 causes the formation of a noticeably blurry and/or dim image.

As an image forming operation continues, the surface layer of the photosensitive drum 1 gradually thins. This thinning of the surface layer of the photosensitive drum 1 reduces the electrical resistance of the photosensitive drum 1 itself, which in turn increases in value the direct current Idc to be detected to determine whether or not the image forming apparatus 100 is to be operated in the charge drain suppression mode. Thus, in order to more precisely control the image forming apparatus 100, it is desired that the threshold value for the direct current Idc, which is for determining whether or not the photosensitive drum 1 is in the condition which causes the formation of a noticeably blurry and/or dim image, is variable.

Referring to FIG. 4, in this embodiment, therefore, the image forming apparatus 100 is provided with an internal means for detecting the amount of the usage of the image forming apparatus 100, that is, an internal means (counter) 16 for cumulatively count the number of the prints made by the apparatus. The cumulative print count detecting means 16 in this embodiment detects the cumulative number of prints, converts the detected cumulative number into the number equivalent to the number of A4 sheets, and transmits this information to the control circuit 13.

Figure 14:
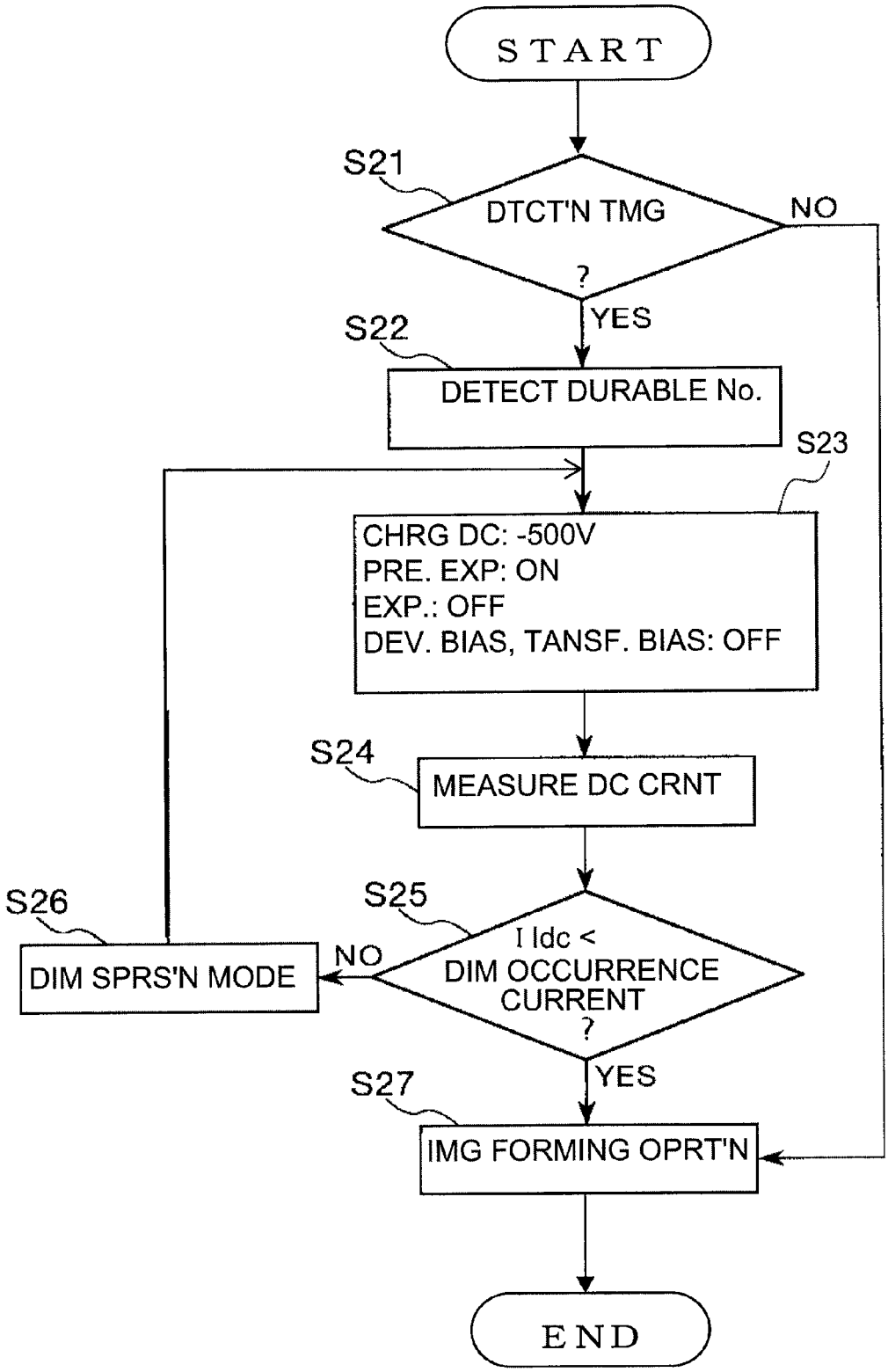
FIG. 14 is a flowchart of another example of the operational sequence for determining whether or not the image forming apparatus is to be operated in the charge drain suppression mode.

FIG. 14 is an example of the flowchart of the operational sequence which is to be carried out for determining whether or not the operational mode is to be switched to the charge drain suppression mode, by carrying out the charge drain detection operation.

As the time for the charge drain detection operation comes (S21), the control circuit 13 detects, first, the cumulative number of the prints, which has been counted by the cumulative print count detecting means 16 since when the photosensitive drum 1 in the image forming apparatus 100 was new (S22).

Then, the control circuit 13 rotates the photosensitive drum 1, and applies to the charge roller, a DC voltage (which is −500 V in this embodiment) which is no higher than the discharge start voltage Vth (S23), while rotating the photosensitive drum 1. During this process, the pre-exposing apparatus 8 is kept turned on; the exposing apparatus 3 is kept turned off; and the development voltage and transfer voltage are both kept turned off (S23). With the apparatuses 8 and 3, and voltages, being set as described above, if the photosensitive drum 1 is in the condition which causes the formation of a noticeably blurry and/or dim image, even if the DC voltage which is no higher than the discharge start voltage Vth is applied to the photosensitive drum 1, the electric current injected from the charge roller 2 into the photosensitive drum 1 is detected, as the direct current Idc, by the measurement circuit 14 (S24).

Here, the control circuit 13 determines whether or not the value of the direct current Idc, which was measured by the measurement circuit 14 is no greater than the current value (threshold value for formation of a noticeably blurry and/or dim image) for determining whether or not the current cumulative print count detected by the cumulative print count detecting means 16 is large enough to causes the formation of a noticeably blurry and/or dim image (S25). Referring to FIG. 13, these value, which are the threshold current values for predicting whether or not the photosensitive drum 1 is in the condition for the formation of a noticeably blurry and/or dim image, are set in advance in the control circuit 13. The control circuit 13 obtains the cumulative print count from the cumulative print count detecting means 16, and selects the current value to which the obtained cumulative print count is to be compared. Then, it uses the selected current value to make the above described determination. That is, if the detected value of the direct current Idc is greater than the current value, shown in FIG. 13, which corresponds to the value, above which the formation of a noticeably blurry and/or dim image will occur, the control circuit 13 determines that the operational mode is to be switched to the charge drain suppression mode (S26). On the other hand, if the value of the direct current Idc is no greater than the smallest current value which causes the formation of a noticeably blurry and/or dim image, the control circuit 13 makes the image forming apparatus 100 begin to form an image (S27). The various devices involved in this control are under the control of the control circuit 13.

In this embodiment, the charge drain suppression mode is carried out by the heater 9 in the photosensitive drum. As the control circuit 13 determines that the operational mode is to be switched to the charge drain suppression mode, it begins to supply the drum heater 9 with the electric power from the heater power source 10 to reduce the relative humidity of the adjacencies of the peripheral surface of the photosensitive drum 1 in order to reduce the charge drain. In this embodiment, the control circuit 13 operates the image forming apparatus 100 in the charge drain suppression mode for one minutes, and then, switches the operational mode back to the charge drain detection mode (S23-S25) to determine whether or not the photosensitive drum 1 is still in the condition which causes the formation of a noticeably blurry and/or dim image. If the value of the direct current Idc has fallen below the threshold value for the formation of a noticeably blurry and/or dim image, the control circuit 13 switches the operational mode to the image formation mode (S27). On the other hand, if the value of the direct current Idc has remained no less than the charge drain causing minimum value, the control circuit 13 switches the operation mode back to the charge drain suppression mode (S26).

As described above, this embodiment can provide the effects similar to those provided by the first preferred embodiment. Moreover, in this embodiment, the cumulative print count is detected by the cumulative print count detecting means 16 before it is determined whether or not a significant amount of draining of the photosensitive drum charge has begun to occur. Therefore, not only can this embodiment make it possible to operate the image forming apparatus 100 in the charge drain suppression mode only when necessary, but also, more efficiently operate the image forming apparatus 100 in the charge drain suppression mode 1.

Embodiment 4

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

In the first to third preferred embodiments, the formation of a noticeably blurry and/or dim image is prevented by the drum heater 9 in the photosensitive drum 1. That is, the drum heater 9 is turned on to minimize the charge drain from the peripheral surface of the photosensitive drum 1 by reducing in relative humidity the peripheral surface portion of the photosensitive drum 1.

In this embodiment, as the image forming apparatus 100 is placed in the charge drain suppression mode, only the photosensitive drum 1 is idled for a preset length of time to increase the length of time the cleaning blade 7*a* and the peripheral surface of the photosensitive drum 1 rub against each other in the area c of contact between the two. Prolonging the length of time the cleaning blade 7*a* and photosensitive drum 1 rub against each other makes it easier for the byproducts of the electrical discharge and the like to be removed, and the cleaner the peripheral surface of the photosensitive drum 1, the less likely is the formation of a noticeably blurry and/or dim image to occur.

As described above, in this embodiment, the image forming apparatus 100 has such a charge drain suppression mode that removes the byproducts of electric discharge, which are remaining adhered to the photosensitive drum 1. The control circuit 13 determines whether or not the image forming apparatus 100 is to be operated in the above described mode, based on the results of the detection by the detecting means for detecting the information regarding the surface potential level of the photosensitive drum 1 after the application of a DC voltage, which is no higher than the discharge start voltage, to the charge roller 2. In particular, in this embodiment, the control circuit 13 determines whether or not the image forming apparatus 100 is to be operated in the above described mode, based on the output of the current detecting device 14. Also in this embodiment, the image forming apparatus 100 has a cleaning blade 7*a*, which is a scrubbing member for scrubbing the photosensitive drum 1 as the photosensitive drum 1 rotates. When the image forming apparatus 100 is in the above described mode, the control circuit 13 makes the cleaning blade 7*a* to scrub the peripheral surface of the photosensitive drum 1.

The operational sequence for determining whether or not the operational mode of the image forming apparatus 100 is to be switched to the charge drain suppression mode can be can be carried out following the flowchart in FIG. 10. However, the operation sequence in this embodiment is different, in the charge drain suppression mode, from the operational sequence in FIG. 10.

That is, as the control circuit 13 places the image forming apparatus 100 in the charge drain suppression mode (S05), it idles the photosensitive drum 1 for 30 seconds, and then, puts the image forming apparatus 100 again in the charge drain detection mode (S02-04) to determine whether or not the photosensitive drum 1 is in the condition which causes the formation of a noticeably blurry and/or dim image. If the value of the direction current Idc has fallen below the minimum value (for example −1 μA) which causes a significant amount of charge drain, the control circuit 13 puts the image forming apparatus 100 into the image formation mode (S06). On the other hand, if the value of the direct current Idc is remaining larger than the minimum value which causes a significant amount of charge drain, the control circuit 13 puts the image forming apparatus 100 again in the charge drain suppression mode (S05).

The charge drain suppression mode in this embodiment may be used following the charge drain suppressing operational sequence in the second and third preferred embodiments.

As described above, this embodiment can offer the same effects as those offered by the first to third preferred embodiment, even though the charge drain suppressing operation in this embodiment is different from those carried out by the image forming apparatuses 100 in the first to third preferred embodiments. In this embodiment, in order to prevent the formation of a noticeably blurry and/or dim image, the byproducts of the electrical discharge, which is remaining adhered to the photosensitive drum 1, are removed. Thus, even if the byproducts of the electrical discharge is remaining adhered to the photosensitive drum 1, they are removed, and therefore, a satisfactory image, that is, an image which do not show any sign of the occurrence of the charge drain.

Embodiment 5

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

This preferred embodiment is different from the first to fourth preferred embodiments in the operational sequence carried out by the image forming apparatus 100 when the apparatus 100 is in the charge drain suppression mode.

In this embodiment, the image forming apparatus 100 is provided with a supply of polishing agent (polishing particles). Thus, as the image forming apparatus 100 is put in the charge drain suppression mode, the polishing agent is sent to the area e of contact between the cleaning blade 7*a* and the peripheral surface of the photosensitive drum 1 to increase the friction between the cleaning blade 7*a* and photosensitive drum 1. The increase in friction between the cleaning blade 7*a* and the photosensitive drum 1 makes it easier for the byproducts of the electrical discharge, which is remaining adhered to the photosensitive drum 1, to be removed, and therefore, it becomes more difficult for the formation of a noticeably blurry and/or dim image to occur.

As described above, when the image forming apparatus 100 in this embodiment is in the charge drain suppression mode, the byproducts of the electrical discharge, which are remaining adhered to the photosensitive drum, are removed. More concretely, the image forming apparatus 100 in this embodiment is provided with a means for polishing the photosensitive drum 1, which polishes the photosensitive drum 1 by supplying the photosensitive drum 1 with polishing particles. Thus, when the image forming apparatus 100 is in the charge drain suppression mode, the control circuit 13 makes the polishing means polish the photosensitive drum 1. In this embodiment, the developing apparatus 4 which stores the polishing particles and delivers the polishing particles to the peripheral surface of the photosensitive drum 1, and the cleaning blade 7*a* which scrubs the peripheral surface of the peripheral surface 1 while the photosensitive drum 1 is rotating, etc., make up the polishing means, as will be described later.

The operational sequence for determining whether or not the operational mode is to be switched to the charge drain suppression mode, by carrying out the charge drain detecting operation while no image is formed may be carried out following the flowchart described above with reference to FIG. 10. However, the operation carried out in the charge drain suppression mode in this embodiment is different from those in the preceding embodiments.

That is, as the control circuit 13 determines that the operational mode is to be switched to the charge drain suppression mode (S05), it supplies the peripheral surface of the photosensitive drum 1 with the polishing agent so that the polishing agent reaches the area e of contact between the cleaning blade 7*a* and peripheral surface of the photosensitive drum 1.

In this embodiment, the toner in the developing apparatus 4 contains the polishing agent which was added to the toner in advance. In the charge drain suppression mode, a latent image of a patch (polishing agent supplying image) which is as wide as the entire length of the photosensitive drum 1, and 10 cm in length in term of the moving direction of the peripheral surface of the photosensitive drum 1 is formed on the peripheral surface of the photosensitive drum 1, and this latent image is developed with the use of this developer that contains the polishing agent. Also in this charge drain suppression mode, the transfer voltage is kept turned off, and the image formed of the this toner is conveyed intact through the transfer station d, and then, to the area e of contact between the photosensitive drum 1 and cleaning blade 7*a*.

Thereafter, the control circuit 13 makes the photosensitive drum 1 idle for 10 seconds, and switches the operation mode to the charge drain detection mode (S02-S04) to determine whether or not the photosensitive drum 1 is in the condition which causes the formation of a noticeably blurry and/or dim image. If the value of the direct current Idc is no higher than the charge drain causing minimum current value, the control circuit 13 switches the operational mode to the image formation mode (S06). On the other hand, if the value of the direct current Idc is remaining greater than the charge drain causing minimum current value, the control circuit 13 switches the operational mode back into the charge drain suppression mode (S05).

The charge drain suppressing operational sequence in this embodiment may be carried out following the flowcharts in the second and third embodiments.

As described above, this embodiment can provide the same effects as those obtained by the first to fourth preferred embodiments even though the operation carried out in the charge drain suppression mode in this embodiment is different from those in the first to fourth embodiments. The charge drain suppression mode in this embodiment is a mode for removing the byproducts of the electrical discharge, which are remaining adhered to the peripheral surface of the photosensitive drum 1. Therefore, even if the byproducts of the electrical discharge is remaining adhered to the photosensitive drum 1, the byproducts are removed, and therefore, it is possible to form excellent images, that is, images which do not show the effects of the charge drain.

Embodiment 6

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

In the first to fifth preferred embodiments, when detecting whether or not a significant amount of charge has begun to drain from the peripheral surface of the photosensitive drum 1, the pre-exposing apparatus was kept turned on, and the exposing apparatus 3 was kept turned off. Further, the development voltage and transfer voltage were kept turned off.

In this embodiment, the image forming apparatus 100 is not provided with the pre-exposing apparatus 8. Here, therefore, an example of the operational sequence carried out to determine whether or not a significant amount of charge drain has begun to occur in the image forming apparatus 100 with no pre-exposing apparatus 8 will be described.

Figure 15:
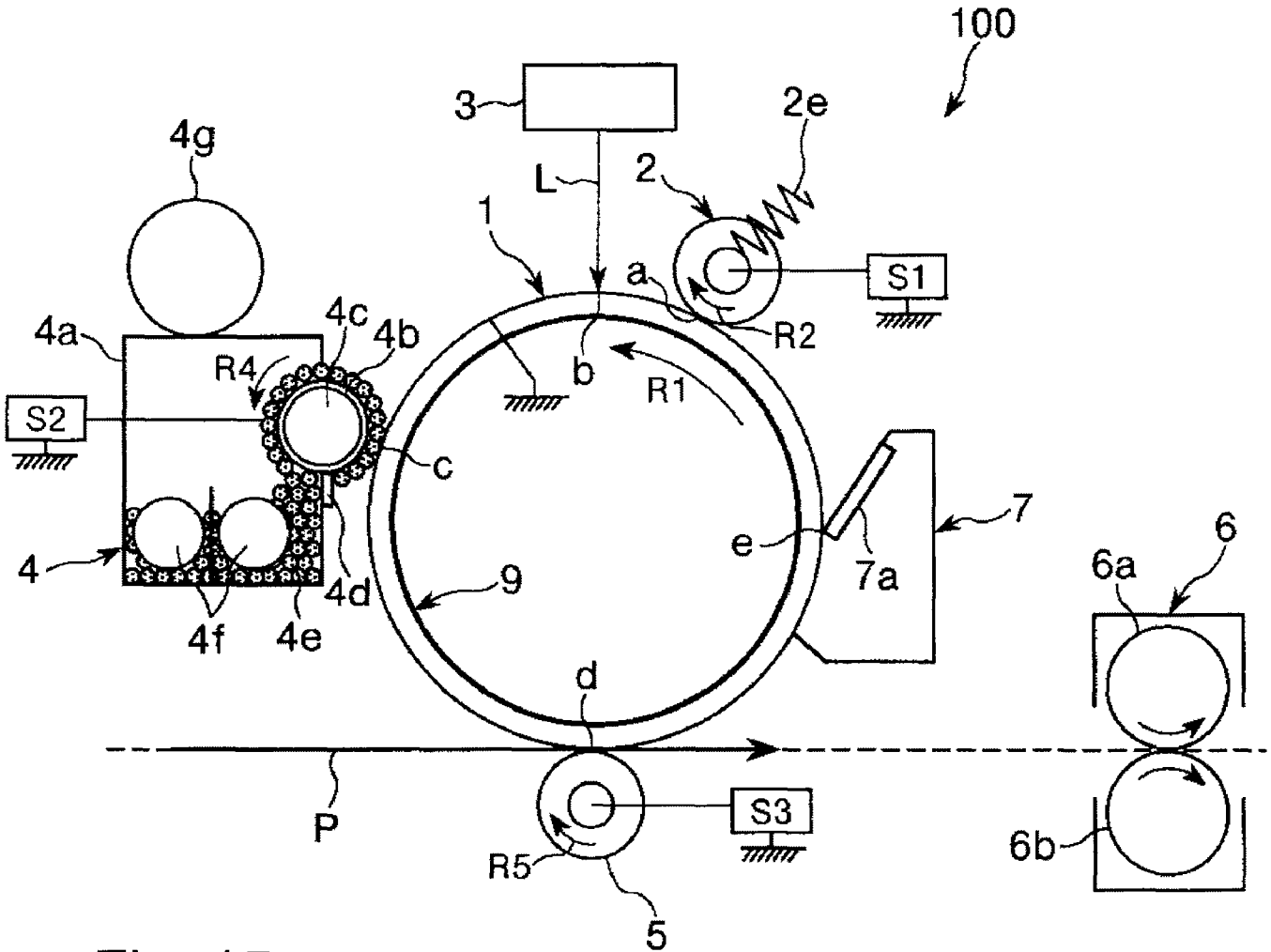
FIG. 15 is a schematic sectional view of the image forming apparatus in the sixth preferred embodiment of the present invention, and shows the general structure of the apparatus.

FIG. 15 shows the general structure of the image forming apparatus 100 in this embodiment. In terms of the structure, this image forming apparatus 100 is virtually the same as the image forming apparatus 100 shown in FIG. 1, except that this image forming apparatus 100 does not have the pre-exposing apparatus 8.

Figure 16:
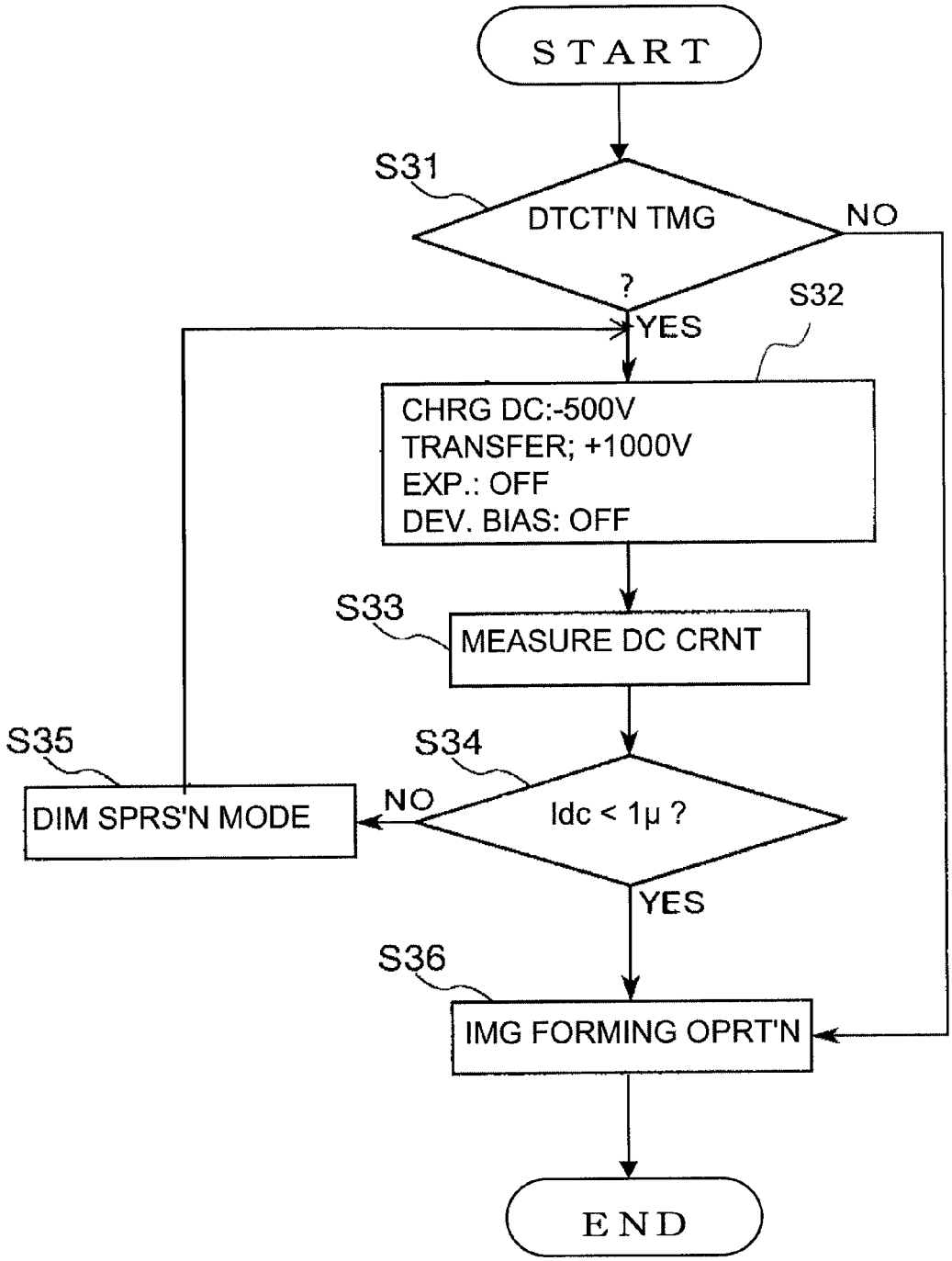
FIG. 16 is a flowchart of another example of the operational sequence for determining whether or not the image forming apparatus is to be operated in the charge drain suppression mode.

FIG. 16 is an example of flowchart of the operational sequence to be executed, while no image is formed, to determine whether or not a significant amount of charge drain has begun to occur, in order to determine whether or not the operational mode is to be switched to the charge drain suppression mode.

As the charge drain detection timing arrives (S31), the control circuit 13 rotates the photosensitive drum 1, and applies a DC voltage (which is −500 V in this embodiment), which is no higher than the discharge start voltage Vth, to the charge roller 2 (S32). During this process, such a transfer voltage (+1,000 V in this embodiment) that causes the portion of the peripheral surface of the photosensitive drum 1, which is on the immediate upstream side of the charge roller 2 in terms of the rotational direction of the photosensitive drum 1, to reduce in surface voltage to virtually zero V, is applied as the transfer voltage. Also during this process, the exposing apparatus 3 is kept turned off, and the development voltage is kept turned off (S32). With the image forming apparatus 100 being set as described above in terms of the voltages, if the photosensitive drum 1 is in the condition which causes the formation of a noticeably blurry and/or dim image, even if the direct voltage which is no higher than the discharge start voltage Vth is applied to the charge roller 2, the current which is being injected from the charge roller 2 into the photosensitive drum 1 is detected, as the direct current Idc, by the measurement circuit 14 (S33).

Then, the control circuit 13 determines whether or not the value of the direct current Icd measured by the measurement circuit 14 is no higher than −1 μA (S34). If the value of the direct current Idc is no less than −1 μA, the control circuit 13 determines that it is the time for the operational mode to be switched to the charge drain suppression mode (S35). On the other hand, if the value of the direct current Idc is no higher than the −1 μA, the control circuit 13 allows the image forming apparatus 100 to start an image forming operation. The various devices used in the operation shown in the flowchart of this operational sequence are controlled by the control circuit 13.

The operations to be carried out in the charge drain suppression mode in this embodiment may be the same as those carried out by the image forming apparatuses in the first, fourth, and fifth preferred embodiments.

As described above, this preferred embodiment of the present invention makes it possible for the image forming apparatus 100 with no exposing apparatus 8 to set the surface potential of the immediately upstream portion of the peripheral surface of the photosensitive drum 1, in terms of the rotational direction of the photosensitive drum 1, to a predetermined level (which is desired to be 0 V), by providing the image forming apparatus with the above described voltage setup. With the voltages being set as described above, if the photosensitive drum 1 falls into the condition which makes it possible for a significant amount of charge drain to occur, even if a DC voltage which is no higher than the discharge start voltage Vth is applied to the charge roller 2, the portion of the peripheral surface of the photosensitive drum 1, which is immediately downstream side of the charge roller 2, becomes charged, and causes injection current to flow. Thus, whether or not a significant amount of charge drain has begun can be detected by detecting the presence of this injection current by the measurement circuit 14. Therefore, the occurrence of a significant amount of charge drain can be efficiently suppressed.

Embodiment 7

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

In the description of this embodiment, an example of the operation sequence to be executed, while no image is formed, to determine whether or not a significant amount of charge has begun drain from the photosensitive drum of the image forming apparatus 100 with no pre-exposing apparatus 8, like the image forming apparatus 100 in the sixth preferred embodiment, will be described.

The image forming apparatus 100 in this embodiment has the structure shown in FIG. 15. Its structure is virtually the same as that of the image forming apparatus 100 shown in FIG. 1, except that the image forming apparatus 100 in this embodiment does not have the pre-exposing apparatus 8.

Figure 17:
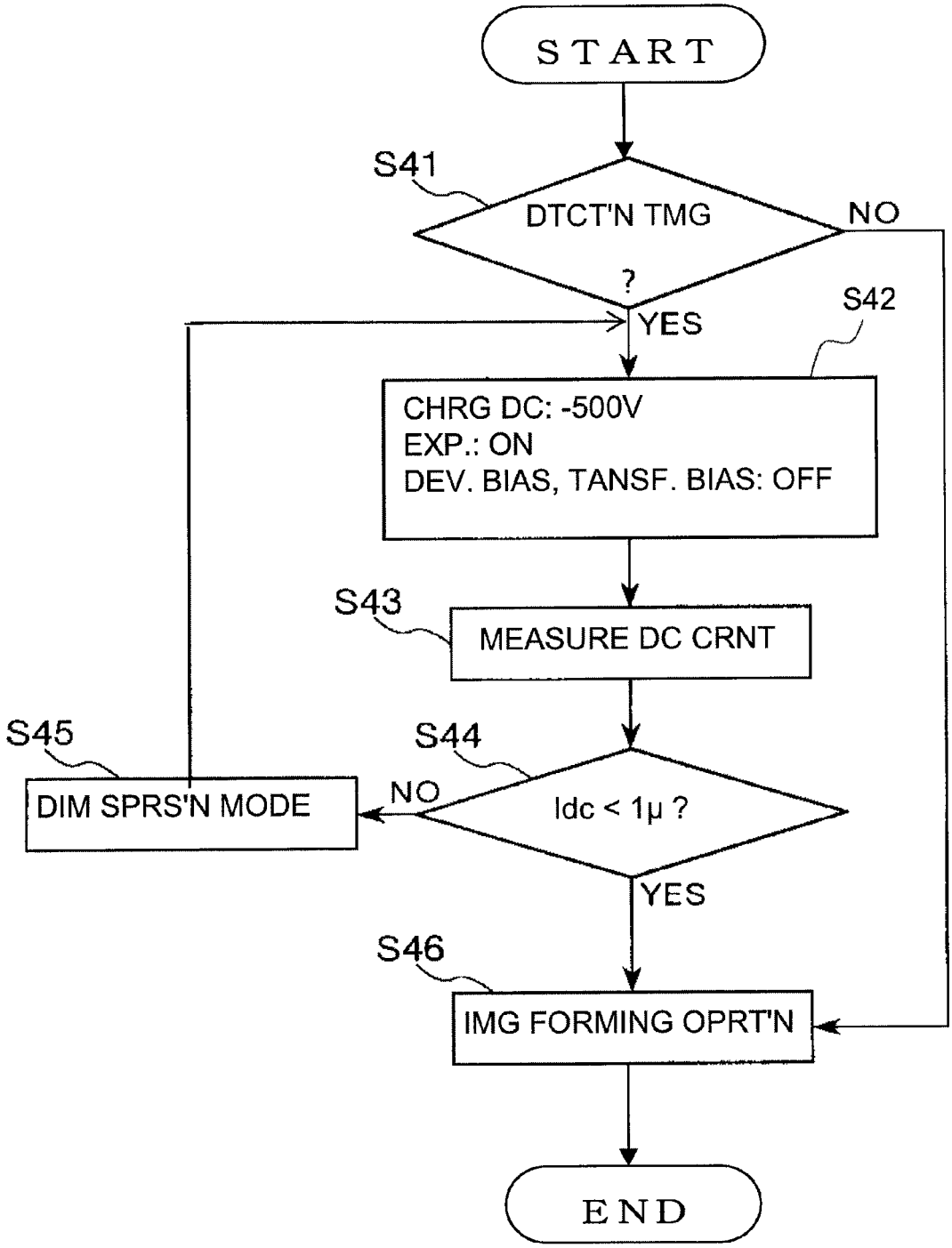
FIG. 17 is a flowchart of another example of the operational sequence for determining whether or not the image forming apparatus is to be operated in the charge drain suppression mode.

FIG. 17 is an example of the flowchart of the operational sequence executed, while no image is formed, to determine whether or not the operational mode of the image forming apparatus 100 is to be switched to the charge drain suppression mode.

As the charge drain detection timing arrives (S41), the control circuit 13 rotates the photosensitive drum 1, and applies to the charge roller 2 a DC voltage (−500 V in this embodiment), which is no higher than the discharge start voltage Vth (S42). Then, in this embodiment, a beam of laser light is projected upon the peripheral surface of the photosensitive drum 1 by the exposing apparatus 3 in such a manner that the potential of the entirety of the peripheral surface of the photosensitive drum 1 reaches the solid image formation level (potential level equivalent to highest density). During this process, the transfer voltage is kept turned off, and the development voltage also is kept turned off (S42). With the image forming apparatus 100 being set as described above, if the photosensitive drum 1 is in the condition which causes a significant amount of charge drain, even if a DC voltage which is no higher than the discharge start voltage Vth is applied to the charge roller 2, the current which is injected from the charge roller 2 into the photosensitive drum 1 is detected, as the direct current Idc, by the measurement circuit 14 (S43).

Then, the control circuit 13 determines whether or not the value of the direct current Idc detected by the measurement circuit 14 is no higher than −1 μA (S44). If the value of the direct current Idc is no less than −1 μA, the control circuit 13 determines that the operational mode is to be switched to the charge drain suppression mode (S45). On the other hand, if the detected value of the direct current Idc is no higher than −1 μA, the control circuit 13 makes the image forming apparatus 100 start an intended image forming operation (S46). The various devices involved in the operations shown in the flowchart are controlled by the control circuit 13.

The operations to be carried out in the charge drain suppression mode in this embodiment may be the same as those in the first, fourth, or fifth embodiment.

As described above, this preferred embodiment can set the potential of the portion of the peripheral surface of the photosensitive drum 1, which is on the immediately upstream side of the charge roller 2 in terms of the rotational direction of the photosensitive drum 1, to a preset level (which is desired to be 0 V), by setting the image forming apparatus 100 as described above, even if the image forming apparatus 100 does not have the pre-exposing apparatus 8. With the image forming apparatus 100 being set as described above, even if a DC voltage which is no higher than the discharge start voltage Vth is applied to the charge roller 2, the portion of the peripheral surface of the photosensitive drum 1, which is on the immediately downstream side of the charge roller 2, becomes charged, and therefore, injection current flows. Thus, whether or not a significant amount charge has begun to drain from the photosensitive drum 1 can be determined by detecting the this injection current with the use of the measurement circuit 14. Therefore, the charge drain can be efficiently suppressed.

Embodiment 8

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

In the first to seventh embodiments, a preset voltage, for example, −500 V of DC voltage was, was applied to the charge roller 2 while keeping the voltage at the preset level, and whether or not the operational mode of the image forming apparatus 100 is to be switched to the charge drain suppression mode was determined by measuring the value of the current flowed by the applied preset voltage. However, whether or not the operational mode of the image forming apparatus 100 is to be switched to the charge drain suppression mode can be determined by controlling the voltage applied to the charge roller 2 in such a manner that the current flowed by the voltage applied to the charge roller 2 remains constant at a preset level.

Figure 18:
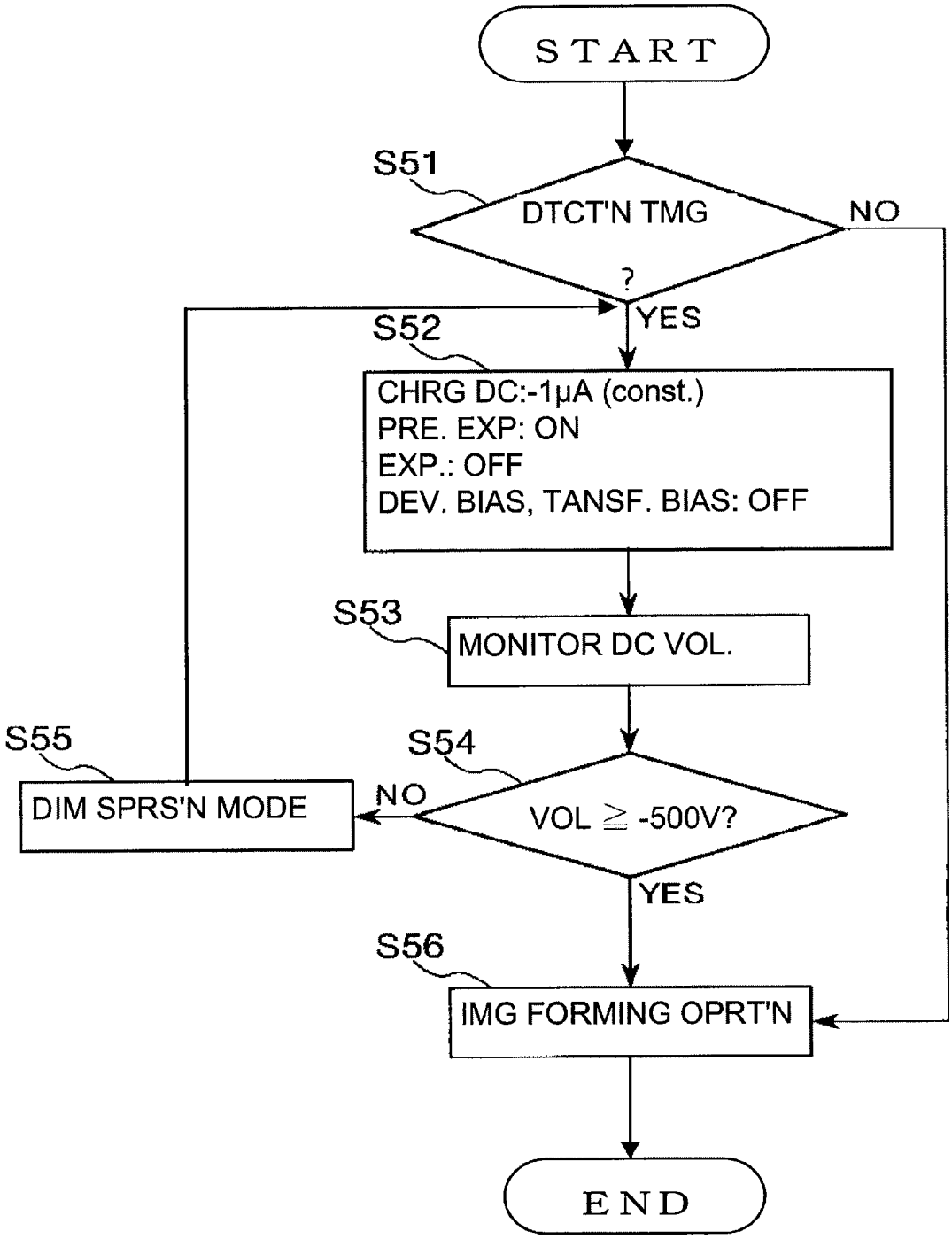
FIG. 18 is a flowchart of another example of the operational sequence for determining whether or not the image forming apparatus is to be operated in the charge drain suppression mode.

FIG. 18 is an example of the flowchart, in this embodiment, of the operational sequence carried out, while no image is formed, to determine whether or not the operational mode of the image forming apparatus 100 is to be switched to the charge drain suppression mode.

As the charge drain detection timing arrives (S51), the control circuit 13 rotates the photosensitive drum 1, and controls the voltage applied to the charge roller 2, so that the amount of the current detected by the measurement circuit 14 remains constant at −1 μA (S52). During this process, the pre-exposing apparatus 8 is kept turned on, and the exposing apparatus 3 is kept turned off along with the development voltage and transfer voltage (S52). Further, the voltage applied by the DC power source 11 of the charge voltage power source S1 is monitored by a voltmeter 17 as a voltage detecting means (S53). The information obtained by monitoring the voltage applied by the DC voltage power source 11 is transmitted to the control circuit 13.

In the first embodiment, if direct current flows by an amount greater than −1 μA as −500 V of DC voltage is applied to the charge roller 2, it is determined that the photosensitive drum 1 is in the condition which can cause the formation of a noticeably blurry and/or dim image. In this embodiment, if the voltage applied to the charge roller 2 remains no higher than −500 V while the voltage applied to the charge roller 2 is controlled so that the current flowed by the voltage remains constant at −1 μA, it is determined that the photosensitive drum 1 is in the condition which can cause the formation of a noticeably blurry and/or dim image (S54).

If the voltage applied to the charge roller 2 remains no higher than −500 V, the control circuit 13 determines that the operational mode of the image forming apparatus 100 is to be switched to the charge drain suppression mode (S55). If the voltage applied to the charge roller 2 exceeds −500 V, the control circuit 13 makes the image forming apparatus 100 start an image forming operation (S56). The various devices involved in this process are controlled by the control circuit 13.

In this embodiment, the charge drain suppressing operation is carried out by the drum heater in the photosensitive drum 1. As the control circuit 13 determines that the operational mode is to be switched to the charge drain suppression mode, it turns on the power source 10 of the drum heater 9 to reduce the relative humidity of the adjacencies of the peripheral surface of the photosensitive drum 1 to minimize the probability of the occurrence of a significant amount of charge drain. More concretely, the control circuit 13 keeps the drum heater 9 turned on for one minute to operate the image forming apparatus 100 in the charge drain suppression mode, and then, puts the image forming apparatus 100 back into the charge drain detection mode (S52-S54) to determined whether or not the photosensitive drum 1 is in the condition which can cause the formation of a noticeably blurry and/or dim image. If the applied voltage is no less than −500 V, the control circuit 13 switches the operational mode to the image formation mode (S56). If the applied voltage remains no higher than −500 V, the control circuit 13 puts the image forming apparatus 100 back into the charge drain suppression mode (S55).

Also in this embodiment, the charge drain suppression mode similar to those in the charge drain suppression mode in the embodiments 4 and 5 may be used in place of the charge drain suppression mode in this embodiment.

As described above, in this embodiment, the DC voltage applied for the charge drain detection is controlled to keep constant the current flowed by the applied DC voltage, and the voltmeter 17 measures the output voltage of the voltage applying means S while the DC voltage for charge drain detection is applied to the charge roller 2 in a manner to keep constant the current flowed by the applied voltage. Then, the control circuit 13 determines whether or not the preset operation to be carried out, based on the voltage value detected by the voltmeter 17. To described in more detail, if the absolute value of the voltage detected by the voltmeter 17 is no greater than a preset value, the control circuit 13 makes the image forming apparatus 100 to carry out the preset operation, whereas if the absolute value of the voltage detected by the voltmeter 17 is no less than a preset value, the control circuit 13 does not make the image forming apparatus 100 carry out the preset operation.

As described above, the effects similar to those in the preceding embodiments can be obtained by detecting the occurrence of a significant amount of charge drain from the photosensitive drum, by applying voltage to the charge roller 2 so that the current flowed by the voltage remains constant, as in this embodiment.

Embodiment 9

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

In the description of the first to eighth embodiments, the operational modes, in which whether or not the photosensitive drum 1 is in the condition which causes the formation of a noticeably blurry and/or dim image, is determined by measuring the amount of the direct current while applying a DC voltage, which is no higher than the discharge start voltage, to the charge roller 2.

In this embodiment of the present invention, and the following embodiments up to the fifteenth embodiment, the operational modes in which whether or not the photosensitive drum 1 is in the condition which causes the formation of a noticeably blurry and/or dim image is determined by applying a DC voltage, which is no higher than the discharge start voltage, to the charge roller 2, and measuring the surface potential of the photosensitive drum 1, which was injected by the DC voltage applied to the charge roller 2, will be described.

Figure 19:
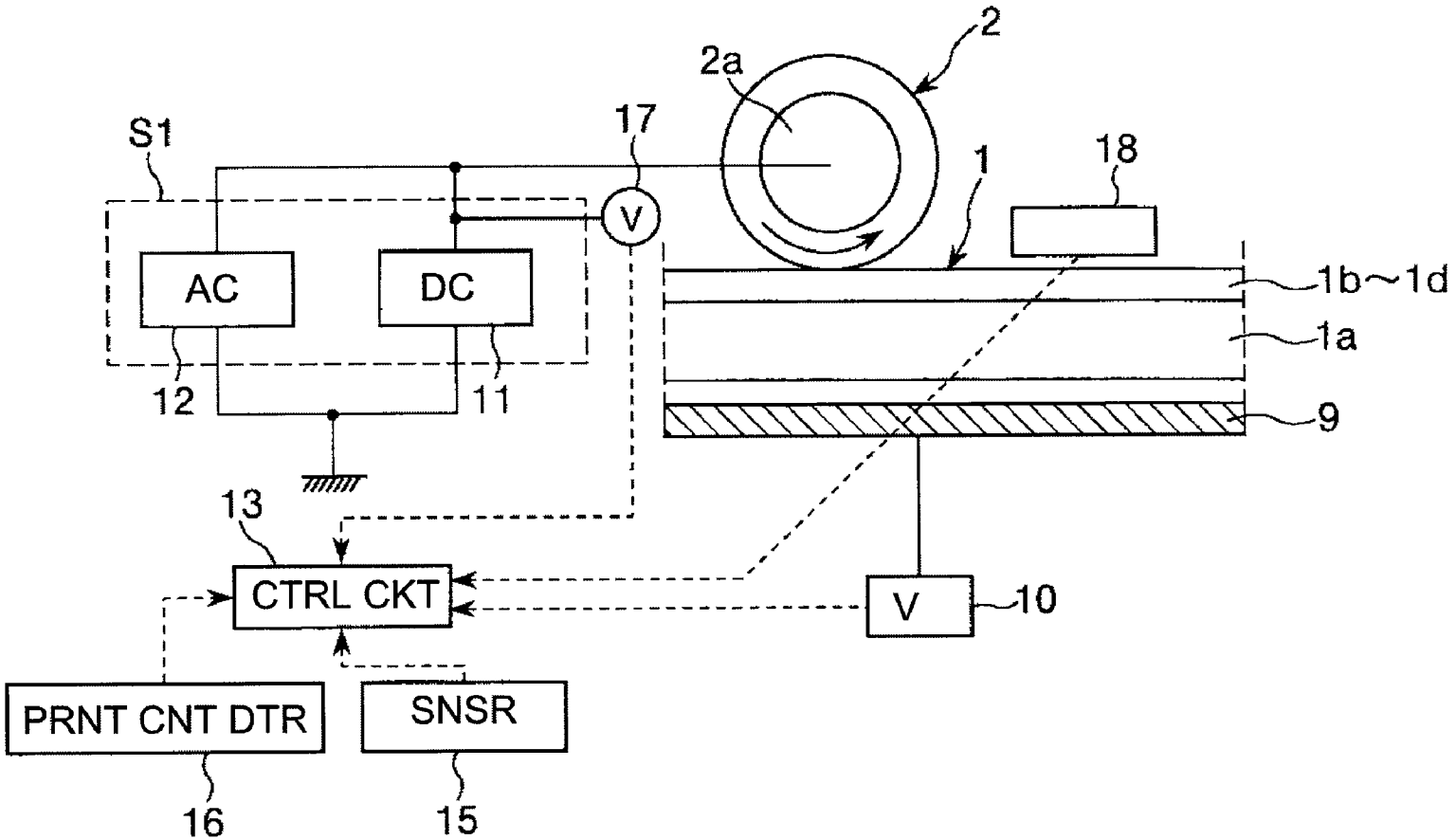
FIG. 19 is a block diagram of the charge voltage application system of the image forming apparatus in the ninth preferred embodiment of the present invention.

FIG. 19 is a block diagram of the electrical circuit of the system for applying the charge voltage to the charge roller 2, in this embodiment.

The image forming apparatus 100 in this embodiment has an electrometer 18 for measuring the surface potential level of the photosensitive drum 1. The measured surface potential level of the photosensitive drum 1 is inputted from this electrometer 18 to the control circuit 13.

In this embodiment, the electrometer 18 measures the surface potential level of the photosensitive drum 1 by measuring the signal changes of the induction current with an electrode.

Further, in order to measure the surface potential level of the photosensitive drum 1, the electrometer 18 is disposed on the downstream side of the charging area a, and upstream side of the exposing point b, in terms of the rotational direction of the photosensitive drum 1.

Further, the control circuit 13 in this embodiment is given the function of carrying out a program for determining whether or not the operational mode of the image forming apparatus 100 is to be switched to the charge drain suppression mode, based on the information of the potential level of the photosensitive drum 1, which is inputted from the electrometer 18.

It should be noted here that the image forming apparatus 100 in this embodiment is not provided with a measurement circuit, such as the measurement circuits 14 in the first to eight embodiments, which is shown in FIG. 4.

Further, the image forming apparatus 100 in this embodiment dos not have a pre-exposing apparatus, such as the pre-exposing apparatus 8 which the image forming apparatus 100 shown in FIG. 1 has. That is, the image forming apparatus 100 in this embodiment is similar in overall structure to the image forming apparatus shown in FIG. 100.

Next, the charge drain detection system in this embodiment will be described.

One of the objects of the present invention is to provide an image forming apparatus which is capable of efficiently preventing the phenomenon that because of the presence of the byproducts of electrical discharge, which is remaining adhered to the peripheral surface of the photosensitive drum 1, a noticeably blurry and/or dim image is formed by the image forming apparatus. To describe in more detail, one of the objects of the present invention is to provide an electrophotographic image forming apparatus, which is capable of determining whether or not its photosensitive member is in the condition which causes the formation of a noticeably blurry and/or dim image, without consuming an additional time and additional image formation supplies, so that it operates in the charge drain suppression mode only when necessary.

As described above, FIG. 5 is a graph which shows the relationship between the DC voltage applied to the charge roller 2 and the surface potential level of the photosensitive drum 1, which was obtained in an environment which is 23° C. in temperature, and 50% in relative humidity. It is evident from this graph that the charge start voltage Vth was −550 V.

The discharge start voltage Vth is affected by the gap between the charge roller 2 and photosensitive drum 1, thickness of the photosensitive layer, and dielectric constant of the photosensitive layer. As a voltage which is no less than the discharge start voltage Vth is applied to the charge roller 2, the electrical discharge occurs across the abovementioned gap, and the photosensitive drum 1 becomes charged in accordance with Paschen's law.

Figure 20:
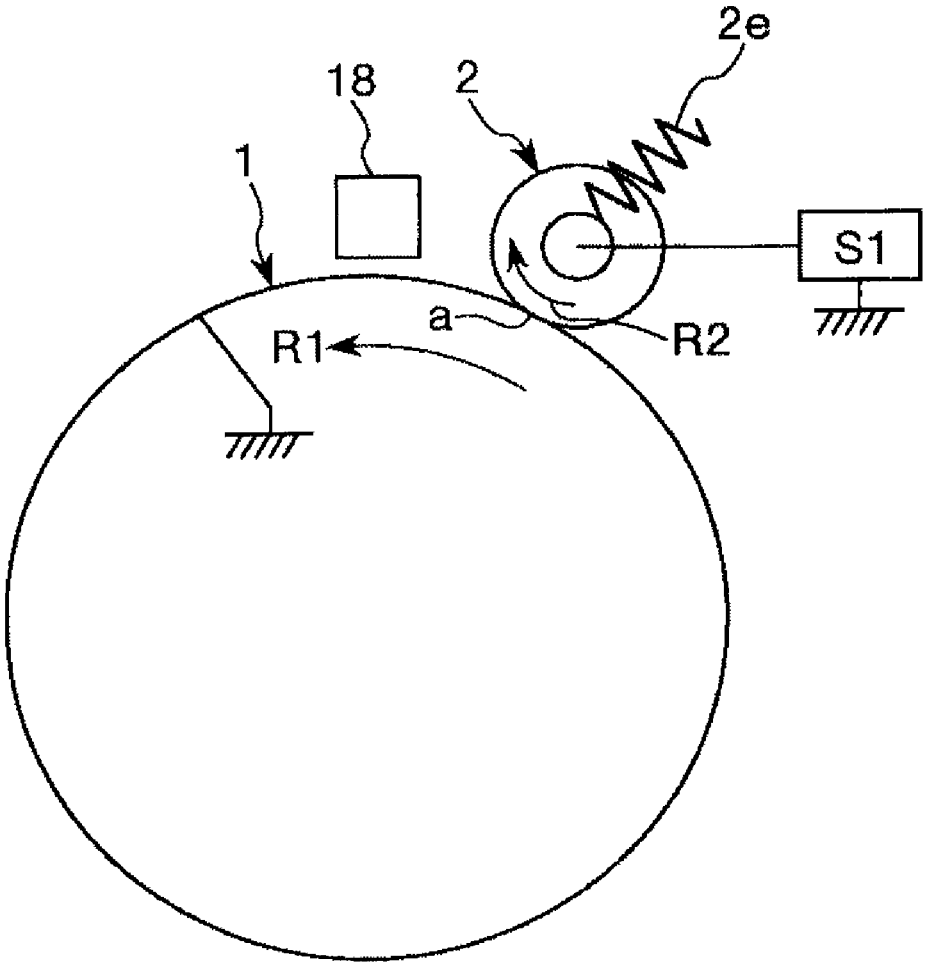
FIG. 20 is a schematic drawing of an another example of testing apparatus for measuring the amount of changes in the amount of surface potential of the photosensitive drum, which causes the image forming apparatus to form a noticeably blurry and/or dim image.

FIG. 20 is a diagrammatic sectional view of what remains after the removal of the exposing apparatus 3, developing apparatus 4, transfer roller 5, fixing apparatus 6, and cleaning apparatus 7 from the image forming apparatus 100 in this embodiment, which is shown in FIG. 15. That is, there is only the charge roller 2 and electrometer 18 in the adjacencies of the peripheral surface of the photosensitive drum 1. When the image forming apparatus 100 is in the above-described condition, and in an environment which is 50% in relative humidity, the photosensitive drum 1 was rotated while applying a preset voltage to the charge roller 2. More specifically, the voltage applied to the charge roller 2 was a combination of an AC voltage which is 1,500 V in peak-to-peak voltage, and −500 V of DC voltage.

Figure 21:
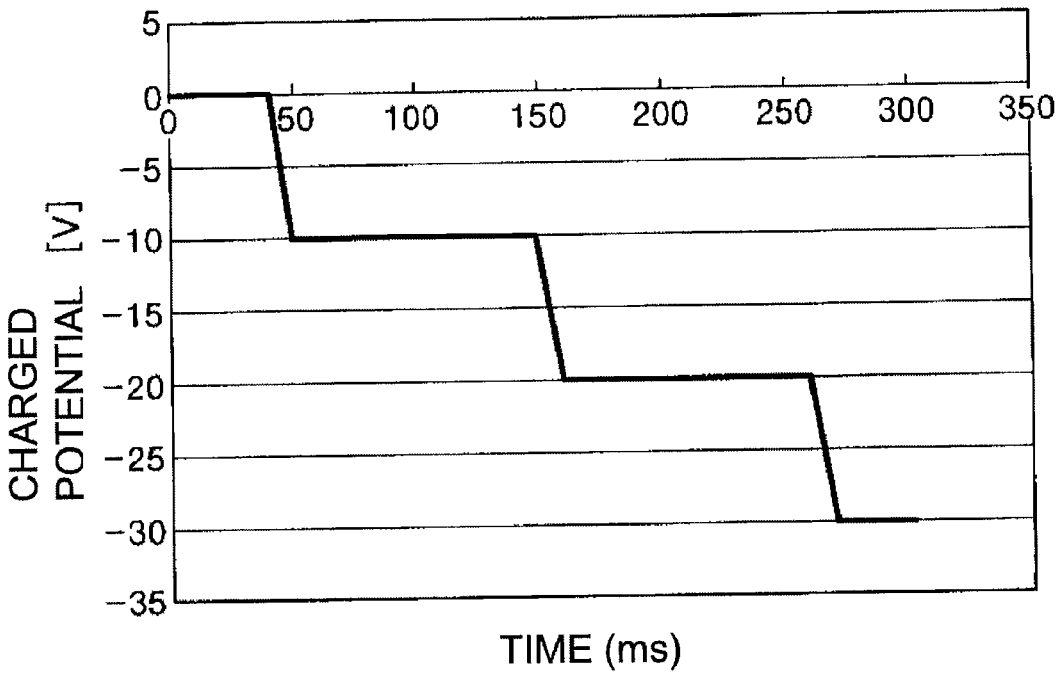
FIG. 21 is a graph which shows an example of relationship between the length of time the photosensitive drum was idled, and the potential level of the peripheral surface of the photosensitive member.

FIG. 21 shows the relationship between the surface potential level of the photosensitive drum 1 and the elapsed time, in a test in which after the photosensitive drum 1 of the apparatus shown in FIG. 20 was rotated while being discharged under the above described voltage settings, and then, the photosensitive drum 1 was charged by applying only −500 V of DC voltage to the charge roller 2.

Referring to FIG. 5, normally, in the case of the charging system like the one in this embodiment, unless the DC voltage, that is, the only voltage applied to the charge roller 2, is no less than −550 V, electrical discharge did not occurred, and therefore, the photosensitive drum 1 does not become charged. However, as the DC voltage is applied to the charge roller 2 to charge the photosensitive drum 1, the byproducts of the electrical discharge accumulate on the peripheral surface of the photosensitive drum 1 anyway. These byproducts remains adhered to the peripheral surface of the photosensitive drum 1, they absorb the humidity in the air, and therefore, reduce the photosensitive drum 1 in surface resistance. Thus, even if the voltage applied to the charge roller 2 is no higher than the discharge start voltage Vth, the photosensitive drum 1 becomes charged. If an image forming operation is carried out by the image forming apparatus 100 while the apparatus 100 is in this condition, an image which appears blurry is formed. That is, a significant amount of charge drains from the peripheral surface of the photosensitive drum.

When the photosensitive drum 1 is in the condition which causes the formation of a noticeably blurry and/or dim image, it becomes slightly charged even if a DC voltage (−500 V in this embodiment) which is no higher than the discharge start voltage Vth, which is in accordance with Paschen's law, is applied to the charge roller 2. This phenomenon occurs because the reduction in the electrical resistance of the peripheral surface of the photosensitive drum 1 allows electrical charge to be "injected" into the photosensitive drum 1. FIG. 9 diagrammatically shows this mechanism.

While the photosensitive drum 1 is in the condition which does not cause the formation of a noticeably blurry and/or dim image, the application of −500 V of DC voltage to the charge roller 2 does not charge the photosensitive drum 1; the photosensitive drum 1 does not change in surface potential.

However, if the photosensitive drum 1 reduces in surface resistance, it becomes possible for electrical charge to be injected into the photosensitive drum 1, and therefore, the photosensitive drum 1 becomes charged, very slightly, even if the voltage applied to the charge roller 2 is no higher than the discharge start voltage Vth. It was found that in this embodiment, as −500 V of DC voltage was applied to the charge roller 2, the potential level of the peripheral surface of the photosensitive drum 1 rose for every full rotation of the photosensitive drum 1.

In this embodiment, a phenomenon, such as the one described above, was used as the means for determining whether or not the photosensitive drum 1 is in the condition which causes the formation of a noticeably blurry and/or dim image.

The following was discovered as the results of the earnest studies made by the inventors of the present invention regarding the significant amount of charge drain from the peripheral surface of a photosensitive drum. That is, referring to FIG. 21, in an environment in which relative humidity is 50%, as an amount ΔV by which the surface potential level changes per full rotation of the photosensitive drum 1 reaches 10 V, the photosensitive drum 1 of the system in this embodiment reduces in surface resistance. As the photosensitive drum 1 reduces in surface resistance, the electrical charge for forming a latent image partially escapes; the photosensitive drum 1 fails to retain all the electrical charge for forming a latent image. Therefore, the phenomenon that the image forming apparatus 100 forms an image, which is missing some of the dots, occurs. That is, a significant amount of charge drain occurs.

In this embodiment, therefore, whether or not the photosensitive drum 1 is in the condition which can cause the formation of a noticeably blurry and/or dim image is determined by measuring the amount ΔV by which the surface potential of the photosensitive drum 1 changes when a DC voltage which is no higher than the discharge start voltage Vth is applied to the charge roller 2. Obviously, it may be determined by finding out whether or not the amount ΔV by which the surface potential level of the photosensitive drum 1 changes per full rotation of the photosensitive drum 1 is greater than a preset value. For example, it may be determined by finding out whether or not the absolute value of the potential level of the peripheral surface of the photosensitive drum 1, relative to a preset value, for example, 0 V, is greater than a preset value.

As described above, the image forming apparatus 100 in this embodiment has a measuring means for measuring the amount of the change in the surface potential of the photosensitive drum 1 caused by the application of a DC voltage, which is no higher than the discharge start voltage, to the charge roller 2. The image forming apparatus 100 has also a controlling means 13 for determining whether or not the process (charge drain suppression mode) for suppressing the draining of charge from the photosensitive drum 1, is to be carried out, in response to the results of the detection by the detecting means 14. In particular, the above described detecting means 14 in this embodiment has the electrometer 18 for measuring the surface potential level which results from the application of the DC voltage, which is no higher than the discharge start voltage Vth, to the charge roller 2. The control circuit 13 determines whether or not to make the image forming apparatus 100 operate in the charge drain suppression mode, based on the output of the electrometer 18. For example, if the absolute value of the potential level measured by the electrometer 18 is no less than a preset value, the control circuit 13 make the image forming apparatus 100 operate in the charge drain suppression mode. If the absolute value is no higher than the preset value, the control circuit 13 does not make the image forming apparatus 100 operate in the charge drain suppression mode.

Figure 22:
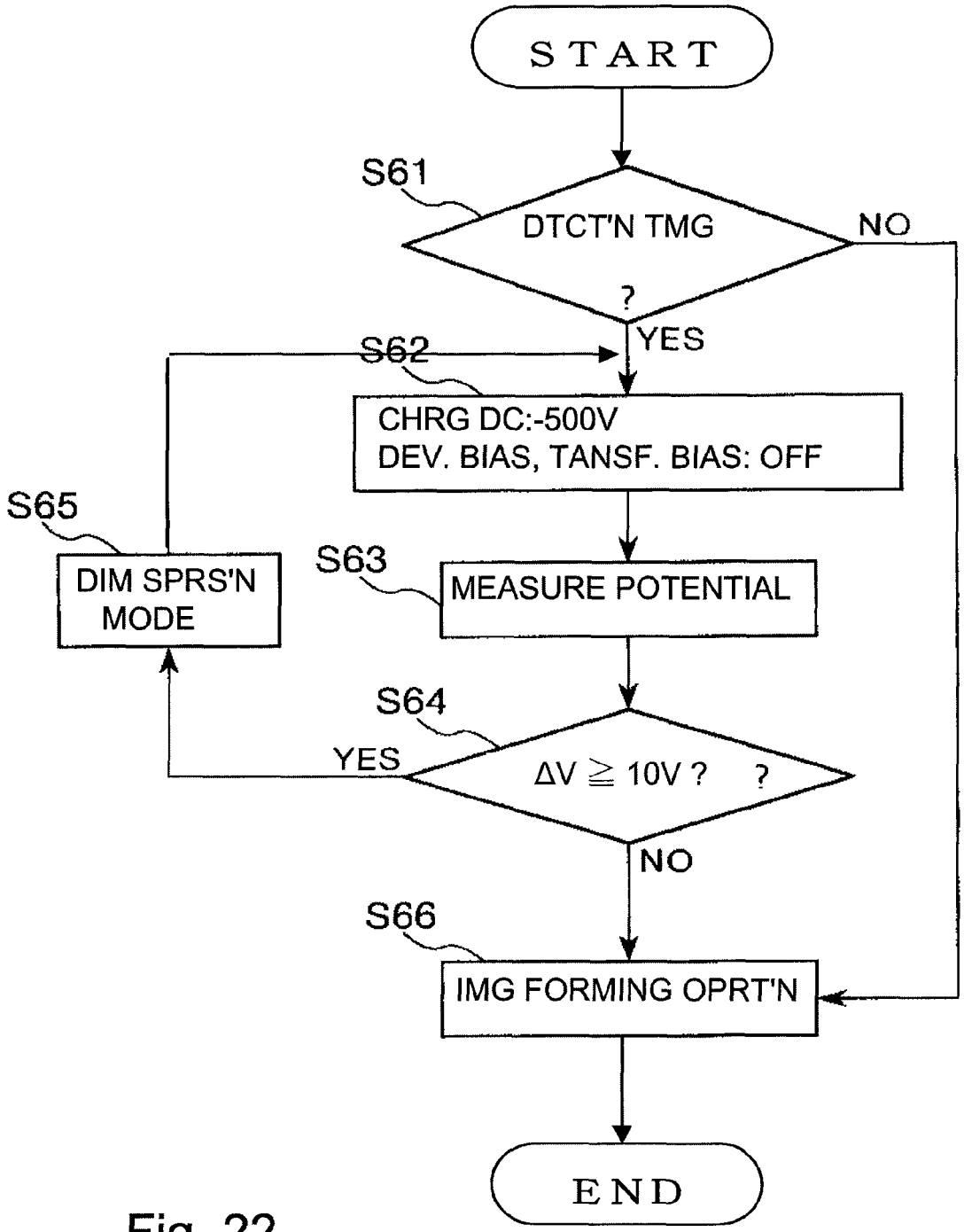
FIG. 22 is a flowchart of another example of the operational sequence for determining whether or not the image forming apparatus is to be operated in the charge drain suppression mode.

FIG. 22 is an example of the flowchart of the operational sequence, which is to be carried out, which no image is formed, to determine whether or not the operational mode is switched to the charge drain suppression mode by determining whether or not the photosensitive drum 1 is in the condition which can cause the formation of a noticeably blurry and/or dim image.

As the charge drain detection timing arrives (S61), the control circuit 13 rotates the photosensitive drum 1, and applies a DC voltage (−500 V in this embodiment), which is no higher than the discharge start voltage Vth, to the charge roller 2 while rotating the photosensitive drum 1 (S62). During this process, the exposing apparatus 3 is not operated, and neither development voltage nor the transfer voltage is applied (S61). With the voltages being set as described above, if the photosensitive drum 1 is in the condition which can cause the formation of a noticeably blurry and/or dim image, electrical charge is injected from the charge roller 2 into the photosensitive drum 1 even when the DC voltage applied to the charge roller 2 is no higher than the discharge start voltage Vth. The injected charge is detected, as the potential of the photosensitive drum 1, by the electrometer 18 (S63).

The control circuit 13 determines whether or not the amount ΔV of the change in the potential level of the photosensitive drum 1, which was measured by the electrometer 18, is no less than 10 V (S64). If the amount Δ of the change in the potential level of the photosensitive drum 1 is no less than 10 V, the control circuit 13 determines that the operational mode is to be switched to the charge drain suppression mode (S65). If the amount ΔV of the change in the potential level of the photosensitive drum 1 is no higher than 10 V, the control circuit 13 makes the image forming apparatus 100 start an image forming operation (S66). Various devices involved in this operation are controlled by the control circuit 13.

When the image forming apparatus 100 in this embodiment is in the charge drain suppression mode, the charge drain suppressing operation is carried out by the drum heater 9 in the photosensitive drum 1. That is, as the control circuit 13 determines that the operational mode is to be switched to the charge drain suppression mode, it turns on the power source 10 of the drum heater 9 to reduce the relative humidity of the adjacencies of the peripheral surface of the photosensitive drum 1 to minimize the probability of the occurrence of the formation of a noticeably blurry and/or dim image. More concretely, the control circuit 13 keeps the drum heater 9 turned on for one minute to operate the image forming apparatus 100 in the charge drain suppression mode, and then, puts the image forming apparatus 100 back into the charge drain detection mode (S62-S64) to determine whether or not the photosensitive drum 1 is in the condition which may cause the formation of a noticeably blurry and/or dim image. If the amount ΔV by which the surface potential level of the photosensitive drum 1 changes has fallen below 10 V, the control circuit 13 switches the operational mode to the image formation mode (S66). If the amount ΔV by which the surface potential level of the photosensitive drum 1 changes has remain at or above 10 V, the control circuit 13 puts the image forming apparatus 100 back into the charge drain suppression mode (S65).

As described above, in this embodiment, the control circuit 13 determines whether or not the photosensitive drum 1 is to be heated by the heating means 9, based on the results of the detection by the detecting means. In particular, in this embodiment, the control circuit 13 determines whether or not the above described heating process to be carried out, based on the output of the potential level detecting means 14.

As described above, in this embodiment, whether or not the photosensitive drum 1 is in the condition which can cause the formation of a noticeably blurry and/or dim image is determined within the image forming apparatus 100 before an image forming operation is started. In other words, the image forming apparatus 100 is operated in the charge drain suppression mode only when necessary. Therefore, electric power and time are not wasted. In other words, the occurrence of the formation of a noticeably blurry and/or dim image is efficiently reduced.

Embodiment 10

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

The ninth embodiment was described with reference to the operational sequence for detecting whether or not the photosensitive drum 1 is in the condition which may cause the formation of a noticeably blurry and/or dim image when the image forming apparatus is in an environment in which relative humidity is at 50%.

Figure 23:
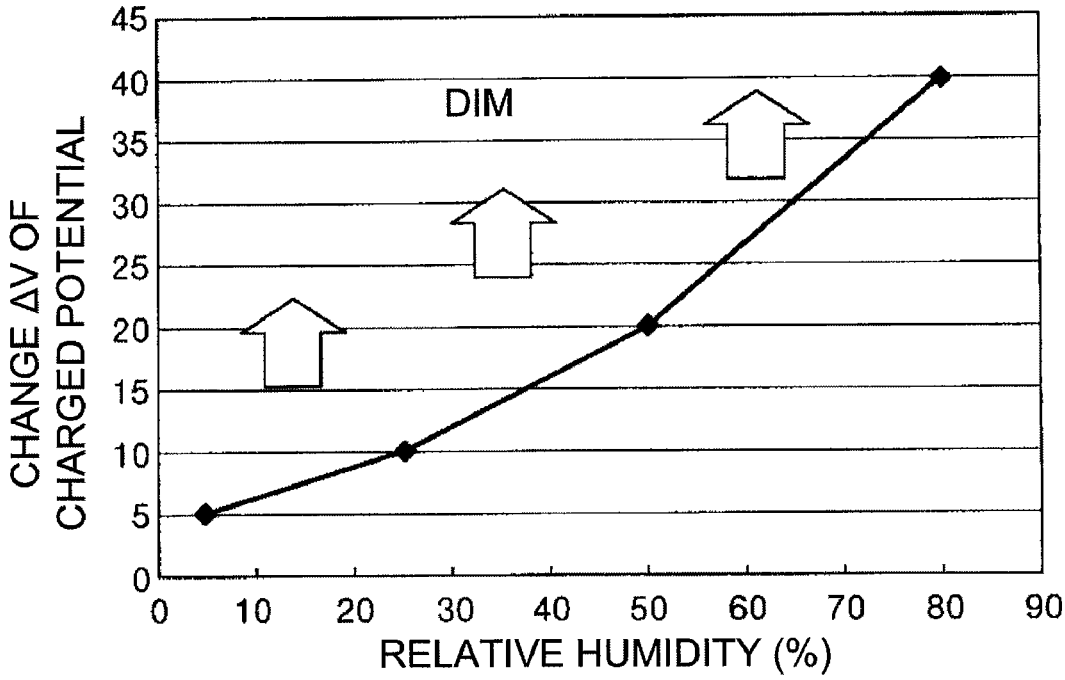
FIG. 23 is a graph which shows another example of relationship between the relative humidity, and the potential level of the peripheral surface of the photosensitive drum.

FIG. 23 is a graph which shows the relationship between the relative humidity in the image forming apparatus 100, and the amount ΔV of the change in the potential level of the photosensitive drum 1, beyond which the photosensitive drum 1 causes the formation of a noticeably blurry and/or dim image.

As the environment in which the image forming apparatus 100 is operated changes, the charge roller 2 and photosensitive drum 1 change in electrical resistance. Thus, as the environment increases in relative humidity, the surface potential level of the photosensitive drum 1, which is detected by the electrometer 18 to determine whether or not the photosensitive drum 1 is in the condition which may cause the formation of a noticeably blurry and/or dim image, changes. Therefore, in order to more precisely control the image forming apparatus 100, it is desired that if the environment changes, the amount ΔV, which is the threshold amount for determining whether or not the photosensitive drum 1 is in the condition which can cause the formation of a noticeably blurry and/or dim image, is changed in response to the change in the environment.

In this embodiment, therefore, the image forming apparatus 100 is provided with an environment sensor 15, as an environment condition detecting means, which is disposed in the image forming apparatus 100, as shown in FIG. 19. This environment sensor 15 detects the relative humidity in the image forming apparatus 100, and transmits the detected relative humidity to the control circuit 13.

Figure 24:
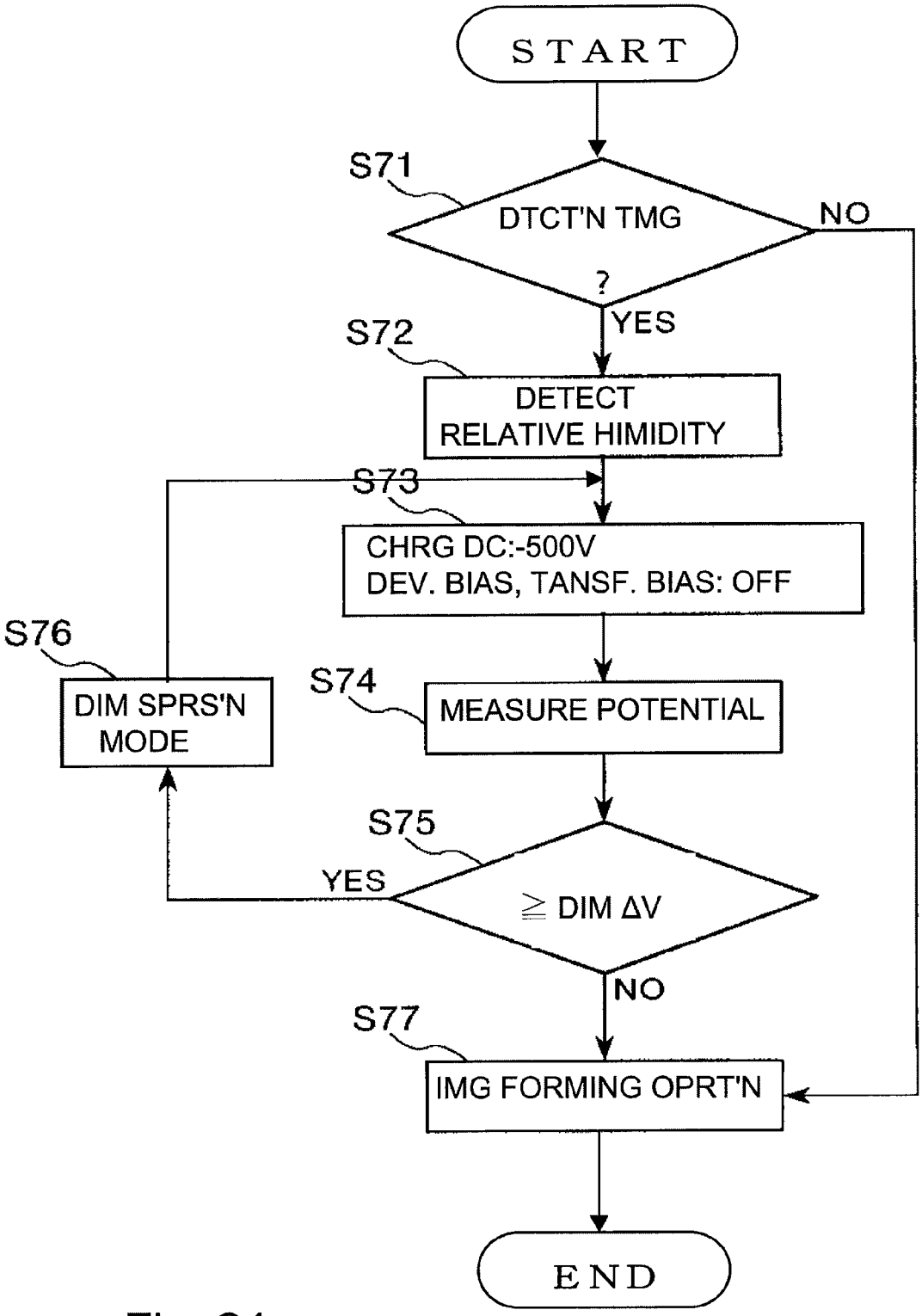
FIG. 24 is a flowchart of another example of the operational sequence for determining whether or not the image forming apparatus is to be operated in the charge drain suppression mode.

FIG. 24 is an example of the flowchart of the operational sequence which is carried out, while no image is form, to determine whether or not the operational mode of the image forming apparatus 100 is to be switched to the charge drain suppression mode, by determining whether or not the formation of a noticeably blurry and/or dim image has begun.

As the charge drain detection timing arrives (S71), the control circuit 13 makes the environment sensor 15 measure the relative humidity in the image forming apparatus 100, and send the obtained information to the control circuit 13 (S71).

Then, the control circuit 13 rotates the photosensitive drum 1, and applies a DC voltage (−500 V in this embodiment), which is no higher than the discharge start voltage Vth, to the charge roller 2 (S73). During this process, the exposing apparatus 3 is kept inactive, and neither development voltage nor the transfer voltage is applied (S73). With the voltages being set as described above, if the photosensitive drum 1 is in the condition which can cause the formation of a noticeably blurry and/or dim image, electrical charge is injected from the charge roller 2 into the photosensitive drum 1 even if the DC voltage applied to the charge roller 2 is no higher than the discharge start voltage Vth. The voltage injected into the photosensitive drum 1 is detected (measured), as potential, by the electrometer 18 (S74).

The control circuit 13 determines whether or not the amount ΔV of the change in the potential level of the photosensitive drum 1, which was measured by the electrometer 18, is greater than a value (threshold value for determining whether or not change in potential level of photosensitive drum is large enough to cause significant amount of charge drain) set for determine whether or not the photosensitive drum 1 is in the condition which may causes the formation of a noticeably blurry and/or dim image, under the present environmental condition detected with the use of the environment sensor 15 (S75). Referring to FIG. 23, the values for the amount ΔV, which are environmental threshold values, are set in advance as shown in FIG. 23. The control circuit 13 selects one of the threshold values based on the relative humidity detected by the environment sensor 15, and uses the selected threshold value to make the above described decision. If the amount ΔV of the change in the potential level of the photosensitive drum 1 detected by the environment sensor 15 is no less than the threshold value selected from FIG. 23 which shows the threshold values for the amount ΔV, the control circuit 13 determines that the operational mode is to be switched to the charge drain suppression mode (S76). If the amount ΔV is no more than the minimum current value which causes the formation of a noticeably blurry and/or dim image, the control circuit 13 makes the image forming apparatus 100 carry out an image forming operation (S77). The various devices involved in this process are controlled by the control circuit 13.

In this embodiment, when the image forming apparatus 100 is in the charge drain suppression mode, the charge drain suppressing operation is carried out by the drum heater 9 in the photosensitive drum 1. That is, as the control circuit 13 determines that the operational mode is to be switched to the charge drain suppression mode, it turns on the power source 10 of the drum heater 9 to reduce the relative humidity of the adjacencies of the peripheral surface of the photosensitive drum 1 to minimize the probability of the occurrence of a significant mount of charge drain from the photosensitive drum 1. More concretely, the control circuit 13 keeps the drum heater 9 turned on for one minute to operate the image forming apparatus 100 in the charge drain suppression mode, and then, puts the image forming apparatus 100 back into the charge drain detection mode (S73-S75) to determine whether or not the photosensitive drum 1 is in the condition which may cause the formation of a noticeably blurry and/or dim image. If the amount ΔV by which the surface potential level of the photosensitive drum 1 changes has fallen below the minimum value which causes the formation of a noticeably blurry and/or dim image (significant amount of charge drain from photosensitive drum), the control circuit 13 switches the operational mode to the image formation mode (S77). If the amount ΔV by which the surface potential level of the photosensitive drum 1 changes has remained above the minimum value which causes a significant amount of charge drain from the photosensitive drum 1, the control circuit 13 puts the image forming apparatus 100 back into the charge drain suppression mode (S76).

As described above, in this embodiment, the state of the internal environment of the image forming apparatus 100 is checked before the occurrence of the significant amount of drawing of electrical charge from the photosensitive drum 1 is checked. Therefore, not only can the effects similar to those obtained by the ninth embodiment obtained, but also, the image forming apparatus 100 can be more efficiently operated in the charge drain suppression mode, in which the image forming apparatus 100 is operated in the charge drain suppression mode only when necessary.

Embodiment 11

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

Figure 25:
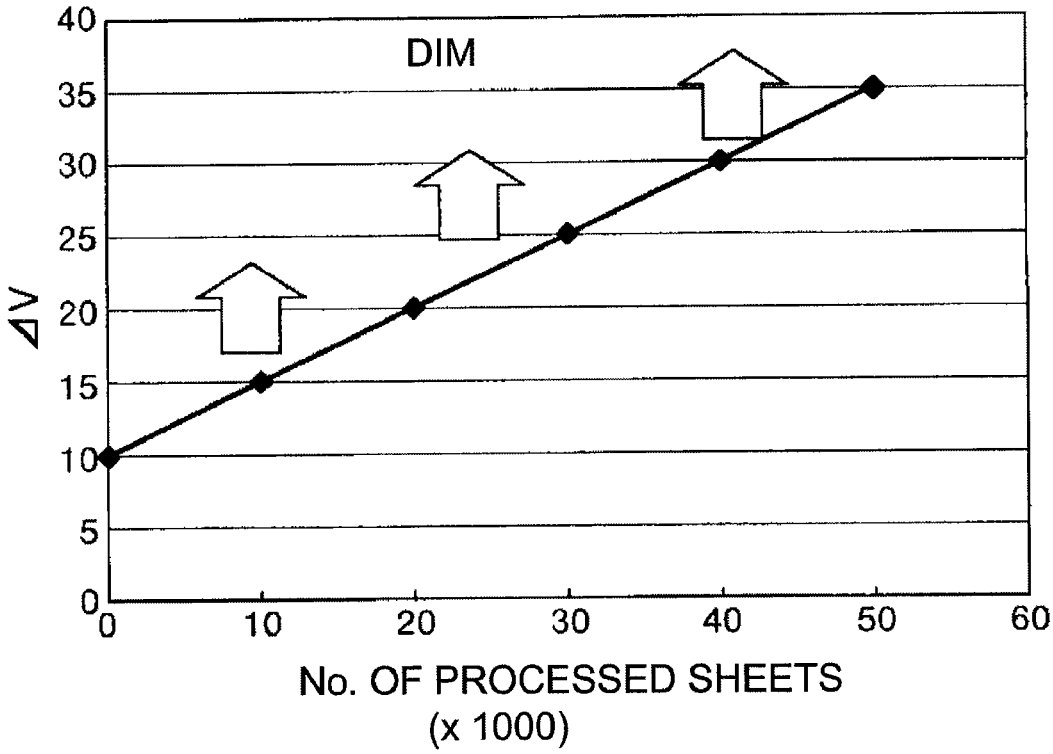
FIG. 25 is a graph which shows another example of relationship between the number of prints made, and the potential level of the peripheral surface of the photosensitive drum.
Figure 26:
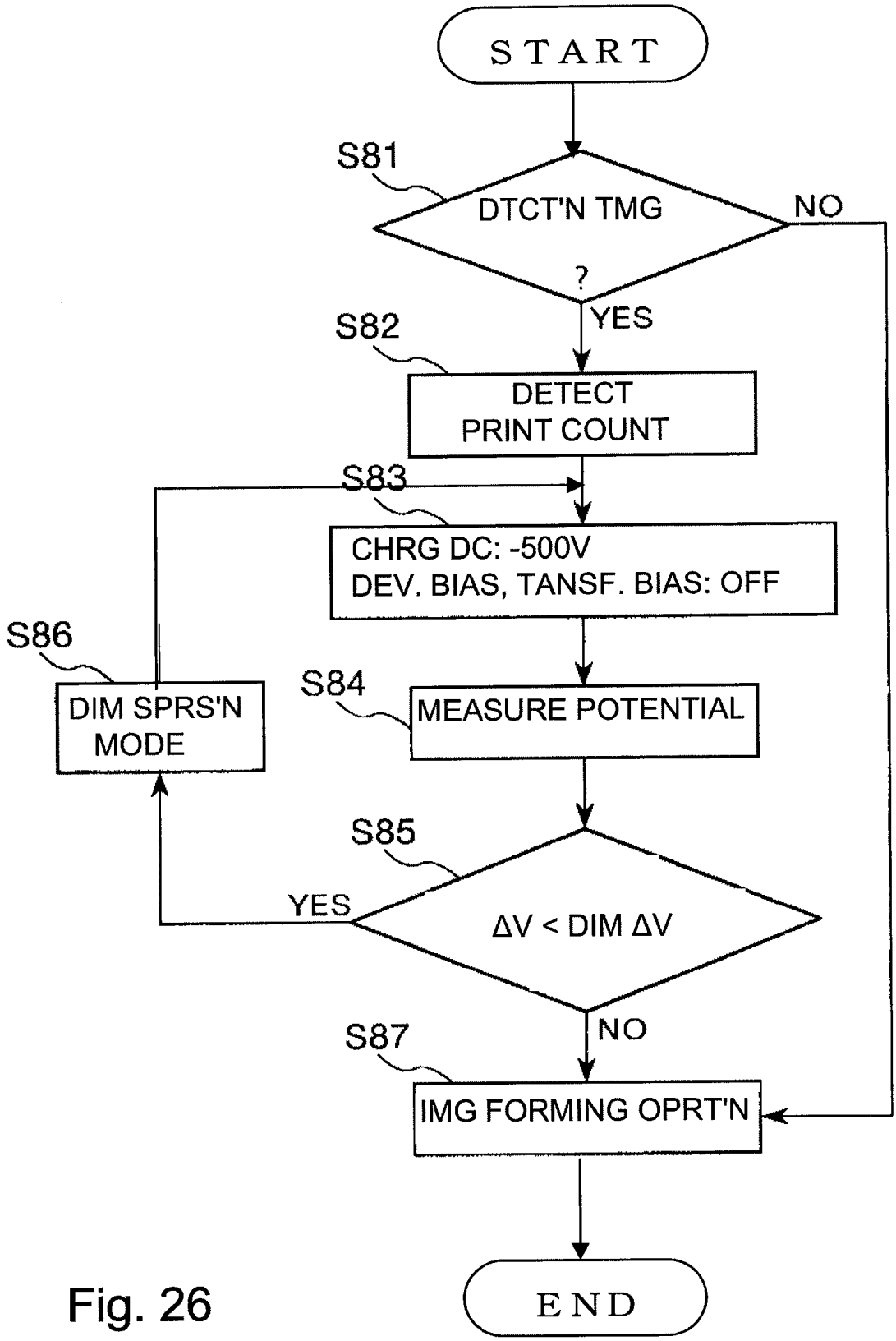
FIG. 26 is a flowchart of another example of the operational sequence for determining whether or not the image forming apparatus is to be operated in the charge drain suppression mode.

FIG. 25 is a graph which shows the relationship between the image formation count (cumulative count), as cumulative usage of image forming apparatus 100, and the amount ΔV of change in the photosensitive drum potential, above which the photosensitive drum 1 can cause the formation of a noticeably blurry and/or dim image.

Repetition of image formation reduces the photosensitive drum 1 in the thickness of its surface layer, and the reduction in the thickness of the surface layer of the photosensitive drum 1 reduces the photosensitive drum 1 in electrical resistance. Thus, if the surface potential of the photosensitive drum 1, which is measured by the electrometer 18 when the photosensitive drum 1 is in the condition which may cause the formation of a noticeably blurry and/or dim image is greater than that measured before the photosensitive drum 1 falls into the condition. Thus, in order to more precisely control the image forming apparatus 100, it is desired that, the threshold value for determining whether or not the photosensitive drum is in the condition which may cause the formation of a noticeably blurry and/or dim image, is variably set, that is, in accordance with the increase in the cumulative number of prints outputted by the image forming apparatus.

Referring to FIG. 19, in this embodiment, therefore, the image forming apparatus 100 is provided with an internal means (counter) 16 which cumulatively counts the number of prints outputted by the image forming apparatus 100. This cumulative print counter 16 cumulatively counts the number of prints made since the current photosensitive drum 1 was mounted in the image forming apparatus 100, as the number of prints, which is equivalent to the number of A4 prints. Then, the cumulative print counter 16 transmits the cumulative count to the control circuit 13.

FIG. 14 is an example of the flowchart of the operational sequence carried out to determine whether or not the operational mode is to be switched to the charge drain suppression mode, by determining, while no image is formed, whether or not the photosensitive drum 1 is in the condition which can cause the formation of a noticeably blurry and/or dim image.

As the charge drain detection timing arrives (S81), the control circuit 13 obtains the cumulative count of the prints made by the image forming apparatus 100 since the photosensitive drum 1 in the image forming apparatus 100 was brand-new, from the cumulative print counter 16 (S82).

Then, the control circuit 13 rotates the photosensitive drum 1, and applies a DC voltage (−500 V in this embodiment), which is no higher than the discharge start voltage Vth, to the charge roller 2 (S83). During this process, the exposing apparatus 3 is kept inactive, and neither development voltage nor the transfer voltage is applied (S83). With the voltages being set as described above, if the photosensitive drum 1 is in the condition which can cause the formation of a noticeably blurry and/or dim image, electrical charge is injected from the charge roller 2 into the photosensitive drum 1 even if the DC voltage applied to the charge roller 2 is no higher than the discharge start voltage Vth. The voltage injected into the photosensitive drum 1 is detected (measured), as the potential of the photosensitive drum 1, by the electrometer 18 (S84).

The control circuit 13 determines whether or not the amount ΔV of the change in the potential of the photosensitive drum 1, which was measured by the electrometer 18, is greater than a value (threshold value for determining whether or not change in potential level of photosensitive drum is large enough to cause formation of noticeably blurry and/or dim image; significant amount of charge drain from photosensitive drum) preset to determine whether or not the photosensitive drum 1 is in the condition which may causes the formation of a noticeably blurry and/or dim image, when the cumulative print count kept by the cumulative print counter 16 is current one (S85). Referring to FIG. 25, the values which are to be used as the threshold values for determining whether or not the amount, by which the potential of the photosensitive drum 1 changes, is large enough for causing the formation of a noticeably blurry and/or dim image, are set in advance in the control circuit 13 as shown in FIG. 25. If the amount ΔV of the change in the potential of the photosensitive drum 1 is no less than the threshold amount, the control circuit 13 determines that the operational mode is to be switched to the charge drain suppression mode (S86). If the amount ΔV of the change in the potential of the photosensitive drum 1 is no more than the minimum amount of current which causes the formation of a noticeably blurry and/or dim image, the control circuit 13 makes the image forming apparatus 100 carry out an image forming operation (S87). The various devices involved in this process are controlled by the control circuit 13.

In this embodiment, when the image forming apparatus 100 is in the charge drain suppression mode, the charge drain suppressing operation is carried out by the drum heater 9 in the photosensitive drum 1. That is, as the control circuit 13 determines that the operational mode is to be switched to the charge drain suppression mode, it turns on the electrical power source 10 for the drum heater 9 to reduce the relative humidity of the adjacencies of the peripheral surface of the photosensitive drum 1, in order to minimize the possibility of the occurrence of the formation of a noticeably blurry and/or dim image. More specifically, the control circuit 13 keeps the drum heater 9 turned on for one minute to operate the image forming apparatus 100 in the charge drain suppression mode, and then, puts the image forming apparatus 100 back into the charge drain detection mode (S83-85) to determine whether or not the photosensitive drum 1 is in the condition which can cause the formation of a noticeably blurry and/or dim image. If the amount Δ by which the surface potential level of the photosensitive drum 1 changes has fallen below the charge drain causing minimum value, the control circuit 13 switches the operational mode to the image formation mode (S87). If the amount Δ by which the surface potential level of the photosensitive drum 1 changes has remained above the charge drain causing minimum value, the control circuit 13 puts the image forming apparatus 100 back into the charge drain suppression mode (S86).

As described above, in this embodiment, the cumulative number of prints made by the image forming apparatus 100 is obtained from the cumulative print counter 16 before the occurrence of the formation of a noticeably blurry and/or dim image is checked. Therefore, not only can the effects similar to the effects obtained by the ninth embodiment be obtained, but also, the image forming apparatus 100 can be more efficiently operated in the charge drain suppression mode, in which the image forming apparatus 100 is operated only when necessary.

Embodiment 12

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

In the ninth to eleventh embodiments, the charge drain suppressing operation is carried out by the drum heater 9 in the photosensitive drum 1. That is, in order to minimize the occurrence of the formation of a noticeably blurry and/or dim image, the drum heater 9 is kept turned on to reduce the relative humidity in the adjacencies of the peripheral surface of the photosensitive drum 1.

In comparison, in this embodiment, as the image forming apparatus 100 is put in the charge drain suppression mode, only the photosensitive drum 1 is rotated (idled) for a preset length of time, as it was in the fourth embodiment, in order to prolong the period in which the cleaning blade 7*a* and the peripheral surface of the photosensitive drum 1 rub against each other in the area a of contact between the two. Prolonging the period in which the cleaning blade 7*a* and photosensitive drum 1 rub against each other makes it easier for the byproduct of electrical discharge, which is remaining adhered to the peripheral surface of the photosensitive drum 1, to be removed, which in turn makes the formation of a noticeably blurry and/or dim image less likely to occur.

The operational sequence for determining whether or not there is a sign of a significant amount of charge drain from the photosensitive drum 1, while no image is formed, to determine whether or not the operational mode is to be switched to the charge drain suppression mode, may be carried out following the flowchart described using FIG. 22. However, the operation carried out by the image forming apparatus 100 in this embodiment while the apparatus 100 is in the charge drain suppression mode, is different from those in the preceding embodiment.

That is, as the control circuit 13 determines that the operational mode is to be switched to the charge drain suppression mode (S65), it idly rotates the photosensitive drum 1 for 30 seconds, and then, puts the image forming apparatus 100 in the charge drain detection mode (S62-S64) to determine whether or not the photosensitive drum 1 is in the condition which may cause the formation of a noticeably blurry and/or dim image. If the amount ΔV by which the photosensitive drum potential changes has fallen below a value (10 V for example) below which the formation of a noticeably blurry and/or dim image will possibly occur, the control circuit 13 makes the image forming apparatus 100 switch to the image formation mode (S66). If the amount ΔV is remaining above the threshold value above which the formation of a noticeably blurry and/or dim image may occur, the control circuit 13 makes the image forming apparatus 100 switch back to the charge drain suppression mode (S65).

The charge drain suppressing operation may be carried out following the above described operational sequences in FIGS. 10 and 11.

As will be evident from the description of this embodiment given above, the same effects as those obtained by the image forming apparatuses 100 in the ninth to eleventh embodiments can be obtained by this embodiment, even though the operation carried out by the image forming apparatus 100 in this embodiment when the image forming apparatus 100 is in the charge drain suppression mode is different from those carried out by the image forming apparatuses 100 in the ninth to eleventh embodiments.

Embodiment 13

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

This embodiment is different from the ninth to twelfth embodiments in the operation sequence carried out by the image forming apparatus 100 when the apparatus is in the charge drain suppression mode.

In this embodiment, when the image forming apparatus 100 is in the charge drain suppression mode, the peripheral surface of the photosensitive drum 1 is supplied with polishing agent as in the fifth embodiment, in order to supply the area e of contact between the cleaning blade 7*a* and peripheral surface of the photosensitive drum 1 with the polishing agent to increase the friction between the cleaning blade 7*a* and peripheral surface of the photosensitive drum 1. Increasing the friction between the cleaning blade 7*a* and peripheral surface of the photosensitive drum 1 makes it easier for the byproducts of the electrical discharge, and the like, which are remaining adhered to the peripheral surface of the photosensitive drum, to be removed, which in turn makes it less likely for the formation of a noticeably blurry and/or dim image to occur. By the way, instead of increasing the friction between the cleaning blade 7*a* and peripheral surface of the photosensitive drum 1 by supplying the area a of contact between the cleaning blade 7*a* and photosensitive drum 1 with the polishing agent, the length of time the photosensitive drum 1 is idled to remove the byproducts of the electrical discharge, which is remaining on the peripheral surface of the photosensitive drum 1, and the like, may be prolonged.

That is, the byproducts of the electrical discharge, which are remaining adhered to the peripheral surface of the photosensitive drum 1, may be removed by making longer the length of time current flows between the photosensitive drum 1 and charging member 2 by an amount greater than a preset value when a voltage which is no higher than the discharge start voltage is applied to the charging member, than the length of time current flows between the photosensitive drum 1 and charging member 2 by an amount no greater than the preset value when the voltage which is no higher than the discharge start voltage is applied to the charging member.

The operational sequence carried out, while no image is formed, to determine whether or not the photosensitive drum 1 is in the condition which may cause the formation of a noticeably blurry and/or dim image, in order to determine whether or not the operational mode is to be switched to the charge drain suppression mode, may be carried out following the flowchart in FIG. 22. However, the charge drain suppressing operation carried out in this embodiment is different from the one in FIG. 22.

That is, in this embodiment, as the control circuit 13 determines that the operational mode is to be switched to the charge drain suppression mode (S65), it supplies the peripheral surface of the photosensitive drum 1 with polishing agent to deliver the polishing agent to the area e of contact between the cleaning blade 7*a* and peripheral surface of the photosensitive drum 1.

In this embodiment, the toner in the developing apparatus 4 contains the polishing agent which was added in advance. In the charge drain suppression mode, this toner is used to develop a latent image of a patch which is as wide as the total length of the photosensitive drum 1, and is 10 cm in its length in terms of the moving direction of the peripheral surface of the photosensitive drum 1. Also in this charge drain suppression mode, the transfer voltage is not applied so that the developed image of the patch (toner which contains polishing agent) is conveyed undisturbed through the transfer station d to be delivered to the area a of contact between the cleaning blade 7*a* and the peripheral surface of the photosensitive drum 1.

Then, the control circuit 13 makes the photosensitive drum 1 idly rotate for 10 seconds, and puts the image forming apparatus 100 in the charge drain detection mode (S62-S64) to determine whether or not the photosensitive drum 1 is in the condition which may cause the formation of a noticeably blurry and/or dim image. If the amount ΔV by which the photosensitive drum changes in potential level has fallen below the value (10 V for example) below which the formation of a noticeably blurry and/or dim image may occur, the control circuit 13 makes the image forming apparatus 100 switch to the image formation mode (S66). If the amount ΔV is remaining above the threshold value, above which the formation of a noticeably blurry and/or dim image may occur, the control circuit 13 makes the image forming apparatus 100 switch back to the charge drain suppression mode (S65).

The charge drain suppression mode in this embodiment may also be carried out following one of the flowcharts in the tenth and eleventh embodiments.

As described above, the effects of this embodiment are the same as those obtained by the ninth to twelfth embodiments, although the operation sequence carried out when the image forming apparatus 100 in this embodiment is in the charge drain suppression mode is different from those carried out by the image forming apparatuses 100 in the ninth to twelfth embodiments.

Embodiment 14

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

This embodiment is related to a case where the charge drain occurs across only a part or parts of the peripheral surface of the photosensitive drum 1.

If the photosensitive drum 1 falls into the condition which may cause the charge drain to occur across the entirety of the peripheral surface of the photosensitive drum 1, the occurrence of the formation of a noticeably blurry and/or dim image can be effectively suppressed with the use of one of the methods in the ninth to thirteenth embodiments described above. However, if any of the methods in the ninth to thirteenth embodiments is employed as the photosensitive drum 1 falls into the condition which may cause electrical charge to drain by a significant amount only across a part or parts of the peripheral surface of the photosensitive drum 1, the employment may use more time and material than necessary.

Next, therefore, referring to FIG. 27, for example, a case in which the draining of charge occurs across an area 131 of the peripheral surface of the photosensitive drum 1, the long edges of which extend from one end of the photosensitive drum 1 to the other in terms of the axial line of the photosensitive drum 1, and the short edges of which extends a short distance in the circumferential direction of the photosensitive drum 1, will be described.

Basically, the operational sequence to be carried out, while no image is formed, to determine whether or not the operational mode of the image forming apparatus is to be switched to the charge drain suppression mode, by determining whether or not a significant amount of electric charge has begun to drain from the photosensitive drum 1, may be carried out following the flowchart shown in FIG. 22. However, the actual operational sequence carried out in the charge drain suppression mode in this embodiment is different from the one shown in FIG. 22.

Figure 27:
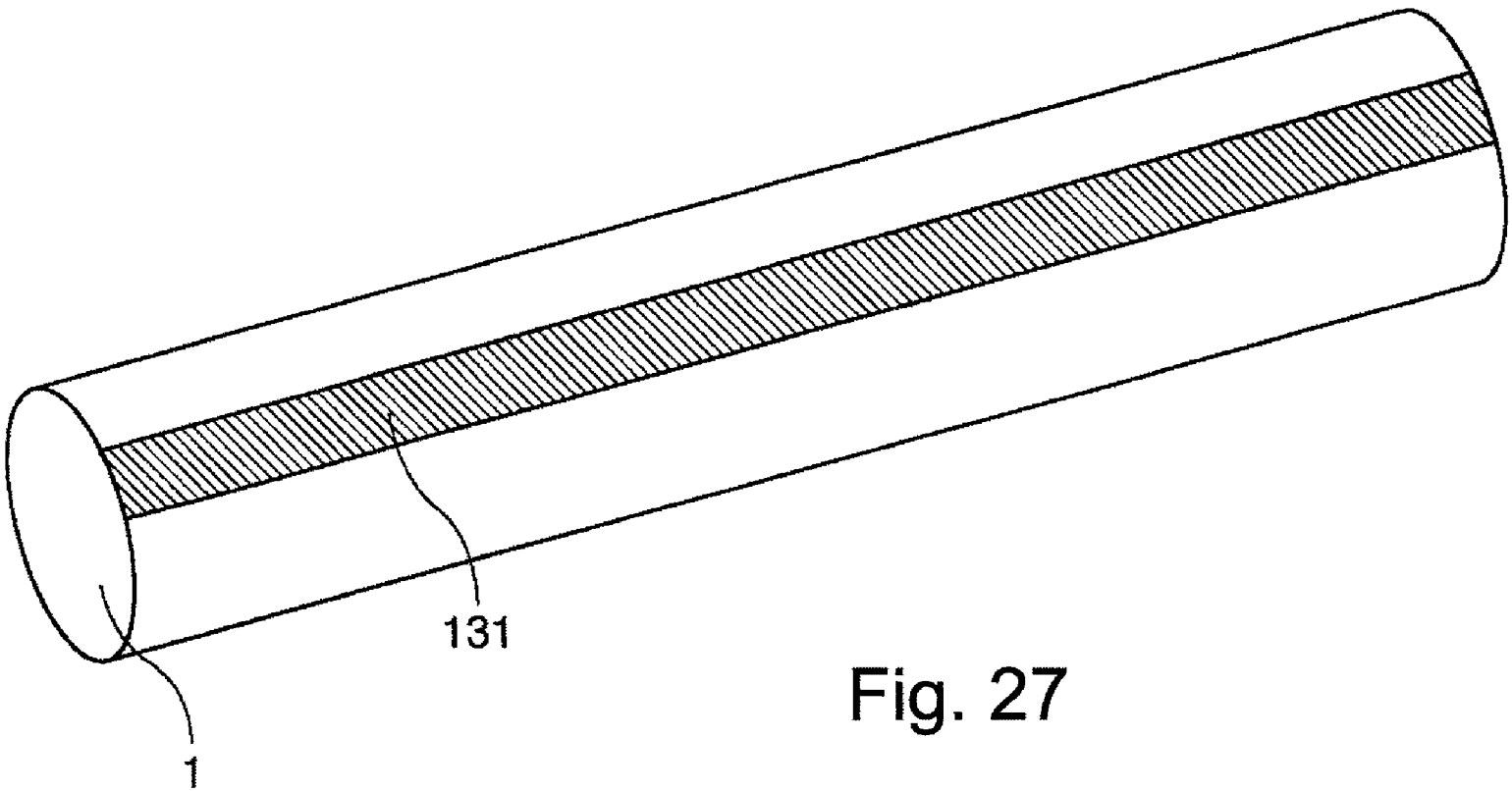
FIG. 27 is a diagrammatic drawing of the photosensitive drum, which is for describing the case in which the charge drain occurred across only a part, or parts, of the peripheral surface of the photosensitive drum.
Figure 28:
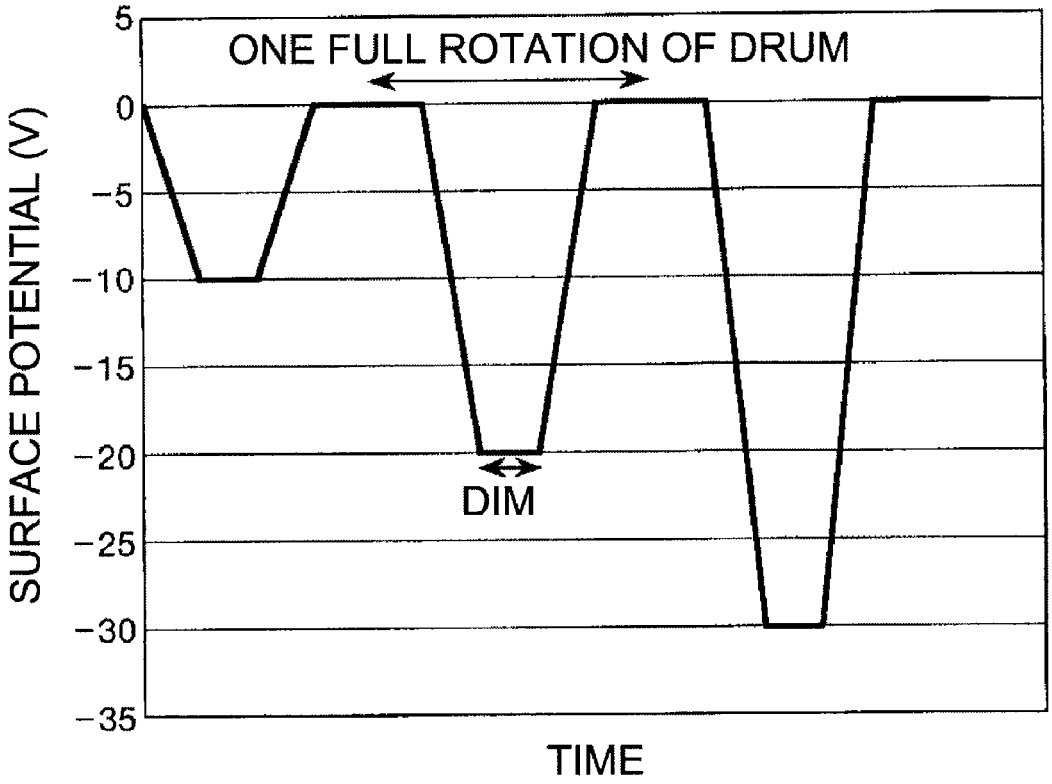
FIG. 28 is a graph which shows an example of the relationship between the potential level of the peripheral surface of the photosensitive drum, and the length of the elapsed time.

FIG. 28 shows the changes in the surface potential level of the photosensitive drum 1, which were measured by the electrometer 18 when a significant mount of draining of charge occurred only across the area 131 covered with oblique line in FIG. 27.

If electrical charge drains by a significant amount from the area 131 covered with the oblique lines in FIG. 27, electrical charge is injected into only the area 131, from which electrical charge drained by a significant amount. Thus, this portion of the peripheral surface of the photosensitive drum 1 increases in the absolute value of its surface potential.

In this embodiment, if the control circuit 13 determines that the amount ΔV of changes which occur to the potential level of the peripheral surface of the photosensitive drum 1 per full rotation of the photosensitive drum 1 has exceeded the charge drain occurrence threshold amount (10 V, for example) even across a part of the peripheral surface of the photosensitive drum 1 in terms of the rotational direction of the photosensitive drum 1, it determines that the formation of a noticeably blurry and/or image may occur across this part of the peripheral surface of the photosensitive drum 1.

As the control circuit 13 determines that the a part of the peripheral surface of the photosensitive drum 1 is in the condition which may cause the formation of a noticeably blurry and/or dim image, and therefore, the operational mode is to be switched to the charge drain suppression mode (S65), it carries out the following operational sequence. That is, it supplies the peripheral surface of the photosensitive drum 1 with polishing agent by an amount sufficient to suppress the formation of a noticeably blurry and/or dim image, which may occur across the part of the peripheral surface of the photosensitive drum 1, so that the polishing agent is sent to the area e of contact between the cleaning blade 7*a* and peripheral surface of the photosensitive drum 1.

In this embodiment, the developing apparatus 4 is filled with toner to which polishing agent was added in advance. In the charge drain suppression mode, this toner is used to develop a latent image of a patch which is as wide as the total length of the photosensitive drum 1, and the dimension of which in the moving direction of the peripheral surface of the photosensitive drum 1 is the same as the dimension of the area 131, in FIG. 27, in the moving direction of the peripheral surface of the photosensitive drum 1. Also in this charge drain suppression mode, the transfer voltage is not applied so that the developed patch (toner image which contains polishing agent) is conveyed undisturbed through the transfer station d to be delivered to the area a of contact between the cleaning blade 7*a* and peripheral surface of the photosensitive drum 1.

Then, the control circuit 13 makes the photosensitive drum 1 idly rotate for 10 seconds, and puts the image forming apparatus 100 in the charge drain detection mode (S62-S64) to determine whether or not the photosensitive drum 1 is in the condition which may cause the formation of a noticeably blurry and/or dim image. If the amount ΔV by which the photosensitive drum changes in potential level has fallen, across the entirety of the peripheral surface of the photosensitive drum 1 in terms of the rotational direction of the photosensitive drum 1, below the threshold value (10 V for example), above which the formation of a noticeably blurry and/or dim image may occur, the control circuit 13 makes the image forming apparatus 100 switch to the image formation mode (S66). If the amount ΔV is remaining above the threshold above which the formation of a noticeably blurry and/or dim image may occur, the control circuit 13 makes the image forming apparatus 100 switch back to the charge drain suppression mode (S65).

As described above, when the peripheral surface of the photosensitive drum 1 is partially in the condition which may cause the formation of a noticeably blurry and/or dim image, this embodiment can efficiently suppress the occurrence of the formation of a noticeably blurry and/or dim image, without unnecessarily consuming image formation supplies.

Embodiment 15

Next, another preferred embodiment of the present invention will be described. The components, portions, etc., of the image forming apparatus in this embodiment, the functions and structures of which are equivalent to, or the same as, the counterparts in the preceding preferred embodiments, are given the same referential codes as those given to describe the preceding preferred embodiments, and will not be described in detail.

In the embodiments 9-14, the electrometer 18 was unchangeable in position. Thus, the electrometer 18 in these embodiments can detect the occurrence of the draining of electrical charge only across the specific portion of the peripheral surface of the photosensitive drum 1 in terms of the lengthwise direction of the photosensitive drum 1. Usually, if the photosensitive drum 1 falls into the condition which may cause the formation of a noticeably blurry and/or dim image, the condition of the photosensitive drum 1 is such that the formation of the blurry and/or dim image is likely to occur across the entirety of the peripheral surface of the photosensitive drum 1 in terms of the lengthwise direction of the photosensitive drum 1. Therefore, it is usual that the satisfactory effects can be obtained by the methods in the ninth to fourteenth embodiments.

However, for example, if the formation of a noticeably blurry and/or dim image has not occurred across a portion of the peripheral surface of the photosensitive drum 1, which corresponds in position to the electrometer 18, but has occurred across another portion of the peripheral surface of the photosensitive drum 1, which does not correspond in position to the electrometer 18, the amount of surface potential, which is detected by the electrometer 18, does not change, and therefore, an image forming operation will be started will be started. In this case, therefore, it is possible that the image forming apparatus 100 will output an image which shows the effects of the draining of electric charge.

On the other hand, if a significant amount of draining of electrical charge occurs across the area of the peripheral surface of the photosensitive drum 1, which corresponds in position to the electrometer 18, but, does not occurs across the area of the of the peripheral surface of the photosensitive drum 1, which does not correspond in position to the electrometer 18, the operational mode will be switched to the charge drain suppression mode, and therefore, the image forming apparatus 100 will outputs an image which shows no effect of the draining of electrical charge. If the photosensitive drum 1 is polished in the charge drain suppression mode by supplying the peripheral surface of the photosensitive drum 1 with toner when the photosensitive drum 1 is in this condition, even the area of the peripheral surface of the photosensitive drum 1, across which the draining of electrical charge has not occurred, will be supplied with the toner, and therefore, the toner will be wasted. Further, it is possible that the photosensitive drum 1 will be shortened in service life by being unnecessarily polished across the portions of its peripheral surface, across which the draining of electrical charge has not occurred.

Figure 29:
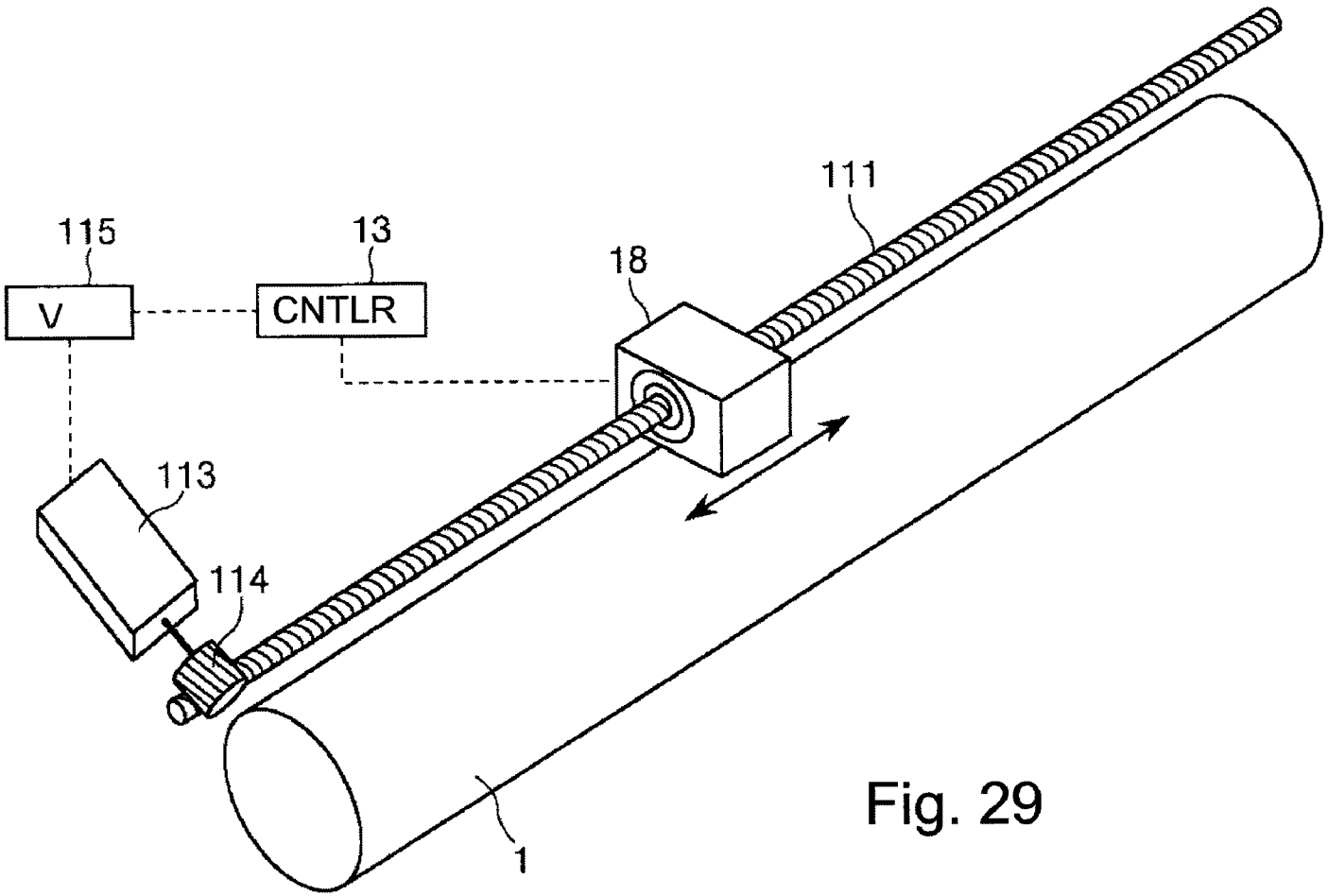
FIG. 29 is a diagrammatic perspective view of the surface potentiometer, and the mechanical and electrical setups for the potentiometer, in the image forming apparatus in the fifteenth preferred embodiment of the present invention.

In this embodiment, therefore, the image forming apparatus 100 is provided with a mechanism which can move the electrometer 18 in the direction parallel to the axial line of the photosensitive drum 1 as shown in FIG. 29.

To describe this mechanism in more detail, the mechanism is provided with a lead screw 111 (as electrometer supporting member), a gear 114 (as power transmitting member), and a motor 13 (mechanical power source), and is structured so that the lead screw 11 can be rotated in either direction by the motor 113 through the gear 114. The starting and stopping of the driving of the motor 113, and the driving direction of the motor 113, are controlled by the control circuit 13. The electric power for the motor 113 is supplied from a motor power source 115.

The electrometer 18 is supported by the lead screw 111; the lead screw 111 is put through the hole of the electrometer 18, the wall of which has a spiral groove. Thus, the electrometer 18 can be moved in the direction (indicated by arrow mark in FIG. 29) parallel to the axial line of the photosensitive drum 1 by the rotation of the lead screw 111. Thus, the electrometer 18 can be moved in at least one of the three dimensional directions.

Figure 30:
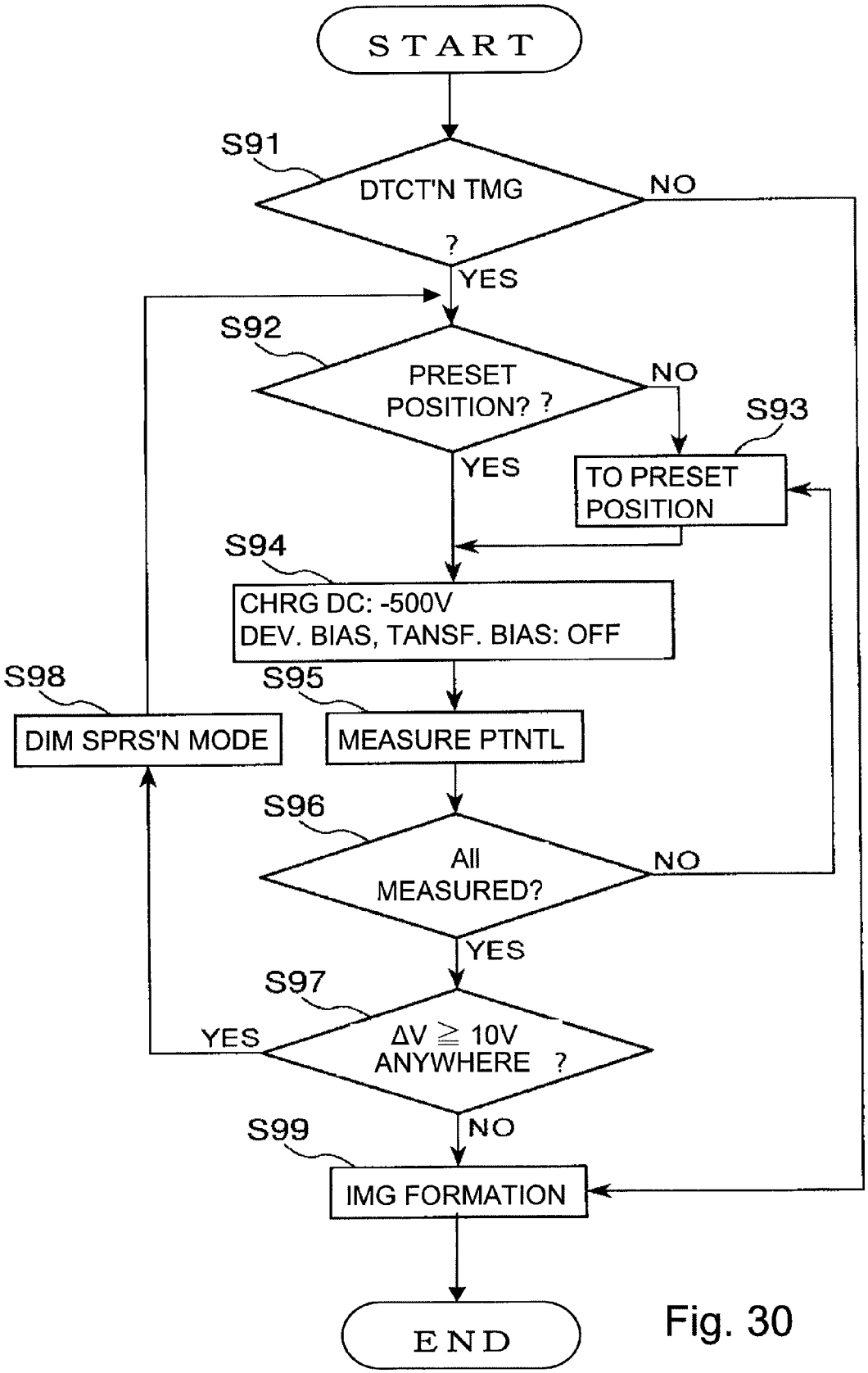
FIG. 30 is a flowchart of another example of the operational sequence for determining whether or not the image forming apparatus is to be operated in the charge drain suppression mode.

FIG. 30 is an example of the flowchart of the operational sequence carried out to determine whether or not electrical charge has begun to drain from the photosensitive drum 1 by a significant amount, in order to determine whether or not the operation mode is to be switched to the charge drain suppression mode. This operational sequence is carried out while no image is formed.

As the charge drain detection timing arrives (S91), the control circuit 13 detects the position of the electrometer 18 (S92). If the electrometer 18 is not at the first preset position, the control circuit 13 moves the electrometer 18 to the first preset position by rotating the lead screw 111 (S93). If the electrometer 18 is at the first preset position, the control circuit 13 rotates the photosensitive drum 1, and applies a DC voltage (−500 V in this embodiment), which is no higher than the discharge start voltage Vth, while rotating the photosensitive drum 1. During this operational sequence, the exposing apparatus 3 is not activated, and neither development voltage nor transfer voltage is applied (S94). With the voltages being set as described above, if the photosensitive drum 1 is in the condition which may cause the formation of a noticeably blurry and/or dim image, electric charge is injected from the charge roller 2 into the photosensitive drum 1 even though the DC voltage applied to the charge roller 2 is no higher than the discharge start voltage Vth. The injected charge is detected, as potential, by the electrometer 18 (S95).

Then, the control circuit 13 moves the electrometer 18 to each of the multiple preset positions in terms of the direction parallel to the lengthwise direction of the photosensitive drum 1, and measure the amount ΔV by which the potential level of the peripheral surface of the photosensitive drum 1 has changed at each preset position. Further, each time the control circuit 13 makes the electrometer 18 to measure the amount ΔV of the change in the potential level of the peripheral surface of the photosensitive drum 1, it checks whether or not the amount ΔV of the change in the potential level of the peripheral surface of the photosensitive drum 1 was measured at all the preset positions on the peripheral surface of the photosensitive drum 1 (S96). If the control circuit 13 finds that the amount ΔV of the change in the potential level of the peripheral surface of the photosensitive drum 1 was not measured at all the preset positions, it moves the electrometer 18 to the position(s) where the amount ΔV was not measured, and measures the amount ΔV at the preset position(s) where the amount ΔV was not measured (S93-S94). If the control circuit 13 finds that the amount ΔV was measured at all the preset positions, it determines whether or not any of the measured amount ΔV is greater than the charge drain occurrence threshold amount (10 V, for example) (S97). If any of the measured amount ΔV of the change in the potential level of the photosensitive drum 1 is higher than the charge drain occurrence threshold amount (voltage), the control circuit 13 changes the operational mode of the image forming apparatus 100 to the charge drain suppression mode (S98). On the other hand, if all of the measured amount ΔV are no higher than the charge drain occurrence threshold voltage, the control circuit 13 makes the image forming apparatus 100 start an image forming operation (S99).

If the control circuit 13 determines that the image forming apparatus 100 is to be put in the charge drain suppression mode, it supplies the peripheral surface of the photosensitive drum 1 with polishing agent to deliver the polishing agent to the area a of contact between the cleaning blade 7*a* and peripheral surface of the photosensitive drum 1.

In this embodiment, the toner in the developing apparatus 4 contains the polishing agent which was added to the toner in advance. In the charge drain suppression mode in this embodiment, a latent image of a patch which is as wide as the total length of the photosensitive drum 1, and the dimension of which in the moving direction of the peripheral surface of the photosensitive drum 1 is 10 cm, is formed across the portion of the peripheral surface of the photosensitive drum 1, which was greater in the amount ΔV of the change in the potential level of the peripheral surface of the photosensitive drum 1 than the charge drain occurrence threshold voltage, and this latent image is developed with the toner which contains the polishing agent. Also in this charge drain suppression mode, the transfer voltage is not applied so that the toner of the developed patch is allowed to reach the area e through the transfer station d.

Thereafter, the control circuit 13 idly rotates the photosensitive drum 1 for 10 seconds, and then, switches the operational mode of the image forming apparatus 100 back to the charge drain detection mode (S92-S97). If the amount ΔV of the change in the potential level of the peripheral surface of the photosensitive drum 1 has fallen below the charge drain occurrence threshold voltage, the control circuit 13 puts the image forming apparatus 100 into the image formation mode (S99). If the amount ΔV of the change in the potential level of the peripheral surface of the photosensitive drum 1 has remained higher than the charge drain occurrence threshold voltage, the control circuit 13 puts the image forming apparatus 100 back in the charge drain suppression mode (S98).

As described above, this embodiment can efficiently prevent the image forming apparatus 100 from outputting a print, the image of which appears blurry or dim, without wasting image formation supplies, even when the photosensitive drum 1 is in the condition which may allow electrical charge to drain from only a part or parts of the peripheral surface of the photosensitive drum 1.

Modified Versions of Preceding Embodiments

Heretofore, the present invention was described in the form of the actual embodiments of the present invention. However, the embodiments of the present invention are not to be limited to those described heretofore. Next, therefore, several modified versions of the above-described embodiments of the present invention will be described.

In the preceding embodiments described above, the operational sequence in which the sign of possible occurrence of charge drain is detected to determine whether or not the image forming apparatus is to be put in the charge drain suppression mode was carried out during the period in which no image is formed, that is, during the operational period in which the photosensitive drum 1 was preparatorily rotated. However, it is not mandatory that this operational sequence is carried out during the period in which the photosensitive drum 1 was preparatorily rotated. That is, the operational sequence may be carried out in any of the other periods in which no image is formed. For example, it may be carried out in the initial rotation period, paper interval period, or post-rotation period. Further, it may be carried out during two or more periods in which no image is formed.

Further, in the above described preceding embodiments, the methods for suppressing the charge drain were to heat the peripheral surface of the photosensitive drum 1 (heating method), to idle the photosensitive drum 1 (scrubbing method), or to polish the peripheral surface of the photosensitive drum 1 (polishing method). However, these methods may be employed in combination. The employment of the combination of these methods can better suppress the occurrence of the draining of electrical charge by a significant amount from the photosensitive drum. For example, the operation for removing the byproducts of electrical discharge on the photosensitive drum can be carried out while heating the photosensitive drum. Further, the operation for polishing the photosensitive drum to remove the byproducts of electrical discharge on the photosensitive drum can also be carried out while heating the photosensitive drum 1.

Some of the image forming apparatuses in the above described preceding embodiments were provided with a means for monitoring the current while applying a constant voltage to the charge roller during one of the periods in which no image is formed, or a means for monitoring the voltage while flowing constant current during one of the periods in which no image is formed. These means can be employed in combination.

In the case of the image forming apparatuses in the preceding embodiments described above, the pre-exposing apparatus was turned on to lower the photosensitive drum in potential, and keep the potential of the photosensitive drum at the lowered level, during the operation for detecting the draining of electrical charge from the photosensitive drum. However, instead of the exposing apparatus, a charge removing apparatus for providing the photosensitive drum with voltage may be disposed on the downstream side of the transfer station.

Further, the image forming apparatuses in the preceding embodiments were described as such image forming apparatuses that have a drum heater in the hollow of the photosensitive drum. However, the heating means does not need to be disposed in the photosensitive drum. That is, any heating means is acceptable as long as it can heat the photosensitive drum. For example, the drum heater may be a heater which provides the photosensitive drum with heat from outside the photosensitive drum.

Also in the preceding embodiments described above, the voltage which was applied to the charge roller to detect the occurrence of the draining of electrical charge from the photosensitive drum, was no higher than the discharge start voltage Vth, was −500 V. However, the DC voltage to be applied to the charge roller does not need to be −500 V. That is, all that is necessary is that the DC voltage to be applied to the charge roller is no higher than the discharge start voltage Vth. However, if the DC voltage to be applied to the charge roller is not −500 V, the charge drain occurrence threshold current value, and the charge drain occurrence threshold voltage, may also be different from the values mentioned in the descriptions of the preceding embodiments.

Also in the preceding embodiments described above, the image forming apparatuses were provided with a cleaning member. However, the present invention is also applicable to a so-called cleaner-less image forming apparatus, that is, an image forming apparatus which cleans its photosensitive member with its developing apparatus while developing a latent image on the photosensitive member. The effects of such an application are the same as those described above.

The photosensitive drum may be of a so-called direction injection type, that is, a photosensitive drum provided with a charge injection layer, the surface electrical resistance of which is in a range of $10^9$-$10^{14}$ Ω·cm. Even in the case of a photosensitive drum with no charge injection layer, the same effects as those described above can be obtained as long as the electrical resistance of its charge transfer layer, for example, is in the abovementioned range. Further, a photosensitive member, which is made of amorphous silicon, and the volume resistivity of the surface layer of which is rough $10^{13}$ Ω·cm, may be used as the photosensitive drum.

Also in the preceding embodiments described above, a charge roller was used as a flexible charging member of the contact type. However, a brush made of fur, felt, fabric, or the like, that is, a charging member different in shape and material from a charge roller, may be used as the charging member. Further, a charging member which is superior in terms of elasticity, electrical conductivity, surface properties, and durability, can be obtained by combining various materials.

The waveform of the alternating voltage component (voltage which periodically changes in value) of the oscillatory electrical voltage to be applied to the charge roller or development sleeve may be sinusoidal, rectangular, triangular, or the like; the waveform may be chosen as fit. Further, it may be in the form of a rectangular wave, which is formed by turning on and off a DC power source.

Further, in the preceding embodiments described above, a charging method which applies a combination of a DC voltage and an AC voltage, which is more likely to cause the draining of electrical charge from a photosensitive member than a DC voltage alone, was used as the charging method for image formation. However, the draining of electrical charge from the photosensitive member by a significant amount occurs even when a charging method which applies only a DC voltage is used, although the charge drain which occurs when only a DC voltage is applied is smaller than that which occurs when a combination of a DC voltage and an AC voltage is applied. The present invention is also effective with an image forming apparatus which uses a charging method which applies only a DC voltage.

Also in the preceding embodiment described above, a charge roller was used as a charging member of the contact type, which is used to detect the occurrence of the charge drain. However, any charging member of the contact type can be similarly used as a means for detecting the occurrence of the draining of electrical charge from the photosensitive member. For example, the charging member of any of the known charging devices, such as a charging device which uses a charging blade, and a charging device which uses a charging brush, can be used as the means for detecting the occurrence of the charge drain. Further, some transferring apparatuses which use a transfer roller are capable of changing a photosensitive drum in potential level by being placed in contact with the photosensitive drum, and therefore, they are capable of functioning as a charging member. Therefore, a transfer roller (transferring apparatus) which is in contact with a photosensitive drum, can be used to detect the occurrence of the draining of electrical charge from the photosensitive drum. In other words, a method for detecting the occurrence of the charge drain, using a transferring apparatus of the contact type, can be used with an image forming apparatus which uses a charging method of the corona type, as its charging means, instead of a charge roller which is a charging member of the contact type, and this transferring apparatus of the contact type can be used to detect the occurrence of the charge drain.

Further, in the preceding embodiments described above, a photosensitive drum was used as the image bearing first member. However, the image bearing first member may be a dielectric member, or the like, on which an image is electrostatically recordable. In a case where a dielectric member is used as the image bearing first member, the surface of the dielectric member is uniformly charged, and then, electrical charge is selectively removed from the numerous points on the charged surface of the dielectric member with the use of a charge removing means, such as a charge removal head (charge removal needle) and an electron gun, to write an electrostatic latent image, which corresponds to the information of an intended image.

Also in the preceding embodiments described above, an exposing apparatus which uses a laser was used as an exposing means (information writing means) for exposing the charged peripheral surface of a photosensitive member, and also, as a pre-exposing means. However, the exposing means may be a digital exposing means which uses an array of light emitting solid-state elements, for example, an array of LEDs. Further, it may be an analog image exposing means, which uses a halogen lamp, a fluorescent light, or the like, as its original illuminating light source.

Further, in the preceding embodiments described above, a transferring method which uses a transfer roller as its transferring means was used. However, the transferring means may be one of the other transferring means of the contact type than a transfer roller. For example, it may be a transferring means which uses a blade, a transferring means which uses a belt, etc. Moreover, it may be a transferring method of the noncontact type, which uses a charging device of the corona type.

Also in the preceding embodiments described above, the image forming apparatuses were those which directly transfer a monochromatic toner image formed on a photosensitive drum, onto a sheet of transfer medium. However, the present invention is also applicable to an image forming apparatus which can form not only a monochromatic image, but also, a multicolor image, or a full-color image, through a multilayer transfer process, with the use of an intermediary transfer member, such as a transfer drum and a transfer belt.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 284885/2008 filed Nov. 5, 2008, which is hereby incorporated by reference.

What is claimed is:

1. An image forming apparatus comprising:

a photosensitive member;

a charging member contactable to said photosensitive member to electrically charge said photosensitive member;

an applying unit that applies a charging bias voltage to said charging member;

a detecting unit that detects a current flowing between said charging member and said photosensitive member; and a control unit that controls said image forming apparatus to execute an operational mode for removing an electric discharge product deposited on a surface of said photosensitive member, in a case where said detecting unit detects a DC current equal to or greater than a predetermined value when a DC voltage, lower than a voltage at which an electric discharge starts between said photosensitive member and said charging member, is applied to said charging member.

2. An apparatus according to claim 1, wherein said applying unit causes said charging member to electrically charge said photosensitive member by applying a bias voltage sufficient to cause said charging member to electrically discharge.

3. An apparatus according to claim 1, further comprising:

a scrubbing member configured to scrub a surface of said photosensitive member, wherein said control unit operates said scrubbing member in the operational mode.

4. An apparatus according to claim 1, further comprising:

an abrading unit which supplies abrasion particles to said photosensitive member to abrade a surface of said photosensitive member, wherein said control unit operates said abrading unit in the operational mode.

5. An apparatus according to claim 1, wherein during an image forming operation said applying unit applies a charging bias voltage which is in the form of an AC voltage biased with a DC voltage to said charging member to charge said photosensitive member, and said applying unit applies only a DC voltage less than the discharge starting voltage value when it is determined whether or not the operational mode to remove the electric discharge product is to be executed.

6. An image forming apparatus comprising:

a photosensitive member;

a charging member contactable to said photosensitive member to electrically charge said photosensitive member;

an applying unit that applies a charging bias voltage to said charging member;

a heating unit that heats said photosensitive member;

a detecting unit that detects a current flowing between said charging member and said photosensitive member; and a control unit that controls said heating unit to heat said photosensitive member, in a case where said detecting unit detects a DC current equal to or greater than a predetermined value when a DC voltage, lower than a voltage at which an electric discharge starts between said photosensitive member and said charging member, is applied to said charging member.

7. An image forming apparatus comprising:

a photosensitive member;

a charging member contactable to said photosensitive member to electrically charge said photosensitive member;

an applying unit that applies a charging bias voltage to said charging member;

a potential sensor configured to measure a potential of a surface of said photosensitive member; and a control unit that controls said image forming apparatus to execute a removing mode operation for removing an electric discharge product deposited on the surface of said photosensitive member, in a case where an absolute value of the potential measured by said potential sensor is equal to or greater than a predetermined value at the surface contacted by said charging member and supplied with a DC voltage lower than a voltage at which an electric discharge starts between said photosensitive member and said charging member.

8. An image forming apparatus comprising:

a photosensitive member;

a charging member contactable to said photosensitive member to electrically charge said photosensitive member;

an applying unit that applies a charging bias voltage to said charging member;

a heating unit that heats said photosensitive member;

a potential sensor configured to measure a potential of a surface of said photosensitive member; and a control unit that controls said heating unit to heat said photosensitive member, in a case where an absolute value of the potential measured by said potential sensor is equal to or greater than a predetermined value at the surface contacted by said charging member and supplied with a DC voltage lower than a voltage at which an electric discharge starts between said photosensitive member and said charging member.

9. An image forming apparatus comprising:

a photosensitive member;

a charging member contactable to said photosensitive member to electrically charge said photosensitive member;

a cleaning member for cleaning said photosensitive member;

an applying unit that applies a charging bias voltage to said charging member; and a detecting unit that detects a current flowing between said charging member and said photosensitive member, wherein in a case where said detecting unit detects a DC current equal to or greater than a predetermined value when a DC voltage, lower than a voltage at which an electric discharge starts between said photosensitive member and said charging member, is applied to said charging member, a rotation duration of said photosensitive member is made longer than a rotational duration in an other case.

* * * * *